US005879869A

United States Patent [19]

Kase et al.

[11] Patent Number: 5,879,869

[45] Date of Patent: Mar. 9, 1999

[54] SILVER HALIDE COLOR PHOTOGRAPHIC LIGHT-SENSITIVE MATERIAL

[75] Inventors: Akira Kase; Yoshiharu Yabuki; Shigeaki Otani, all of Kanagawa, Japan

[73] Assignee: Fuji Photo Film Co., Ltd, Japan

[21] Appl. No.: 724,399

[22] Filed: Oct. 2, 1996

Related U.S. Application Data

[63] Continuation of Ser. No. 400,509, Mar. 7, 1995, abandoned, which is a continuation-in-part of Ser. No. 357,232, Dec. 12, 1994, abandoned.

[30] Foreign Application Priority Data

Dec. 15, 1993 [JP] Japan ..... 5-343516

[51] Int. Cl.[6] ..... G03C 1/83; G03C 7/32

[52] U.S. Cl. ..... 430/507; 430/522

[58] Field of Search ..... 430/507, 510, 430/217, 522

[56] References Cited

U.S. PATENT DOCUMENTS

| | | | |
|---|---|---|---|
| 4,420,555 | 12/1983 | Krueger et al. | 430/507 |
| 4,764,455 | 8/1988 | Arakawa et al. | 430/517 |
| 4,857,446 | 8/1989 | Diehl et al. | 430/510 |
| 4,920,031 | 4/1990 | Ohno et al. | 430/522 |
| 4,940,654 | 7/1990 | Diehl et al. | 430/522 |
| 5,061,615 | 10/1991 | Kase et al. | 430/567 |
| 5,063,146 | 11/1991 | Inagaki et al. | 430/522 |
| 5,143,822 | 9/1992 | Nishio | 430/517 |
| 5,232,825 | 8/1993 | Hattori et al. | 430/517 |
| 5,238,799 | 8/1993 | Usami et al. | 430/522 |
| 5,278,037 | 1/1994 | Karino | 430/517 |
| 5,326,686 | 7/1994 | Katoh et al. | 430/522 |
| 5,340,707 | 8/1994 | Ohnishi et al. | 430/517 |
| 5,346,810 | 9/1994 | Ohno | 430/522 |
| 5,356,766 | 10/1994 | Idogaki | 430/522 |
| 5,360,702 | 11/1994 | Zengerle et al. | 430/517 |
| 5,374,507 | 12/1994 | Yoshioka | 430/507 |
| 5,393,653 | 2/1995 | Kawai | 430/569 |
| 5,437,970 | 8/1995 | Shono | 430/522 |

FOREIGN PATENT DOCUMENTS

| | | | |
|---|---|---|---|
| 0 554 834 | 8/1993 | European Pat. Off. . | |
| 0554834 | 8/1993 | European Pat. Off. | 430/510 |
| 2-282244 | 11/1990 | Japan . | |
| 2296241 | 12/1990 | Japan . | |
| 0 571 959 | 12/1993 | Japan . | |

OTHER PUBLICATIONS

D.M. Sturmer et al., The Theory of the Photographic Process, 4th Edition, Sensitizing and Desensitizing Dyes, pp. 194–200.

*Primary Examiner*—Richard L. Schilling

[57] ABSTRACT

A silver halide color photographic light-sensitive material which comprises a support having thereon photographic constituting layers comprising blue, green and red sensitive silver halide emulsion layers, and a light-insensitive hydrophilic colloidal layer, wherein the photographic constituting layers contain, in combination or separately, at least one compound represented by the following formula (1):

(1)

wherein $R^1$, $R^2$, and $R^3$ represent specific groups, and $L^1$, $L^2$, and $L^3$ each independently represents methine; and at least one compound selected from the group consisting of the compounds represented by the following formulas (2) and (3):

$$A^1{=}L{-}Q \quad (2)$$

$$A^1{=}L{-}A^2 \quad (3)$$

wherein $A^1$ or $A^2$ each independently represents an acidic nucleus, Q represents aryl or a heterocyclic ring, and L represents methine. The light-insensitive hydrophlic colloidal layer exhibits antihalation effect.

25 Claims, No Drawings

SILVER HALIDE COLOR PHOTOGRAPHIC LIGHT-SENSITIVE MATERIAL

This application is a continuation, of application Ser. No. 08/400,509 filed on Mar. 7, 1995, now abandoned, which is a continuation-in-part of application Ser. No. 08/357,232 filed Dec. 12, 1994, now abandoned.

FIELD OF THE INVENTION

The present invention relates to a silver halide color photographic light-sensitive material having a hydrophilic colloidal layer which has been dyed, and particularly, to a silver halide color photographic light-sensitive material having a hydrophilic colloidal layer containing a dye which is photochemically inactive, which has excellent light-absorption characteristics, and which is discolored and/or leached away without giving a residual color stain during a development process, the layer containing the dye in a dispersion form of solid fine particles so as to prevent transfer of the dye from the hydrophilic colloidal layer.

BACKGROUND OF THE INVENTION

In the manufacture of silver halide color photographic light-sensitive materials, it is a frequent practice that hydrophilic colloidal layers such as photographic emulsion layers are colored in order to absorb a specific wave length.

A colored layer known as an antihalation layer may also be provided in order to prevent a picture image from being shaded, or to prevent halation. Halation is caused as follows: light is scattered when or after it passes through a photographic emulsion layer and is reflected at the interface between the emulsion layer and its support or at the surface of a light-sensitive material opposite the emulsion layer, and then enters the photographic emulsion layer again. In cases where a plurality of photographic emulsion layers exist, an antihalation layer is sometimes placed between two of the layers.

The hydrophilic colloidal layers to be colored generally contain a dye. The dye must satisfy the following requirements:

(1) it must have a spectral absorption suitable for the purpose of use, (2) it must be photochemically inactive, i.e., must result in no adverse chemical effects, such as deteriorated sensitivity, regression of latent image, or fogging, on the performance of a silver halide photographic emulsion layer, (3) it must not leave a harmful stain on a processed photosensitive material by discoloration during a photographic processing, or by leaching out of the material into a process liquid or washing water, (4) it must not diffuse from a layer in which the dye is incorporated into another layer, and (5) it must have excellent stability over time while in a solution or a photographic material, never causing color fading.

Particularly, when a colored layer is an antihalation layer placed on the same side of a support as a photographic emulsion layer, it is often required that the colored layer be selectively colored and other layers not be substantially colored. Otherwise, the other layers will be affected by a harmful spectral effect. In addition, the effect as the antihalation layer will be reduced. However, when the layer containing a dye contacts other hydrophilic colloidal layers under wet conditions, part of the dye sometimes diffuses from the former layer into the latter layers.

Hitherto, great efforts have been made in order to prevent diffusion of a dye.

For example, there have been disclosed a method in which, together with a dissociated anionic dye, a hydrophilic polymer with the opposite electrical charge is incorporated as a mordanting agent into a specific layer or layers to localize the dye in the layer(s) by the interaction between the molecules of the dye and the polymer (U.S. Pat. Nos. 2,548,564, 4,124,386, and 3,525,694); a method in which a specific layer is dyed using fine particles of a salt of a metal to which a dye has been adsorbed (for example, U.S. Pat. Nos. 2,719,088, 2,496,841, and 2,496,843, and JP-A-60-45,237); and a method in which a specific layer is dyed with a solid dye insoluble in water (JP-A-55-120,030, JP-A-56-12,639, JP-A-55-155,350, JP-A-56-155,351, JP-A-63-27,838, JP-A-63-197,943, JP-A-52-92,716, European Patent Application Nos. 15601, 323,729, 274,723, 276,566, and 299,435A, and WO 88/04794). Among these, the method of dyeing a specific layer with a solid dye is superior in that diffusion is prevented. This method, however, has drawbacks with respect to photographic performance (low color density, residual color when a sample is treated after passage of time, effects on photographic sensitivity, etc.), because the solid dye must be added in large amounts to a photosensitive material due to its low absorption per unit weight. In addition, there are other drawbacks due to the low speed of decoloration during a developing process. Thus, the decoloring function cannot necessarily be fully obtained when changes have been made in various factors including speed-up of the process, improvement in the composition of a processing liquid, or improvement in the composition of a photographic emulsion composition.

In silver halide color photographic light-sensitive materials having at least one blue sensitive silver halide emulsion layer, at least one green sensitive silver halide emulsion layer, and at least one red sensitive silver halide emulsion layer, it is preferred that a dye for antihalation has a wide range of absorption from 400 to 700 nm. Examples of such a dye include 1) combined use of a monomethine pyrazolone oxonole dye and a pentamethyne pyrrazolone oxonole dye (JP-A-52-92,716), 2) combined use of an arylidene dye or a monomethine pyrazolone oxonole dye and a pentamethine barbituric oxonole dye (JP-A-63-27,838) and 3) a single use of a pyrazolopyridone oxonole dye (JP-A-2-282,244).

However, when the inventors of the present invention prepared a silver halide photographic light-sensitive material having an antihalation layer based on the examples described in the above publications, it was found that combined dyes 1) described above resulted in a great reduction in the color density after a developing process compared with the case where an antihalation layer is not provided, that combined dyes 2) could not provide desired sharpness because the dyes are not securely fixed in the antihalation layer, leading to deteriorated sensitivity, and that single dye 3) cannot yield sufficient yellow sharpness and reduces the color density after a developing process.

SUMMARY OF THE INVENTION

Accordingly, a first object of the present invention is to provide a silver halide color photographic light-sensitive material comprising a combination of light-absorptive dyes which dye a specific hydrophilic colloidal layer in the photographic light-sensitive material, which do not diffuse into other layers, which are rapidly discolored during a developing process, and which have a light-absorbing ability over the spectrum of the visible light region.

A second object of the present invention is to provide a silver halide color photographic light-sensitive material which comprises a hydrophilic colloidal layer colored with a combination of dyes which do not adversely affect photographic characteristics.

These objects can be accomplished by the following:

[1] A silver halide color photographic light-sensitive material which comprises a support having thereon photographic constituting layers comprising a blue sensitive silver halide emulsion layer containing a yellow coupler, a green sensitive silver halide emulsion layer containing a magent coupler, a red sensitive silver halide emulsion layer containing a cyan coupler, and a light-insensitive hydrophlic colloidal layer, wherein the photographic constititung layers contain, in combination or separately, at least one compound represented by the following formula (1):

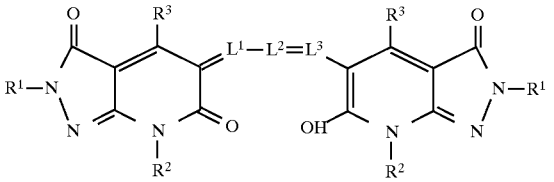

(1)

wherein $R^1$ represents a hydrogen atom, an alkyl group, an aryl group or a heterocyclic ring group, $R^2$ represents a hydrogen atom, an alkyl group, an aryl group, a heterocyclic ring group, $COR^4$ or $SO_2R^4$, $R^3$ represents a hydrogen atom, a cyano group, a hydroxyl group, a carboxyl group, an alkyl group, an aryl group, $CO_2R^4$, $OR^4$, $NR^5R^6$, $CONR^5R^6$, $NR^5COR^4$, $NR^5SO_2R^4$, or $NR^5CONR^5R^6$ (wherein $R^4$ represents an alkyl group or an aryl group, and $R^5$ and $R^6$ represent a hydrogen atom, an alkyl group or an aryl group), and $L^1$, $L^2$, and $L^3$ each independently represents a methine group; and at least one compound selected from the members consisting of the compounds represented by the following formulas (2) and (3):

$$A^1{=}L{-}Q \quad (2)$$

$$A^1{=}L{-}A^2 \quad (3)$$

wherein $A^1$ and $A^2$ each independently represents an acidic nucleus, Q represents an aryl group or a heterocyclic ring group, and L represents a methine group, provided that each of the compounds represented by formulas (1), (2), and (3) has, in the molecule, at least one dissociating group selected from the group consisting of carboxyl, sulfonamide, arylsulfamoyl, sulfonylcarbamoyl, carbonylsulfamoyl, an enol group of an oxonole dye, and phenolic hydroxyl, and each compound does not contain any other groups which render the compounds soluble in water, each compound being in a dispersion form of solid fine particles.

[2] The silver halide color photographic light-sensitive material according to [1], wherein the hydrophilic colloidal layer is located between the support and the silver halide emulsion layer which is closest to the support, and contains at least one compound represented by formula (1) and at least one compound selected from the members consisting of the compounds represented by formulas (2) and (3) in a dispersion form of solid fine particles.

[3] The silver halide color photographic light-sensitive material according to [2], wherein the ratio by weight of the total amounts of the compounds incorporated in dispersion forms of solid fine particles to the amount of hydrophilic colloids contained in the hydrophilic colloidal layer which is present between the support and the silver halide emulsion layer closest to the support is in the range from 0.05 to 0.3.

[4] The silver halide color photographic light-sensitive material according to [1], wherein the hydrophilic colloidal layer, between the support and the blue-sensitive silver halide emulsion layer, contains at least one compound selected from the compounds of formulas (2) and (3), and another hydrophilic colloidal layer, between the blue-sensitive silver halide emulsion layer and the red-sensitive silver halide emulsion layer, contains at least one compound represented by formula (1).

Preferably, this embodiment is applied to a color photographic light-sensitive material having a blue sensitive silver halide emulsion layer as the nearest photosensitive layer to the support, a red sensitive silver halide emulsion layer as the secondly nearest photosensitive layer thereto, and a green sensitive silver halide emulsion layer as the farthest photosensitive layer thereto.

[5] The silver halide color photographic light-sensitive material according to [1], wherein an antistatic layer is provided by application thereof on the surface of the support opposite the surface on which the silver halide emulsion layer is provided.

DETAILED DESCRIPTION OF THE INVENTION AND PREFERRED EMBODIMENTS

The compound represented formula (1) will be described in detail.

The alkyl groups which are represented by $R^1$, $R^2$, $R^3$, $R^4$, $R^5$, and $R^6$ are preferably those having 1 to 6 carbon atoms. Examples of them include methyl, ethyl, n-propyl, isopropyl, n-butyl, tert-butyl, n-hexyl, and cyclohexyl. The alkyl groups may have a substituent, examples of which include hydroxyl, carboxyl, cyano, nitro, alkoxy (for example, methoxy and ethoxy), halogen (for example, chlorine, bromine, and fluorine), aryl (for example, phenyl, 4-carboxyphenyl, 4-hydroxyphenyl, and 4-methanesulfonamidephenyl), amino (for example, unsubstituted amino, dimethylamino, and diethylamino), acylamino (for example, acetylamino and benzoylamino), sulfonamide (for example, methanesulfonamide and benzenesulfonamide), carbamoyl (for example, unsubstituted carbamoyl, methylcarbamoyl, ethylcarbamoyl, and phenylcarbamoyl), and sulfamoyl (for example, unsubstituted sulfamoyl, methylsulfamoyl, and phenylsulfamoyl).

The aryl groups which are represented by $R^1$, $R^2$, $R^3$, $R^4$, $R^5$, and $R^6$ are preferably phenyl or naphthyl groups. They may have a substituent, examples of which include hydroxyl, carboxyl, cyano, nitro, alkoxy (for example, methoxy and ethoxy), halogen (for example, chlorine, bromine, and fluorine), amino (for example, unsubstituted amino, dimethylamino, and diethylamino), acylamino (for example, acetylamino, pivaloylamino, and benzoylamino), sulfonamide (for example, methanesulfonamide and benzenesulfonamide), carbamoyl (for example, unsubstituted carbamoyl, methylcarbamoyl, ethylcarbamoyl, and phenylcarbamoyl), sulfamoyl (for example, unsubstituted sulfamoyl, methylsulfamoyl, and phenylsulfamoyl), ureido (for example, 3-methylureido and 3-(p-carboxyphenyl) ureido), alkyl (for example, methyl, ethyl, n-propyl, tert-butyl, and isopropyl), and ester (methoxycarbonyl, ethoxycarbonyl, and acetyloxy).

The heterocyclic groups represented by $R^1$ and $R^2$ are preferably 5-membered or 6-membered nitrogen-containing heterocyclic rings having at least one nitrogen atom (for example, pyridine-2-yl, quinoline-2-yl, benzothiazol-2-yl, benzooxazol-2-yl, and pyrimidine-2-yl). They may have a substituent, examples of which include hydroxyl, carboxyl, cyano, halogen (for example, chlorine, bromine, and fluorine), acylamino (for example, acetylamino, benzoylamino, and 4-cyanobenzoylamino), and sulfonamide (for example, methanesulfonamide and benzenesulfonamide).

The methine groups represented by $L^1$, $L^2$, and $L^3$ encompass unsubstituted methine groups, substituted methine groups which have a substituent such as methyl, ethyl, benzyl, phenyl, cyano, carboxy, fluorine, or chlorine, and rings which are formed by methine groups linked together. Examples of the rings include the compounds represented by the following formula (6).

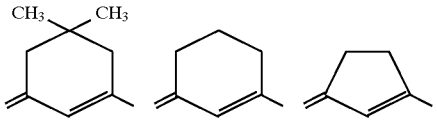

(6)

Among the compounds represented by formula (1), preferred is one wherein $R^1$ is phenyl having at least one group selected from the group consisting of carboxyl, sulfonamide, and sulfamoyl; $R^2$ is hydrogen; $R^3$ is hydrogen, C1 to C4 alkyl (This means an alkyl group having 1 to 4 carbon atoms. The similar expressions in any sentences are similar meanings), ester, or carboxyl; and $L^1$, $L^2$, and $L^3$ are respectively unsubstituted methine. Preferable examples of $R^1$ include 4-carboxyphenyl, 3-carboxyphenyl, 2-carboxyphenyl, 3,3-dicarboxyphenyl, 2,4-dicarboxyphenyl, 2,5-dicarboxyphenyl, 4-methanesulfonamidephenyl, 4-benzenesulfonamidephenyl, 4-sulfamoylphenyl, and 4-(N-phenylsulfamoyl)phenyl. Preferable examples of $R^3$ include hydrogen, methyl, and in particular, the compounds represented by the following formula.

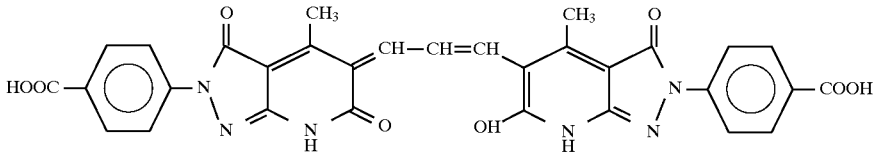

Examples of the compounds represented by formula (1) other than those illustrated above will be described hereinafter, which should not be construed as limiting the invention.

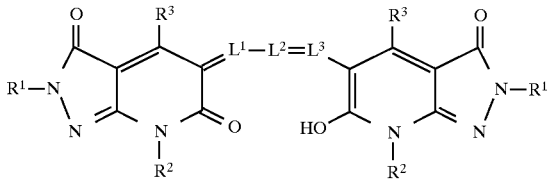

| | $-R^1$ | $-R^2$ | $-R^3$ | $=L^1-L^2=L^3-$ |
|---|---|---|---|---|
| 1-1 | 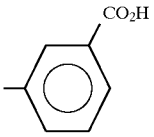 | $-H$ | $-CH_3$ | $=CH-CH=CH-$ |
| 1-2 | 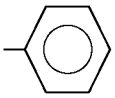 | $-H$ | $-CH_3$ | $=CH-CH=CH-$ |
| 1-3 | $-CH_3$ | $-H$ | $-CH_3$ | $=CH-CH=CH-$ |
| 1-4 | 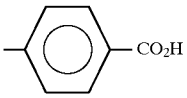 | $-CH_3$ | $-CH_3$ | $=CH-CH=CH-$ |
| 1-5 | 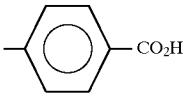 | 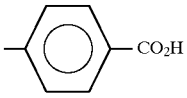 | $-CH_3$ | $=CH-CH=CH-$ |
| 1-6 | 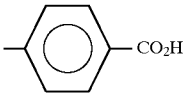 | $-CH_3$ | $-CO_2C_2H_5$ | $=CH-CH=CH-$ |

-continued
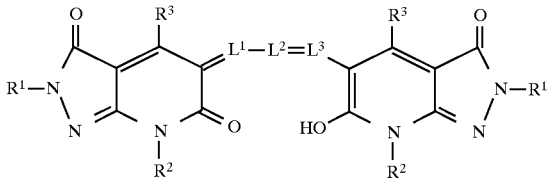
| | $-R^1$ | $-R^2$ | $-R^3$ | $=L^1-L^2=L^3-$ |
|---|---|---|---|---|
| 1-7 | 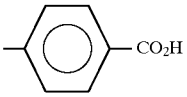 | $-CH_3$ | $-CO_2H$ | $=CH-CH=CH-$ |
| 1-8 | $-CH_3$ | 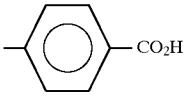 | $-CH_3$ | $=CH-CH=CH-$ |
| 1-9 | $-CH_3$ | 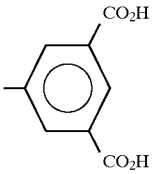 | $-CH_3$ | $=CH-CH=CH-$ |
| 1-10 | $-CH_3$ | $-CH_3$ | $-CH_3$ | $=CH-CH=CH-$ |
| 1-11 | 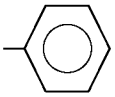 | 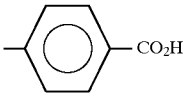 | $-CH_3$ | $=CH-CH=CH-$ |
| 1-12 | 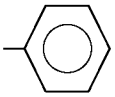 | 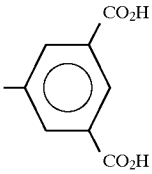 | $-CH_3$ | $=CH-CH=CH-$ |
| 1-13 | 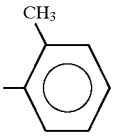 | 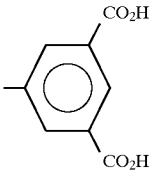 | $-CH_3$ | $=CH-CH=CH-$ |
| 1-14 | 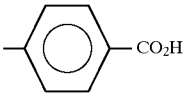 | $-H$ | $-CH_3$ | $=CH-C(CH_3)=CH-$ |
| 1-15 | 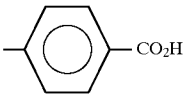 | $-H$ | $-CO_2C_2H_5$ | $=CH-CH=CH-$ |
| 1-16 | 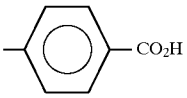 | $-H$ | $-CO_2H$ | $=CH-CH=CH-$ |
| 1-17 | 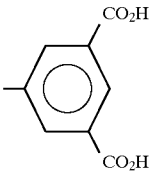 | $-H$ | $-CH_3$ | $=CH-CH=CH-$ |

-continued

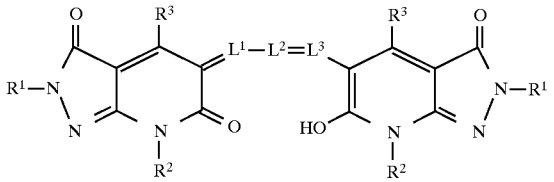

| | $-R^1$ | $-R^2$ | $-R^3$ | $=L^1-L^2=L^3-$ |
|---|---|---|---|---|
| 1-18 | 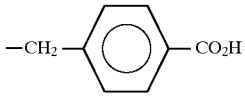 | $-H$ | $-CH_3$ | $=CH-C(CH_3)=CH-$ |
| 1-19 | 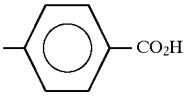 | $-CH_2CH_2OH$ | $-H$ | $=CH-CH=CH-$ |
| 1-20 | 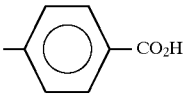 | $-CH_2CO_2H$ | $-CH_3$ | $=CH-C(CH_3)=CH-$ |
| 1-21 | 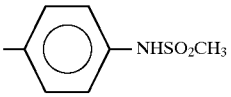 | $-H$ | $-CH_3$ | $=CH-CH=CH-$ |
| 1-22 | 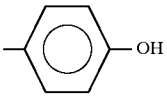 | $-H$ | $-CH_3$ | $=CH-CH=CH-$ |
| 1-23 | $-CH_2CH_2OH$ | $-H$ | $-CH_3$ | $=CH-CH=CH-$ |
| 1-24 | $-CH_3$ | $-CH_2CH_2OH$ | $-CH_3$ | $=CH-CH=CH-$ |
| 1-25 | $-H$ | 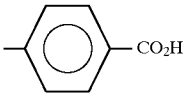 | $-CH_3$ | $=CH-CH=CH-$ |
| 1-26 | $-H$ | $-H$ | $-CO_2H$ | $=CH-CH=CH-$ |
| 1-27 | 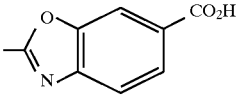 | $-H$ | $-C_2H_5$ | $=CH-CH=CH-$ |
| 1-28 | 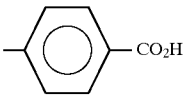 | $-SO_2CH_3$ | $-CO_2CH_3$ | $=CH-C(CH_3)=CH-$ |
| 1-29 | 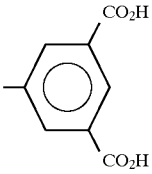 | $-COCH_3$ | $-CH_3$ | $=CH-CH=CH-$ |
| 1-30 | $-H$ | 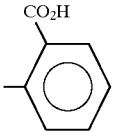 | $-CH_3$ | $=CH-CH=CH-$ |
| 1-31 | 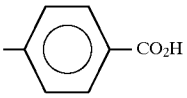 | 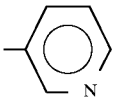 | $-CH_3$ | $=CH-C(CH_3)=CH-$ |

-continued
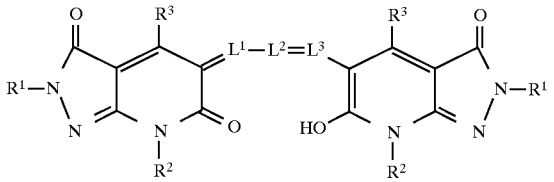
| | $-R^1$ | $-R^2$ | $-R^3$ | $=L^1-L^2=L^3-$ |
|---|---|---|---|---|
| 1-32 | 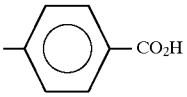 | $-CH_3$ | $-CN$ | $=CH-CH=CH-$ |
| 1-33 | 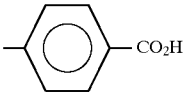 | $-H$ | $-H$ | $=CH-CH=CH-$ |
| 1-34 | 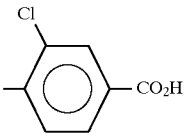 | $-H$ | $-OC_2H_5$ | $=CH-CH=CH-$ |
| 1-35 | 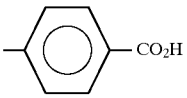 | $-H$ | $-C_4H_9(n)$ | $=CH-CH=CH-$ |
| 1-36 | 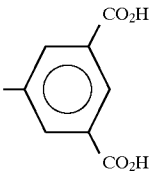 | $-CH_3$ | $-NHCH_3$ | $=CH-CH=CH-$ |
| 1-37 | 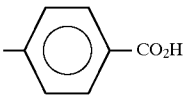 | $-COCH_3$ | $-NHCOCH_3$ | $=CH-CH=CH-$ |
| 1-38 | 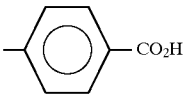 | $-CO_2CH_3$ | $-NHSO_2CH_3$ | $=CH-CH=CH-$ |
| 1-39 | 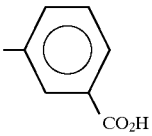 | $-CH_2CH_2OH$ | $-CH_3$ | $=CH-CH=CH-$ |
| 1-40 | $-CH_2CH_2CN$ | $-H$ | $-CH_3$ | $=CH-CH=CH-$ |
| 1-41 | 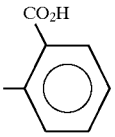 | $-H$ | $-CH_3$ | $=CH-CH=CH-$ |
| 1-42 | 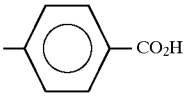 | $-H$ | $-C_2H_5$ | $=CH-CH=CH-$ |
| 1-43 | 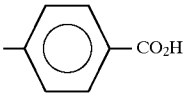 | $-CH_2CH_2OCH_3$ | $-CH_3$ | $=CH-C(C_2H_5)=CH-$ |

-continued

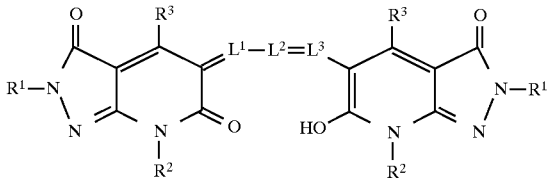

| | $-R^1$ | $-R^2$ | $-R^3$ | $=L^1-L^2=L^3-$ |
|---|---|---|---|---|
| 1-44 | 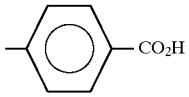 | $-H$ | $-CH_3$ | $=CH-C(Cl)=CH-$ |
| 1-45 | 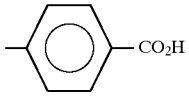 | $-H$ | $-CO_2H$ | $=CH-C(CH_3)=CH-$ |
| 1-46 | 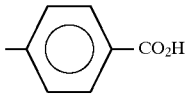 | $-H$ | $-CO_2H$ | $=CH-C(Cl)=CH-$ |
| 1-47 | $-CH_2CH_2CN$ | 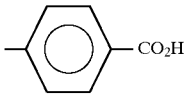 | $-CH_3$ | $=CH-CH=CH-$ |
| 1-48 | $-CH_2CH_2CN$ | 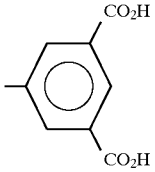 | $-CH_3$ | $=CH-CH=CH-$ |

The compounds of formula (1) can be synthesized by various methods described, for example, in JP-B-39-22,069, JP-B-43-3,504, JP-B-52-38,056, JP-B-54-38,129, JP-B-55-10,059, JP-B-58-35,544, JP-A-49-99,620, JP-A-59-16,834, JP-A-316,853, JP-A-2-282,244, and U.S. Pat. No. 4,181,225.

The compounds of formulas (2) and (3) will now be described in detail.

The acidic nuclei represented by $A^1$ or $A^2$ in the compounds of formulas (2) and (3) are preferably identical. They are preferably those derived from cyclic ketomethylene compounds or compounds having a methylene group sandwiched by electron withdrawing groups. Examples of the acidic nucleus derived from the cyclic ketomethylene compounds include 2-pyrazoline-5-one, rodanin, hidantoin, thiohidantoin, 2,4-oxazolidinedione, iso-oxazolone, barbituric acid, thiobarbituric acid, indanedione, hydroxypyridine, pyrazolidinedione, and 2,5-dihydrofuran-2-one. They may respectively have a substituent.

The compounds having a methylene group sandwiched by electron withdrawing groups may be represented by $Z^1CH_2Z^2$, wherein $Z^1$ and $Z^2$ each independently represents CN, $SO_2R^{11}$, $COR^{11}$, $COOR^{12}$, $CONHR^{12}$, $SO_2NHR^{12}$, $C[=C(CN)_2]R^{11}$, or $C[=C(CN)_2]NHR^{11}$, in which $R^{11}$ represents alkyl, aryl, or a heterocyclic ring, and $R^{12}$ represents hydrogen and a group represented by $R^{11}$, each of which may have a substituent. The hydrogen is removed from $—CH_2$- of $Z^1CH_2Z^2$ to form the acidic nucleus.

Among these acidic nuclei, 2-pyrazoline-5-one, iso-oxazolone, barbituric acid, indanedione, hydroxypyridine, and pirazolidinedione are more preferred, and 2-pyrazoline-5-one is particularly preferred.

Examples of the aryl group represented by Q include phenyl and naphthyl. They may have a substituent (preferably an electron donating group). Particularly, phenyl substituted with dialkylamino, hydroxy, or alkoxy is the most preferred. Examples of the heterocyclic ring represented by Q include pyrrole, indole, furan, thiophene, imidazole, pyrazole, indolizine, quinoline, carbazole, phenothiazine, phenoxazine, indoline, thiazole, pyridine, pyridazine, thiadiazine, pyrane, thiopyrane, oxadiazole, benzoquinoline, thiadiazole, pyrrolothiazole, pyrrolopyridazine, tetrazole, oxazole, coumalin and coumarone. They may have a substituent. Among the listed heterocyclic rings, pyrrole, indole, furan, thiophene, quinoline, carbazole, oxazole, and coumalin are preferred. Of these, pyrrole, indole, furan, and thiophene are particularly preferred.

The methine group represented by L may have a substituent such as alkyl.

The substituents which may be possessed by each of the above-described groups in the compounds of formulas (2) and (3) are not particularly limited as long as they do not substantially make the compounds of formulas (2) and (3) dissolve in water of pH 5 to 7. Examples of the substituents include carboxyl, C1–C10 sulfonamide (for example, methanesulfonamide, benzenesulfonamide, butanesulfonamide, and n-octanesulfonamide), C1–C10 sulfamoyl (for example, unsubstituted sulfamoyl, methylsulfamoyl, phenylsulfamoyl, and butylsulfamoyl), C2–C10 sulfonylcarbamoyl (for example, methanesulfonylcarbamoyl, propanesulfonylcarbamoyl, and benzenesulfonylcarbamoyl), C1–C10 acylsulfamoyl (for example, acetylsulfamoyl, propionylsulfamoyl, pivaloysulfamoyl, and benzoylsulfamoyl), C1–C8 linear or cyclic alkyl (for example, methyl, ethyl, isopropyl, butyl, hexyl, cyclopropyl, cyclohexyl, 2-hydroxyethyl, 4-carboxybutyl, 2-methoxyethyl, benzyl, phenethyl, 4-carboxybenzyl, and 2-diethylaminoethyl), C2–C8 alkenyl (for example, vinyl and allyl), C1–C8 alkoxy (for example, methoxy, ethoxy, and butoxy), halogen atoms (fluorine, chlorine, and bromine), C0–C10 amino (for example, unsubstituted amino, dimethylamino, diethylamino, and carboxyamino), C2–C10 esters (for example, methoxycarbonyl), C1–C10 amide (for example, acetamide and benzamide), C1–C10 carbamoyl (for example, unsubstituted carbamoyl, methylcarbamoyl, and ethylcarbamoyl), C6–C10 aryl (for example, phenyl, naphthyl, 4-carboxyphenyl, 3-carboxyphenyl, 3,5-dicarboxyphenyl, 4-methanesulfonamidephenyl, and 4-butanesulfonamidephenyl), C6–C10 aryloxy (for example, phenoxy, 4-carboxyphenoxy, 3-methylphenoxy, and naphthoxy), C1–C8 alkylthio (for example, methylthio, ethylthio, and octylthio), C6–C10 arylthio (for example, phenylthio and naphthylthio), C1–C10 acyl (for example, acetyl, benzoyl, and propanoyl), C1–C10 sulfonyl (for example, methanesulfonyl and benzenesulfonyl), C1–C10 ureido (for example, ureido and methylureido), C2–C10 urethane (for example, methoxycarbonylamino and ethoxycarbonylamino), cyano, hydroxyl, nitro, and heterocyclic groups (for example, 5-carboxybenzoxazole ring, pyridine ring, sulforane ring, furan ring, pyrrole ring, pyrrolidine ring, morpholine ring, piperazine ring, and pyrimidine ring).

Among the compounds selected from those of formulas (2) and (3), the compounds represented by the following formula (4) are particularly preferred.

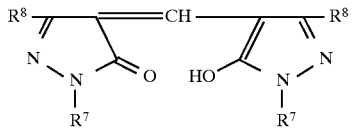

wherein $R^7$ is hydrogen, alkyl, or aryl, and $R^8$ is alkyl or aryl.

Specific examples of the compounds of formulas (2) and (3) used in the present invention will be described below. However, the present invention is not limited to these compounds.

2-1

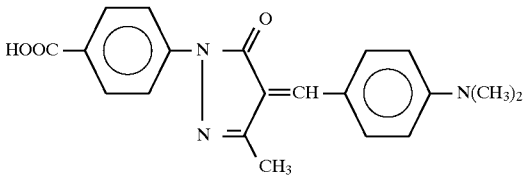

2-2

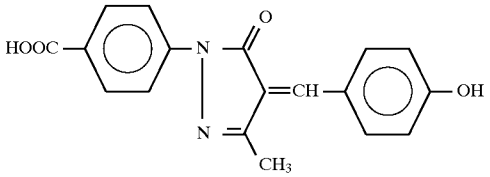

2-3

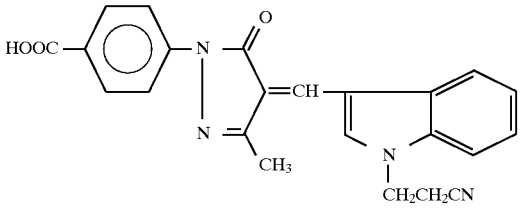

2-4

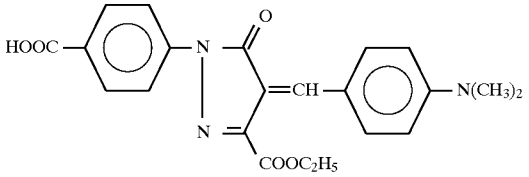

2-5

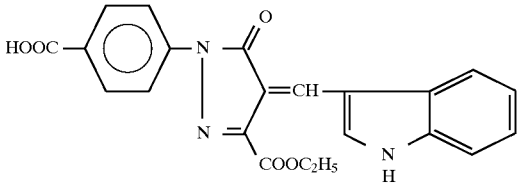

-continued
2-6
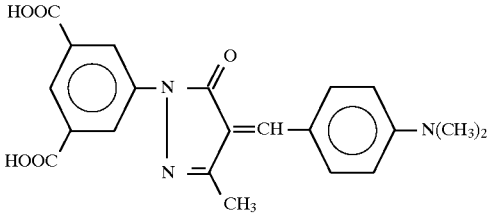
2-7
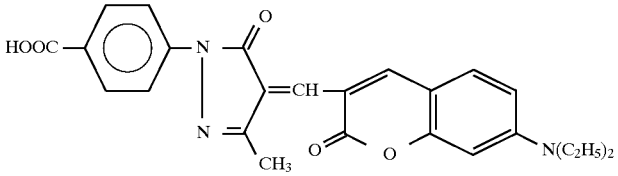
2-8
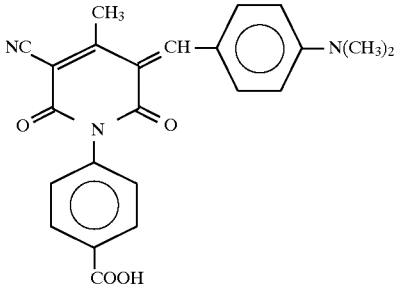
2-9
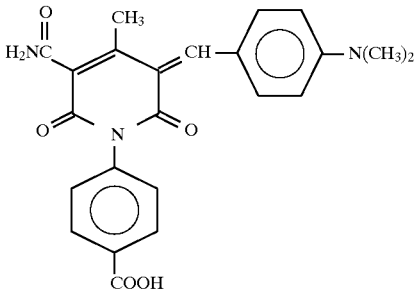
2-10
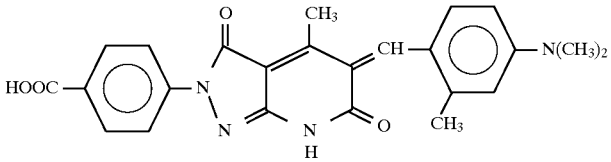
2-11
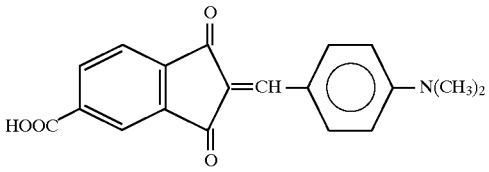
2-12
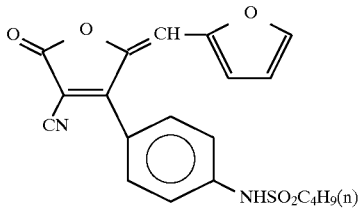

-continued
2-13
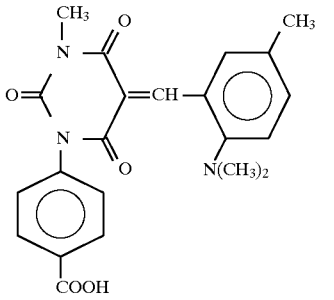
2-14
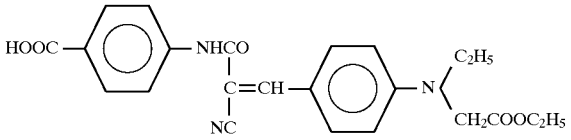
2-15
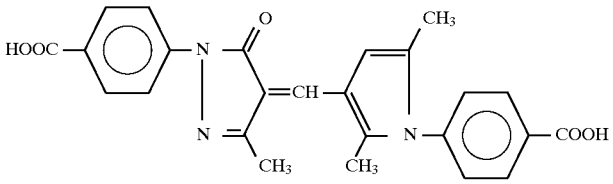
2-16
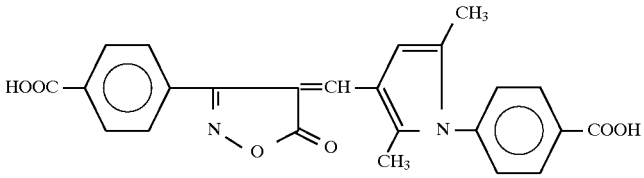
2-17
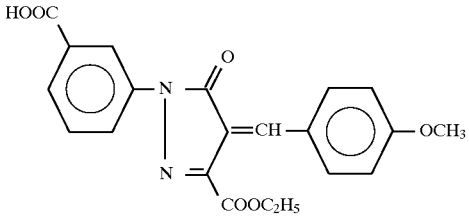
2-18
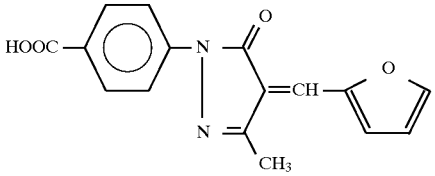
2-19
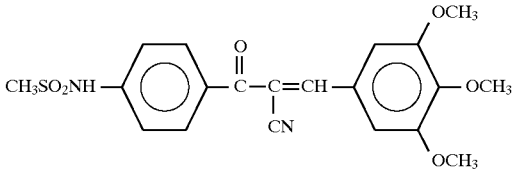
2-20
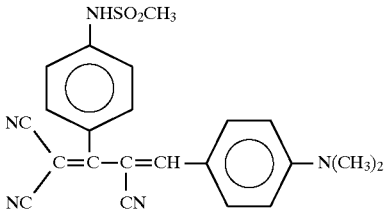

-continued
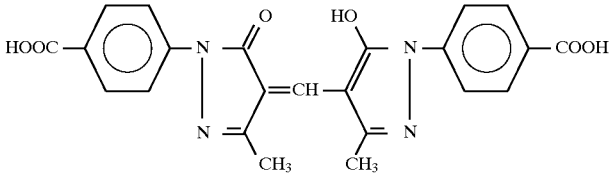
3-1
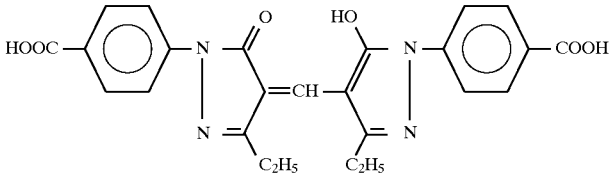
3-2
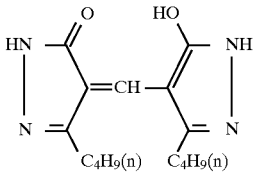
3-3
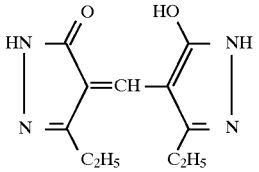
3-4
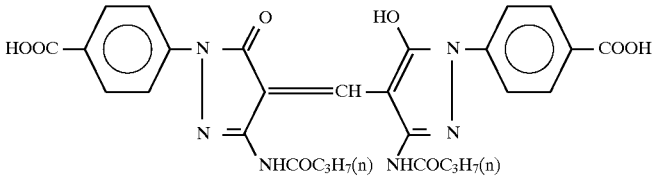
3-5
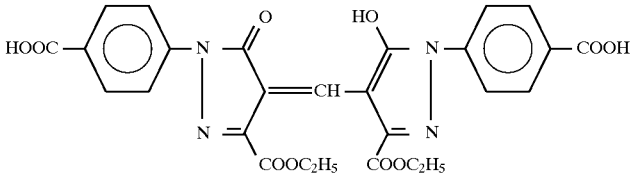
3-6
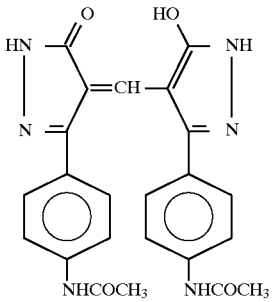
3-7

-continued 3-8

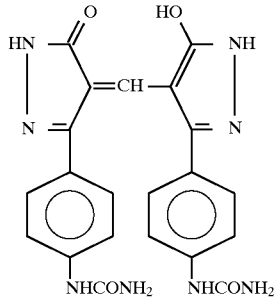

3-9

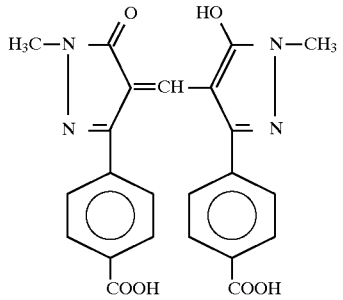

3-10

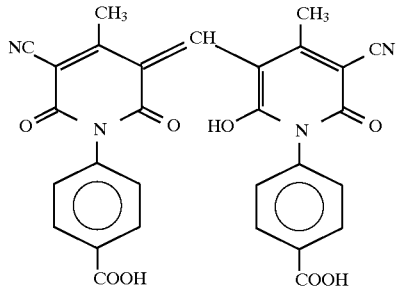

The dyes of formula (1) and the dyes of formula (2) or (3) may be used as a single dispersion or as separate dispersions.

It is preferred that the amount of each of the compounds of formulas (1), (2) and (3) used in the present invention as a dispersion of solid fine particles be from $5\times10^{-2}$ mol/m$^2$ to $5\times10^{-7}$ mol/m$^2$, and particularly from $1\times10^{-3}$ mol/m$^2$ to $5\times10^{-5}$ mol/m$^2$.

The compounds of the present invention may be incorporated, in the form of a dispersion of solid fine particles, into any hydrophilic colloidal layer, in the light-sensitive material. They may be added to a single hydrophilic colloidal layer, or may be divided and added to different layers. However, in view of antihalation performance, the suppression of adverse effects on photographic characteristics, and ease in manufacturing light-sensitive materials, it is preferable that they be contained in the hydrophilic colloidal layer which is present between the support and the silver halide emulsion layer closest to the support. In this preferable embodiment, it is preferred that the ratio by weight of the total amounts of the compounds incorporated in the form of dispersions of solid fine particles to the amount of hydrophilic colloids contained in the hydrophilic colloidal layer present between the support and the silver halide emulsion layer closest to the support be in the range from 0.05 to 0.3, and more preferably from 0.1 to 0.2.

Preferably, the dyes represented by formulas (1), (2), and (3) are used as a dispersion of solid fine particles (microcrystalline particles). Dispersions of solid fine (crystalline) particles of the dyes can be mechanically prepared by using a known pulverizing means such as a ball mill, vibrating ball mill, epicyclic ball mill, sand mill, colloid mill, jet mill, or a roller mill in the presence of a dispersant and, if desired, a suitable solvent (water, alcohol, etc.). Fine (crystalline) particles of the dyes are prepared, for example, in such a manner that the dyes are dissolved in a suitable solvent by using a surfactant for dispersion and then the obtained solution is added to a bad solvent for a dye to allow fine crystals to precipitate. Alternatively, the dyes may be first dissolved in a solvent by controlling the pH, followed by varying the pH to cause microcrystallization. The thus obtained fine (crystalline) particles of the dyes are dispersed in a suitable binder to prepare a substantially uniform dispersion of solid particles, and are applied on a suitable support, whereby a layer containing the fine particles of the dyes can be obtained. Alternatively, the dyes in a dissociated state may be applied to a substrate in the form of a salt, and then acidic gelatin may be applied thereto as a finish coating. The dispersion is thereby fixed at the time of coating.

The above-mentioned binder is not particularly limited as long as it is a hydrophilic colloid which can be used in a photosensitive emulsion layer or in a non-photosensitive layer. Generally, gelatin or synthetic polymers are used.

The fine particles of a dye in a solid-containing dispersion have an average particle size from 0.005 $\mu$m to 10 $\mu$m, preferably from 0.01 $\mu$m to 1 $\mu$m, more preferably from 0.01 $\mu$m to 0.5 $\mu$m, and particularly preferably from 0.01 $\mu$m to 0.1 $\mu$m.

The color photographic light-sensitive materials according to the present invention have a structure comprising at least one yellow color developing silver halide emulsion layer, at least one magenta color developing silver halide emulsion layer, and at least one cyan color developing silver halide emulsion layer provided on a support by coating. Use of the light-sensitive materials of the present invention is not particularly limited. They may be used as negative films for general use, printing papers for general use, negative films for motion pictures, positive films for motion pictures, reversal films, reversal papers, copy materials, and so on. When one incorporates, into color printing papers for popular use, a color coupler capable of forming a die which has a color complementary to the light with which silver halide emulsion is sensitized, colors can be subtractively reproduced. In color printing papers for popular use, silver halide emulsion particles are spectrally sensitized, in the order of the above-mentioned color developing layers, by blue-sensitive, green-sensitive, and red-sensitive spectral sensitizing dyes separately, and are superposed on a support in the above-mentioned order. However, the light-sensitive layers may be superposed in a different order. In other words, in a certain case, it is preferable that a light-sensitive layer containing silver halide particles having a largest average particle size be used as a top layer, and in another case, the lowermost layer is preferably a magenta color developing sensitive layer in view of the storability while being exposed to light.

Light-sensitive layers and color hues to be developed do not necessarily correspond to each other as described above, and at least one infrared sensitive silver halide emulsion layer may also be used.

No limitation is imposed on the material of the support used in the present invention as long as a photographic emulsion layer can be applied thereon. Examples of supports include glass, papers, and plastic films (for example, cellulose triacetate and polyethylene terephthalate).

Preferably, the color photographic light-sensitive material according to the present invention has an antistatic layer on the surface of the support opposite the surface on which the silver halide emulsion layer is provided by coating. Various materials can be used as the antistatic layer. For example, hydrophilic colloidal layers containing a conductive polymer or a metal oxide can be used.

The silver halide grains of the present invention may be particles of silver chloride, silver chlorobromide, silver iodobromide, or silver chlorolodide. In the present invention, it is preferable to use silver chloride or silver chlorobromide which is virtually free from silver iodide in order to accelerate a development process. Here, the term "virtually free from silver iodide" means that the silver iodide content is 1 mol % or less, and preferably 0.2 mol % or less. In some cases, silver halide-rich grains containing 0.01 to 3 mol % of silver iodide as disclosed in JP-A-3-84,545 may be preferably used in the emulsion surface in order to enhance sensitivity at high intensity of illumination, sensitivity of spectral sensitization, or stability of light-sensitive materials over time. Although the halogen composition of the emulsion may differ from grain to grain, use of an emulsion having an identical composition for every grain will easily make the performance of each grain uniform. Particles of the silver halide emulsion may have a uniform structure in which all parts of the grain have the identical composition, a multilayer structure in which the core part of the grain and one or more shells which embrace the core have different halogen compositions, or a structure in which there are non-lamellar phases, inside or in the surface of the grain, having halogen compositions different from the remaining part (in the case where such phases are in the surface of a grain, the edges, corners, or other parts of the grain are linked to a phase having a different composition). In order to obtain high sensitivity, either of the latter two grain structures is more advantageous than the uniform structure. The two latter structures are also advisable in view of pressure resistivity. When a silver halide grain has either one of these hetero-structures, the boundary between the phases having different halogen-compositions may be a clearcut border, or may be an unclear border as a result of formation of mixed crystals based on the difference in composition. Alternatively, the structure may intentionally be varied continuously.

In the present invention, when a silver chloride-rich emulsion containing not less than 90 mol %, and especially not less than 95 mol % of silver chloride is used, the silver halide grain preferably has a structure in which silver bromide is localized in a lamellar or in a non-lamellar manner inside the grain and/or in the surface of the grain. Preferably, the composition of the phase in which silver bromide is localized contains at least 10 mol % and preferably more than 20 mol % of silver bromide. The silver bromide content of the phase in which silver bromide is localized (which hereinafter may be referred to as a localized phase) can be determined by X-ray diffraction (see, for example, "Structural Analysis—New Experimental Chemistry vol. 6" edited by the Japan Chemical Society, published by Maruzen). Such a phase may be present inside the grain, at an edge or corner in the surface of the grain, or on the surface of the grain. A preferable example of the structure is one in which silver bromide is epitaxially grown at a corner of the grain.

Enhancing the amount of silver chloride contained in a silver halide emulsion is effective for reducing the amount of a developer to be replenished. For this purpose, it is preferable to use emulsions of approximately pure silver chloride, such as those containing 98 to 100 mol % of silver chloride.

It is preferable that the average grain size (the arithmetic mean of the values of the diameter of a circle which has an area equivalent to the projected area of the grain) of silver halide grains contained in the silver halide emulsion of the present invention is from 0.1 $\mu$m to 2 $\mu$m.

The distribution of the size of the grains is preferably a so-called monodispersion, having a variation coefficient (a factor obtained by dividing the standard deviation of the grain size distribution by the average grain size) of not more than 20%, preferably not more than 15%, and particularly preferably not more than 10%. In order to obtain a wide latitude, it is preferable that emulsions of monodispersion as described above be blended in the same layer, or that they be applied as multi-layers.

Particles of the silver halides in the photographic emulsions may have various configurations including regular crystal forms such as cubic, tetradecahedral, and octahedral; irregular crystal forms such as spheres and plates; and composites of them. The grains may be a mixture of various crystal forms. In the present invention, it is preferable that not less than 50%, more preferably not less than 70%, and most preferably not less than 90% of the grains have a regular crystal form. Alternatively, preferred are emulsions which contain tabular silver halide grains in an amount that exceeds 50% of the total grains when measured from the projected area, the tabular grains having an average aspect ratio (diameter of a circle/thickness) of not less than 5, and preferably not less than 8. When tabular grains are used, the indices of the primary plane are preferably (100), (111), or (110).

The silver chloride (bromide) emulsions used in the invention can be prepared by the methods described, for example, by "Chemie et Physique Photographique" by P. Glafkides, published by Paul Montel, 1967; "Photographic Emulsion Chemistry", by G. F. Duffin, published by Focal Press, 1966; and "Making and Coating Photographic Emulsion" by V. L. Zelikman et al., Focal Press, 1964. That is, any of the acid method, neutral method, and the ammonia method may be used. A soluble silver salt and a soluble halogen salt may be reacted by a unilateral mixing method, simultaneous mixing method, or by a combination of these methods. A method of forming grains in a silver ion-rich atmosphere (a so-called reverse mixing method) may also be used. A so-called controlled double jet method, which is a variety of the simultaneous method, may be used in which pAg in a liquid phase where silver halide is produced is maintained constant. By this method, it is possible to obtain an emulsion of silver halide grains having an approximately uniform grain size and a regular crystal form.

The localized phases of silver halide grains and the matrix of the phases acording to the present invention preferably contain hetero-metal ions or their complex ions. Preferable metal ions or metal complexes are selected from ions and complexes of the metals of the groups VIII and IIb in the periodic table, lead ions, and thallium ions. The localized phases mainly contain ions or complex ions of iridium, rhodium, iron, etc., and the matrix contains ions or complex ions of osmium, iridium, rhodium, platinum, ruthenium, palladium, cobalt, nickel, and iron. The kinds of metal ions and their concentrations may be varied between localized phases and the matrix. Plural kinds of metals may be used. Preferably, iron and iridium compounds are incorporated in phases in which silver bromide is localized.

The compounds capable of donating these metal ions may be incorporated into localized phases of silver halide grains and/or the remaining phase of the grains (matrices) by dissolving them in a dispersing solution such as an aqueous gelatin solution, aqueous halide solution, aqueous silver salt solution, or other aqueous solutions; or alternatively by addition of silver halide fine grains in which the metal ions are incorporated beforehand, followed by dissolving the fine grains.

Metal ions used in the present invention are incorporated into grains of the emulsion, before, during, or immediately after the formation of the grains. The timing of incorporation will be decided depending on parts in which the metal ions are to be incorporated.

The silver halide emulsion according to the present invention is generally subjected to chemical sensitization and spectral sensitization. Chemical sensitization includes sensitization using a chalcogen sensitizer (specifically, sulfur sensitization by typically adding an unstable sulfur compound, selenium sensitization using selenium, and tellurium sensitization using tellurium are mentioned), noble metal sensitization typified by gold sensitization, and reduction sensitization. They may be used singly or in combination. As for the compounds which are used in chemical sensitization, those described in JP-A-62-215,272, from page 18, lower right column to page 22, upper right column are preferably used.

The advantageous effects of the structure of the light-sensitive material of the present invention are more remarkable than the case where a silver chloride-rich emulsion which has been sensitized with gold is used.

The silver halide emulsion used in the invention may optionally contain various compounds or precursors thereof in order to inhibit fogging during the manufacturing process, storage, or photographic treatment, or to stabilize the photographic performance. Specific examples of preferable compounds are those described in the above-mentioned JP-A-62-215,272, from page 39 to page 72. Moreover, 5-arylamino-1,2,3,4-thiatriazole (the aryl residue has at least one electron withdrawing group) described in European Patent No. 0447647 is also preferably used.

Spectral sensitization is performed for the purpose of imparting spectral sensitivity in a desired range of wave length of light to each emulsion layer of the light-sensitive material.

Examples of spectral sensitizing dyes used in the light-sensitive material of the invention for effecting spectral sensitization of the blue, green and red regions include those described in "Heterocyclic Compounds—Cyanine Dyes and related Compounds" by F. M. Harmer (published by John Wiley & Sons (New York, London), 1964). Specific description of the preferred compounds and spectral sensitization is given in the above-mentioned JP-A-62-215,272, page 22, right upper column to page 38. With regard to red sensitive spectral sensitizing dyes for silver chloride-rich grains of a silver halide emulsion, those described in JP-A-3-123,340 are very preferable from the viewpoints of stability, intensity of adsorption, temperature dependency of exposure, etc.

In the light-sensitive materials according to the present invention, in order to effectively carry out spectral sensitization in the infrared region, use is made of sensitizing dyes described in JP-A-3-15,049, page 12, upper left column to page 21, lower left column; JP-A-3-20,730, page 4, lower left column to page 15, lower left column, European Patent No. 0,420,011, page 4, line 21 to page 6, line 54, European Patent No. 0,420,012, page 4, line 12 to page 10, line 33, European Patent No. 0,443,466, and U.S. Pat. No. 4,975,362.

In order to incorporate these spectral sensitizing dyes into a silver halide emulsion, they may be directly dispersed into an emulsion, or they may be first dissolved in a single solvent of water, methanol, ethanol, propanol, methyl cellosolve, 2,2,3,3-tetrafluoropropanol, etc. or in a mixture of two or more of them, and then the resultant solution may be added to an emulsion. Alternatively, the dyes may be added to an aqueous solution in which an acid or a base co-exists as described in JP-B-44-23,389, JP-B-44-27,555, JP-B-57-22089, etc., or may be added to an aqueous solution or a colloidal dispersion by incorporation of a surfactant as described in U.S. Pat. Nos. 3,822,135 and 4,006,025, and subsequently, the resultant aqueous solution or dispersion may be added to an emulsion. It is also possible to dissolve the dyes in a solvent which is substantially immiscible with water such as phenoxyethanol, disperse the resultant solution in water or hydrophilic colloid, and then add it to an emulsion. As described in JP-A-53-102,733 and JP-A-58-105,141, a dispersion obtained by directly dispersing the dyes in a hydrophilic colloid may be added to an emulsion. The dyes may be added to an emulsion at any stages, during the preparation of the emulsion, known to be advantageous stages. Specifically, the dyes may be added to an emulsion before or during the formation of grains of silver halide emulsion, during a period from immediately after the formation of grains of silver halide emulsion to just before a washing step, before or during chemical sensitization, during a period from immediately after the chemical sensitization to just before the emulsion is solidified, or during the preparation of a coating liquid. Generally, the spectral sensitizing dyes are added to an emulsion after completion of chemical sensitization and before coating. However, it is possible to add them at the same time of addition of a chemical sensitizer as described in U.S. Pat. Nos. 3,628,969 and 4,225,666 to perform spectral sensitization and chemical sensitization simultaneously, or to add them prior to chemical sensitization as described in JP-A-58-113,928. Moreover, spectral sensitization may be initiated by adding the spectral sensitizing dyes before silver halide grains are completely precipitated. It is also possible to add a spectral sensitizing dye in divided amounts as described in U.S. Pat. No. 4,225,666, i.e., to add part of the dyes prior to chemical sensitization and add the remainder after chemical sensitization. Thus, the spectral sensitizing dyes can be added at any stage during the formation of silver halide grains as in a manner described in U.S. Pat. No. 4,183,756, etc. It is particularly preferable that the sensitizing dyes are added before the washing step for an emulsion or before chemical sensitization.

The amounts of spectral sensitizing dyes to be added fall in a wide range depending on the case. Preferably, the amount of the dyes is $0.5\times10^{-6}$ mol to $1.0\times10^{-2}$ mol per mol of silver halide, and more preferably, $1.0\times10^{-6}$ mol to $5.0\times10^{-3}$ mol per mol of silver halide.

In the present invention, when a sensitizing dye having spectral sensitivity in a range from red to infrared is used, it is preferred that a compound described in JP-A-2-157,749, from page 13, lower right column to page 22, lower right column be used in combination. Use of such a compound specifically enhances storability of light-sensitive materials, stability in processing, and effects of color sensitization. Particularly, combination use of the compounds of formulas (IV), (V), and (VI) in the publication is preferred. They are used in amounts from $0.5\times10^{-5}$ mol to $5.0\times10^{-2}$ mol per mol of silver halide, and more preferably, $5.0\times10^{-5}$ mol to $5.0\times10^{-3}$ mol per mol of silver halide. Good results can be obtained when they are used from 0.1 to 10,000 fold, preferably from 0.5 to 5,000 fold, per mol of a sensitizing dye.

When the light-sensitive materials of the invention are used as printing materials, they may be used not only in a printing system using an ordinary negative film printer, but also in a digital scanning exposure system which uses monochromatic high density light generated from a gas laser; light emission diode semiconductor laser; or a second harmonics generator (SHG) using a combination of a semiconductor laser or a solid state laser using a semiconductor laser as a excitation light source and non-linear optical crystal. In order to make the system compact and inexpensive, it is preferable to use a semiconductive laser; or a second harmonics generator (SHG) based on a combination of a semiconductor laser or a solid state laser with a non-linear optical crystal. For designing a compact and inexpensive apparatus which has a long life and high stability, a semiconductor laser is preferably used, and at least one light source for exposure preferably uses a semiconductor laser.

When a light source for scanning exposure is used, the maximum spectral sensitivity of the light-sensitive materials of the present invention can arbitrarily be set depending on the wave length of the light source to be used for performing scanning exposure. With an SHG light source in which a solid state laser using a semiconductor laser as an excitation light source or a semiconductor laser are used in combination with a non-linear optical crystal, the oscillation wave length of laser can be halved, and thus blue light and green light are obtained. Therefore, it is possible to obtain maximal spectral sensitivities of the light-sensitive materials in ordinary three regions of blue, green and red. When a semiconductor laser is used as a light source in an attempt to make an inexpensive, highly stable, and compact apparatus, it is preferred that at least two layers have their maximal spectral sensitivities in the range of not less than 670 nm. This is because inexpensive and stable semiconductor lasers of III-V group which are presently available have an oscillation wave range only in the range from red to infrared. However, in laboratories, oscillation of semiconductors of II-VI group in green and blue ranges has been confirmed. Therefore, it is foreseeable that the semiconductor laser could be used in an economical manner with stable supply if manufacturing technology for semiconductor laser advances. In such a case, requirements that at least two layers have maximal spectral sensitivities in the range of not less than 670 nm will have less significance.

In scanning exposure, the period during which silver halide contained in a light-sensitive material is exposed is a period required for exposing a certain very small area. The very small area is called a pixel, and is generally taken as a minimum unit in which the quantity of light can be controlled by digital data. Accordingly, the size of the pixel affects the period of exposure per pixel. The size of a pixel depends on the density of pixels which, realistically, is in the range from 50 to 2,000 dpi. When exposure time is defined to be a period for exposing a pixel having a density of 400 dpi, the exposure time is preferably not more than $10^{-4}$ seconds, and more preferably not more than $10^{-6}$ seconds.

The light-sensitive materials of the invention may optionally contain water-soluble dyes (particularly, oxonole dye and cyanine dye), in hydrophilic colloidal layers, which can be discolored during processing and which are described in European Patent No. 0337490A2, page 27 to page 76, in order to prevent irradiation or halation or to enhance safelight immunity.

Among the water-soluble dyes, some cause color separation or deteriorate safelight immunity when used in an increased amount. Preferable examples of dyes which can be used and which do not aggravate color separation include water soluble dyes described in Japanese Patent Application Nos. 03-310,143, 03-310,189, and 03-310,139.

In the present invention, it is possible to use a colored layer which can be discolored, during processing, in combination with the compound of the present invention which is dispersed as solid fine particles. The colored layer to be used may directly contact an emulsion layer or indirectly through an intermediate layer containing color amalgamation inhibiting agents such as gelatin and hydroquinone. The colored layer is preferably provided as a lower layer (on the side of a support) with respect to the emulsion layer which develops a primary color which is the same as the color of the colored layer. It is possible to provide colored layers independently, each corresponding to respective primary colors. Alternatively, one layer selected from them may be provided. In addition, it is possible to provide a colored layer subjected to coloring so as to match a plurality of primary colors. It is preferred that the optical reflection density of the colored layer be such that the optical density at the wavelength which provides the highest optical density in a range of wave lengths used for exposure (a visible light region from 400 nm to 700 nm for an ordinary printer exposure, and the wavelength of the light generated from the light source in the case of scanning exposure) be within the range of 0.2 to 3.0, more preferably 0.5 to 2.5, and particularly preferably 0.8 to 2.0.

The colored layer described above may be formed by known methods. For example, there are mentioned a method in which dyes described in JP-A-2-282,244, from page 3, upper right column to page 8 or anionic dyes are mordanted in a cationic polymer, a method in which dyes are adsorbed onto fine grains of silver halide or the like and fixed in the layer, and a method in which colloidal silver described in JP-A-1-239,544 is used. The method of mordanting anionic dyes in a cationic polymer is described in JP-A-2-84,637, pages 18 to 26. U.S. Pat. Nos. 2,688,601 and 3,459,563 disclose a method of preparing a colloidal silver for use as a light absorber.

A binder or protective colloid used in the light-sensitive materials according to the invention is preferably gelatin. However, hydrophilic colloids other than gelatin may also be used solely or in combination with gelatin. Gelatin is preferably a low calcium gelatin, which contains not more than 800 ppm, more preferably not more than 200 ppm, of calcium. In order to prevent various fungi and microorganisms, which deteriorate picture images, from propagating in hydrophilic layers, it is preferred that mildewproof agents as described in JP-A-63-271,247 be added.

When the light-sensitive materials of the present invention are subjected to exposure with a printer, it is preferred that a band-stop filter described in U.S. Pat. No. 4,880,726 be used. With the filter, color amalgamation of light is eliminated, thereby remarkably enhancing color reproduction.

The exposed light-sensitive materials can be developed by an ordinary color developing process. In order to achieve a rapid processing, the color photographic light-sensitive materials according to the present invention may be subjected to a bleaching-fixing process after a color-developing process has been completed. Especially in the case where a silver chloride-rich emulsion is used, the pH of a bleach-fix bath is preferably not more than about 6.5, and more preferably not more than about 6 for accelerating desilvering.

Preferable examples of silver halide emulsions and other materials (such as additives) used in light-sensitive materials of the invention, structures of photographic layers (such as arrangement of layers), methods of processing the sensitive materials, and additives used for processing are described in the patent application publications listed below, among which those described in European Patent Application No. 0,355,660 A2 (JP-A-2-139,544) are particularly preferred.

TABLE 5

| Photographic constituents, and the like | JP-A-62-215272 | JP-A-2-33144 | EPO No. 355,660A2 |
|---|---|---|---|
| Silver halide emulsions | Page 10, right upper column, line 6 to page 12, left lower column, line 5, and page 12, right lower column, 4th line from the last line to page 13, left upper column, line 17 | Page 28, right upper column, line 16 to page 29, right lower column, line 11, and page 30, line 2 to line 5 | Page 45, line 53 to page 47, line 3, and page 47, line 20 to line 22 |
| Silver halide solvents | Page 12, left lower column, line 6 to line 14, and page 13, left upper column, 3rd line from the last line to page 18, left lower column, the last line | — | — |
| Chemical sensitizers | Page 12, left lower column, 3rd line from the last line to right lower column, 8th line from the last line, and page 18, right lower column, line 1 to page 22, right upper column, 9th line from the last line | Page 29, right lowe column, line 12 to the last line | Page 47, line 4 to line 9 |
| Spectral sensitizers (Spectral sensitizing methods) | Page 22, right upper column, 8th line from the last line to page 38, the last line | Page 30, left upper column, line 1 to line 13 | Page 47, line 10 to line 15 |
| Emulsion stabilizers | Page 39, left upper column, line 1 to page 72, right upper column, the last line | Page 30, left upper column, line 14 to right upper column, line 1 | Page 47, line 16 to line 19 |
| Development accelerators | Page 72, left lower column, line 1 to page 91, right upper column, line 3 | — | — |

TABLE 6

| Photographic constituents, and the like | JP-A-62-215272 | JP-A-2-33144 | EPO No. 355,660A2 |
|---|---|---|---|
| Color couplers (Cyan, magenta, yellow couplers) | Page 91, right upper column, line 4 to page 121, left upper column, line 6 | Page 3, right upper column, line 14 to page 18, left upper column, the last line, and page 30, right upper column, line 6 to page 35, right lower column, line 11 | Page 4, line 15 to line 27, page 5, line 30 to page 28, the last line, page 45, line 29 to line 31, and page 47, line 23 to page 63, line 50 |
| Color increasing agents | Page 121, left upper column, line 7 to page 125, right upper column, line 1 | — | — |
| UV absorbers | Page 125, right upper column, line 2 to page 127, left lower column, the last line | Page 37, right lower column, line 14 to page 38, left upper column, line 11 | Page 65, line 22 to line 31 |
| Anti-fading agents (Image stabilizers) | Page 127, right lower column, line 1 to page 137, left lower column, line 8 | Page 36, right upper column, line 12 to page 37, left upper column, line 19 | Page 4, line 30 to page 5, line 23, page 29, line 1 to page 45, line 25, page 45, line 33to line 40, and page 65, line 2 to line 21 |
| High B.P. and/or low B.P. organic solvents | Page 137, left lower column, line 9 to page 144, right upper column, the last line | Page 35, right lower column, line 14 to page 36, left upper column, 4th line from the last line | Page 64, line 1 to line 51 |
| Method of dispersing photographic additives | Page 144, left lower column, line 1 to page 146, right upper column, line 7 | Page 27, right lower column, line 10 to page 28, left upper column, the last line, and page 35, right lower column, line 12, to page 36, right upper column, line 7 | Page 63, line 51 to page 64, line 56 |

TABLE 7

| Photographic constituents, and the like | JP-A-62-215272 | JP-A-2-33144 | EPO No. 355,660A2 |
|---|---|---|---|
| Hardening agents | Page 146, right upper column, line 8 to page 155, left lower column, line 4 | — | — |
| Developing agent precursors | Page 155, left lower column, line 5 to page 155, right lower column, line 2 | — | — |
| Development inhibitor releasing compounds | Page 155, right lower column, line 3 to line 9 | — | — |
| Supports | Page 155, right lower column, line 19 to page 156, left upper column, line | Page 38, right upper column, line 18 to page 39, left upper column, line 3 | Page 66, line 29 to page 67, line 13 |
| Constitution of sensitive material layers | Page 156, left upper column, line 15 to page 156, right lower column, line | Page 28, right upper column, line 1 to line 15 | Page 45, line 41 to line 52 |
| Dyes | Page 156, right lower column, line 15 to page 184, right lower column, the last line | Page 38, left upper column, line 12 to right upper column, line 7 | Page 66, line 18 to line 22 |
| Color mixing | Page 185, left upper | Page 36, right upper | Page 64, line 57 |

TABLE 7-continued

| Photographic constituents, and the like | JP-A-62-215272 | JP-A-2-33144 | EPO No. 355,660A2 |
|---|---|---|---|
| inhibitors | column, line 1 to page 188, right lower column, line 3 | column, line 8 to line 11 | to line 65, line 1 |
| Gradation adjusting agents | Page 188, right lower column, line 4 to line 8 | — | — |

TABLE 8

| Photographic constituents, and the like | JP-A-62-215272 | JP-A-2-33144 | EPO No. 355,660A2 |
|---|---|---|---|
| Antistain agents | Page 188, right lower column, line 9 to page 193, right lower column, line 10 | Page 37, left upper column, the last line to right lower column, line 13 | Page 65, line 32 page 66, line 17 |
| Surfactants | Page 201, left lower column, line 1 to page 210, right upper column, the last line | Page 18, right upper column, line 1 to page 24, right lower column, the last line, and page 27, left lower column, 10th line from the last line to right lower column, line 9 | — |
| Fluorine-containing compounds (For use as antistatic agents, coating aids, lubricants, antiadhesive agents, etc.) | Page 210, left lower column, line 1 to page 222, left lower column, line 5 | Page 25, left upper column, line 1 to page 27, right lower column, line 9 | — |
| Binders (Hydrophilic colloids) | Page 222, left lower column, line 6 to page 225, left upper column, the last line | Page 38, right upper column, line 8 to line 18 | Page 66, line 23 to line 28 |
| Thickeners | Page 225, right upper column, line 1 to page 227, right upper column, line 2 | — | — |
| Antistatic agents | Page 227, right upper column, line 3 to page 230, left upper column, line 1 | — | — |

TABLE 9

| Photographic constituents, and the like | JP-A-62-215272 | JP-A-2-33144 | EPO No. 355,660A2 |
|---|---|---|---|
| Polymer latex | Page 230, left upper column, line 2 to page 239, the last line | — | — |
| Matte agents | Page 240, left upper column, line 1 to page 240, right upper column, the last line | — | — |
| Photographic processing methods | Page 3, right upper column, line 7 to | Page 39, left upper column, line 4 to | Page 67, line 14 to page 69, line 28 |

TABLE 9-continued

| Photographic constituents, and the like | JP-A-62-215272 | JP-A-2-33144 | EPO No. 355,660A2 |
|---|---|---|---|
| (processing steps, additives, etc) | page 10, right upper column, line 5 | page 42, left upper column, the last line | |

Note: The cited portions of JP-A-62-215272 include portions which have been amended by an amendment dated March 16, 1987, which is appended to the end of the published specification. Further, it is preferable to use, as yellow couplers among the above mentioned color couplers, so-called yellow couplers of a short wavelength type, which are disclosed in JP-A-63-231451, JP-A-63-123047, JP-A-63-241547, JP-A-1-173499, JP-A-1-213648 and JP-A-1-250944.

It is preferred that cyan, magenta, and yellow couplers be emulsified and dispersed in an aqueous hydrophilic colloidal solution after they are incorporated in loadable latex polymers (see, for example, U.S. Pat. No. 4,203,716) in the presence or absence of high boiling point organic solvents listed in the above tables, or after they are dissolved along with polymers which are insoluble in water but soluble in organic solvents.

Preferable examples of the polymers which are insoluble in water but soluble in organic solvents include homopolymers or copolymers described in U.S. Pat. No. 4,857,449, from column 7 to column 15, and WO 88/0723, pages 12 to 30. Specifically, methacrylate or acrylamide polymers, particularly acrylamide polymers, are preferred.

It is preferred that the light-sensitive materials of the present invention contain compounds for improving color image storability as described in European Patent Application No. 0,277,589 A2 together with couplers. Particularly, use in combination with pyrazoloazole couplers, pyrrolotriazole couplers, or acylacetamide yellow couplers is preferred.

In other words, in order to prevent generation of stains due to formation of color developing dyes as a result of a reaction, during storage after processing, between a primary developer remaining in a membrane or its oxidation product and a coupler, it is preferred that the compounds described in the above European Patent Application be used singly or in combination, the compounds being capable of chemically binding to a primary developer of aromatic amines remaining after a color developing process so as to produce chemically inert and substantially colorless compounds, or being capable of chemically binding to an oxidation product of a primary developer of aromatic amines remaining after a color developing process so as to produce chemically inert and substantially colorless compounds.

Examples of cyan couplers include diphenylimidazole cyan couplers described in JP-A-2-33,144, 3-hydroxypyridine cyan couplers described in European Patent No. 0333185 A2 (particularly, couplers obtained by incorporating leaving chlorine into the 4-equivalent couplers of coupler (42) listed in this publication and converting them into 2-equivalent couplers, coupler (6), and coupler (9) being preferred), cyclic active methylene cyan couplers described in JP-A-64-32,260 (particularly, coupler Nos. 3, 8, and 34 are preferred), pyrrolopyrazole cyan couplers described in European Patent Application No. 0456226 A1, pyrroloimidazole cyan couplers described in European Patent No. 0484909, and pyrrolotriazole cyan couplers described in European Patent Application Nos. 0488248 Al and 0491197 A1.

Examples of magenta couplers include 5-pyrazolone magenta couplers described in the publications in the table above. In view of picture image storability and less variation in image quality, preferred are the 5-pyrazolone magenta couplers from which arylthio groups leave and which are described in WO 92/18901, WO 92/18902, and WO 92/18903.

Known pyrazoloazole couplers may also be used. Among which, preferred are pyrazolotriazole couplers described in JP-A-61-65245 in which secondary or tertiary alkyl groups are directly bound to the 2-, 3-, or 6- position of a pyrazolotriazole ring; pyrazoloazole couplers containing a sulfonamide group in the molecule, as described in JP-A-61-65,246; pyrazoloazole couplers having an alkoxyphenylsulfonamide ballast group, as described in JP-A-61-147,254; and pyrazoloazole couplers having an alkoxy group or aryloxy group at the 6- position described in European Patent Application Nos. 226,849 A and 294,785 A. These pyrazoloazole couplers are preferred from the viewpoints of color hue and picture image stability.

As for yellow couplers, known acylacetoanilide couplers are preferably used. Among them, preferred are pivaloyl acetoanilide couplers having a halogen atom or an alkoxy group at the ortho- position of an anilide ring; acylacetanilide couplers in which the acyl group is a cycloalkane carbonyl group substituted at the 1- position described in European Patent Application No. 0447969 A, JP-A-5-107,701, and JP-A-5-113,642; and malondianilide couplers described in European Patent Application Nos. 0482552 A and 0524540 A.

The color sensitive materials according to the present invention are preferably processed by the methods listed in the above table, or by using the materials and methods described in JP-A-2-207250, from page 26, lower right column, line 1 to page 34, upper right column, line 9, and JP-A-4-97,355, from page 5, upper left column, line 17 to page 18 lower right column, line 20.

The inventors have taken account of the following points.

Variation in humidity during an exposure process cannot be avoided even under normal conditions. For example, temperature of atmosphere around a light-sensitive material such as photographic printing paper is normally 15–35° C. Relative humidity thereof varies in the range from 35 to 85%. When a light-sensitive material stored at a low temperature in a sealed state is taken out of a sealed container of a lower temperature relative to room temperature for use, dew formation occurs. Such dew formation greatly increases the humidity of the light-sensitive material (for example, the relative humidity: 85%).

Accordingly, a crucial problem which cannot be ignored is decrease in the sensitivity (desensitization) of a light-sensitive material which may occur due to humidity-variation during an exposure process after storage for a prolonged period. Thus, the present invention also provides a silver halide color photographic light-sensitive material in which variation of the sensitivity is minimized even when the humidity varies during an exposure process after storage for a prolonged period.

Thus, the invention provides:

[A] a silver halide color photographic light-sensitive material comprising a support having thereon photographic constituting layers comprising at least one light-sensitive silver halide emulsion layer containing a yellow coupler, at least one light-sensitive silver halide emulsion layer containing a magenta coupler, at least one light-sensitive silver halide emulsion layer containing a cyan coupler, and at least one light-insensitive hydrophilic colloidal layer, wherein at least one layer of said photographic constituting layers comprises at least one compound represented by formula (1) and at least one of the compounds represented by formulas (2) and (3), each compound being in a dispersion form of solid fine particles, at least one magenta coupler contained in said light-sensitive silver halide emulsion layer containing the magenta coupler is a compound represented by the following formula (M-I):

said light-sensitive silver halide emulsion layer containing the magenta coupler comprises at least one selected from the group consisting of silver chlorobromide, silver chloroiodobromide, silver chloroiodide and silver chloride emulsion particles, each of said silver halides containing silver chloride in an amount not less than 70 mol %, and said emulsion particles are formed by adding, into a system containing said silver halide particles, at least one of a bromine ion releasing compound and a bromine atom releasing compound in an amount of 0.0005–0.05 mol per mol of the silver halide at any time during a period from completion of the formation of the silver halide particles to its application onto the support,

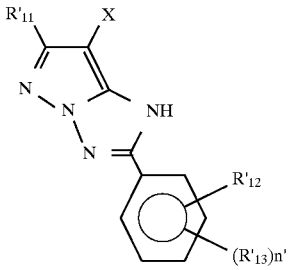

(M-I)

wherein $R'_{11}$ is a group represented by the following formula (Q-1), (Q-2) or (Q-3):

$$—C(R'_{14})(R'_{15})—R'_{16} \quad (Q\text{-}1)$$

wherein $R'_{14}$ is alkyl, cycloalkyl, aryl or heterocyclic ring group, $R'_{15}$ and $R'_{16}$ are substituents, and $R'_{14}$, $R'_{15}$ and $R'_{16}$ may be linked to each other to form a single ring or condensed ring having 5–7 members, $$—CH(R'_{17})—R'_{18} \quad (Q\text{-}2)$$

wherein $R'_{17}$ is alkyl, cycloalkyl, aryl or heterocyclic ring group, $R'_{18}$ represents a substituent, and $R'_{17}$ and $R'_{18}$ may be linked to each other to form a single ring or condensed ring having 5–7 members,

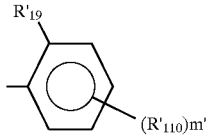

(Q-3)

wherein $R'_{19}$ and $R'_{110}$ are substituents, and m' is a number of 0–4, provided that plural $R'_{110}$ may be the same or different when m' is not less than 2, $R'_{12}$ and $R'_{13}$ are substituents, n' is a number of 0–4, and X is a halogen atom or a group which is releasable by a coupling reaction with an oxidized developing agent, provided that plural $R'_{13}$ may be the same or different when n' is a number not less than 2.

In particular, preferred is each embodiment of the above silver halide color photographic light-sensitive material [A], corresponding to each of the aforesaid silver halide color photographic light-sensitive materials [2], [3], [4] and [5].

In addition, preferred is the embodiment of the above light-sensitive material [A] in which $R'_{11}$ in formula (M-I) representing the magenta coupler present in the light-sensitive silver halide emulsion layer containing the magenta coupler is a coupler represented by formula (Q-1) or (Q-2). Moreover, the light-sensitive materials [A] is preferable in which the magenta coupler, represented by formula (M-I), present in the light-sensitive silver halide emulsion layer containing the magenta coupler is a coupler represented by the following formula (M-II):

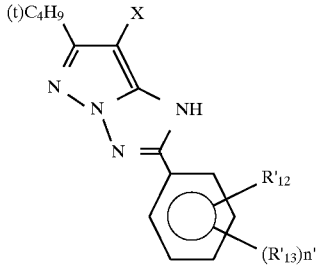

(M-II)

wherein $R'_{12}$, $R'_{13}$, n' and X have the same meanings as defined in formula (M-1).

The compound represented by formula (M-I) will be described in detail.

$R'_{12}$ preferably represents alkyl (preferably, C1–C32 linear or branched alkyl such as methyl, ethyl, propyl, isopropyl, butyl, t-butyl, 1-octyl and tridecyl), cycloalkyl (preferably, C3–C32 cycloalkyl such as cyclopropyl, cyclopentyl and cyclohexyl), alkenyl (preferably, C2–C32 alkenyl such as vinyl, allyl and 3-butene-1-yl), aryl (preferably, C6–C32 aryl such as phenyl, 1-naphthyl and 2-naphthyl), a heterocyclic ring (preferably, C1–C32 heterocyclic rings having 5–8 members such as 2-thienyl, 4-pyridyl, 2-furyl, 2-pyrimidinyl, 1-pyridyl, 2-benzothiazolyl, 1-imidazolyl, 1-pyrazolyl and benzotriazol-2-yl), and a cyano group, a halogen atom (such as fluorine, chlorine and bromine), hydroxyl, nitro, carboxyl, alkoxy (preferably, C1–C32 alkoxy such as methoxy, ethoxy, 1-butoxy, 2-butoxy, isopropoxy, t-butoxy and dodecyloxy), cycloalkyloxy (preferably, C3–C32 cycloalkyloxy such as cyclopentyloxy and cyclohexyloxy), aryloxy (preferably, C6–C32 aryloxy such as phenoxy and 2-naphthoxy), heterocyclic oxy (preferably C1–C32 heterocyclic oxy such as 1-phenyltetrazol-5-oxy, 2-tetrahydropyranyloxy and 2-furyloxy), silyloxy (preferably, C1–C32 silyloxy such as trimethylsilyloxy, t-butyl dimethylsilyloxy and diphenyl methylsilyloxy), acyloxy (preferably, C2–C32 acyloxy such as acetoxy, pivaloyloxy, benzoyloxy and dodecanoyloxy), alkoxycarbonyloxy (preferably, C2–C32 alkoxycarbonyloxy such as ethoxycarbonyloxy and t-butoxycarbonyloxy), cycloalkyloxycarbonyloxy (preferably, C4–32 cycloalkyloxycarbonyloxy such as cyclohexyloxycarbonyloxy), aryloxycarbonyloxy (preferably, C7–C32 aryloxycarbonyloxy such as phenoxycarbonyloxy), carbamoyloxy (preferably, C1–C32 carbamoyloxy such as N,N-dimethylcarbamoyloxy and N-butylcarbamoyloxy), sulfamoyloxy (preferably, C1–C32 sulfamoyloxy such as N,N-diethylsulfamoyloxy and N-propylsulfamoyloxy), alkanesulfonyloxy (preferably, C1–C32 alkanesulfonyloxy such as methanesulfonyloxy and hexadecanesulfonyloxy), allenesulfonyloxy (preferably, C6–C32 allenesulfonyloxy such as benzenesulfonyloxy), acyl (preferably, C1–C32 acyl such as formyl, acetyl, pivaloyl, benzoyl and tetradecanoyl), alkoxycarbonyl (preferably, C2–C32 alkoxycarbonyl such as methoxycarbonyl, ethoxycarbonyl and octadecyloxycarbonyl), cycloalkyloxycarbonyl (preferably, C2–C32 cycloalkyloxycarbonyl such as cyclohexyloxycarbonyl), aryloxycarbonyl (preferably, C7–C32 aryloxycarbonyl such as phenoxycarbonyl), carbamoyl (preferably, C1–C32 carbamoyl such as carbamoyl, N,N-dibutylcarbamoyl, N-ethyl-N-octylcarbamoyl and N-propylcarbamoyl), amino (preferably, amino groups having 32 or less carbon atoms such as amino, methylamino, N,N-dioctylamino, tetradecylamino and octadecylamino), anilino (preferably, C6–C32 anilino such as anilino and N-methylanilino), heterocyclic amino (preferably, C1–C32 heterocyclic amino such as 4-pyridyl amino), carbonamide (preferably, C2–C32 carbonamide such as acetamide, benzamide and tetradecanamide), ureido (preferably, C1–C32 ureido such as ureido, N,N-dimethyl ureido, N-phenylureido), imide (preferably, imide groups having 10 or less carbon atoms such as N-succinimide and N-phthalimide), alkoxycarbonylamino (preferably, C2–C32 alkoxycarbonylamino such as methoxycarbonylamino, ethoxycarbonylamino, t-butoxycarbonylamino, and octadecyloxycarbonylamino), aryloxycarbonylamino (preferably, C7–C32 aryloxycarbonylamino such as phenoxycarbonylamino), sulfonamide (preferably, C1–C32 sulfonamide such as methanesulfonamide, butanesulfonamide, benzenesulfonamide and hexadecanesulfonamide), sulfamoylamino (preferably, C1–C32 sulfamoylamino such as N,N-dipropylsulfamoylamino, N-ethyl-N-dodecylsufamoylamino), azo (preferably, C1–C32 azo such as phenylazo), alkylthio (preferably, C1–C32 alkylthio such as ethylthio and octylthio), arylthio (preferably, C6–C32 arylthio such as phenylthio), heterocyclic thio (preferably, C1–C32 heterocyclic thio such as 2-benzothiazolylthio, 2-pyridylthio and 1-phenyltetrazolylthio), alkylsufinyl (preferably, C1–C32 alkylsulfinyl such as dodecanesulfinyl), allenesulfinyl (preferably, C6–C32 allenesulfinyl such as benzenesulfinyl), alkanesulfonyl (preferably, C1–C32 alkanesulfonyl such as methanesulfonyl and octanesulfonyl), allenesulfonyl (preferably, C6–C32 allenesulfonyl such as benzenesulfonyl and 1-naphthalenesulfonyl), sulfamoyl (preferably, sulfamoyl groups having 32 or less carbon atoms such as sulfamoyl, N,N-dipropylsulfamoyl, N-ethyl-N-dodecylsulfamoyl), sulfo, or phosphonyl group (preferably, C1–C32 phosphonyl such as phenoxyphosphonyl, octyloxyphosphonyl and phenylphosphonyl).

$R'_{13}$ represents the same groups as defined by $R'_{12}$.

In formula (Q-1), $R'_{14}$ preferably represents C1–C32 linear or branched alkyl or C6–C32 aryl. Specific examples of these groups are the same as those illustrated for the alkyl and aryl represented by $R'_{12}$. $R'_{15}$ and $R'_{16}$ represent the same groups as defined by $R'_{12}$. Two or more groups of $R'_{14}$, $R'_{15}$ and $R'_{16}$ may be linked to each other to form a carbon ring or a heterocyclic ring (a single ring or a condensed ring) having 5–7, members which will be exemplified hereinafter.

In formula (Q-2), $R'_{17}$ represents the same groups as defined by $R'_{14}$ in formula (Q-1). $R'_{18}$ represents the same groups as defined by $R'_{12}$: $R'_{17}$ and $R'_{18}$ may be linked to each other to form a carbon ring or a heterocyclic ring (a single ring or a condensed ring) having 5–7 members, which will be exemplified hereinafter.

In formula (Q-3), $R'_{19}$ represents the same groups as defined by $R'_{110}$.

X represents a hydrogen atom, or a group which is releasable upon a reaction with an oxidized developing agent. Specifically, X represents, for example, a halogen atom, alkoxy, aryloxy, acyloxy, carbamoyloxy, sulfonyloxy, carbonamide, sulfonamide, carbamoylamino, heterocyclic groups, arylazo, alkylthio, arylthio, or heterocyclic thio group. A preferable scope and specific examples of these groups are identical to those described in relation to the groups defined by $R'_{12}$. In some cases, X may be a bis-type coupler in which a bi-molecular 4 equivalent coupler is bounded to each other via aldehyde or ketone. Also, X may be a group suitable for use in photography such as a development accelerator, development inhibitor, silver removal accelerator or leuco dye, or a precursor thereof.

The groups represented by $R'_{11}$, $R?_{12}$, $R'_{13}$, and X may have a substituent, preferable examples of which include a halogen atom, alkyl, cycloalkyl, alkenyl, aryl, heterocyclic ring, cyano, hydroxyl, nitro, alkoxy, aryloxy, heterocyclic oxy, silyloxy, acyloxy, alkoxycarbonyloxy, cycloalkyloxycarbonyloxy, aryloxycarbotyloxy, carbamoyloxy, sulfamoyloxy, alkanesulfonyloxy, allenesulfonyloxy, carboxyl, acyl, alkoxycarbonyl, cycloalkyloxycarbonyl, aryloxycarbonyl, carbamoyl, amino, anilino, heterocyclic amino, carbonamide, alkoxycarbonylamino, aryloxycarbonylamino, ureido, sulfonamide, sulfamoylamino, imide, alkylthio, arylthio, heterocyclic thio, sulfinyl, sulfo, alkanesulfonyl, allenesulfonyl, sulfamoyl, and phosphonyl groups.

The compounds represented by formula (M-I) may form a dimer, oligomers, or polymers, with substituents $R'_{11}$, $R'_{12}$, $R'_{13}$ or X.

Hereafter, description will be made about a preferable range of the compounds represented by formula (M-I).

In formula (Q-1), $R'_{14}$ is preferably alkyl group. $R'_{15}$ and $R'_{16}$ are preferably alkyl, cycloalkyl, aryl, hydroxyl, alkoxy, aryloxy, amino, anilino, carbonamide, ureido, sulfonamide, sulfamoylamino, imide, alkylthio, or arylthio group. Among them, alkyl, cycloalkyl, and aryl groups are more preferable, and alkyl is the most preferable.

In formula (Q-2), $R'_{17}$ is preferably alkyl, cycloalkyl, or aryl group. More preferably, $R'_{17}$ is secondary or tertiary alkyl, or cycloalkyl group. $R'_{18}$ is preferably alkyl, cycloalkyl, or aryl group, with alkyl and cycloalkyl groups being more preferred.

In formula (Q-3), $R'_{19}$ and $R'_{110}$ are preferably halogen atoms, alkyl, cycloalkyl,-aryl, alkoxy, aryloxy, acyl, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, heterocyclic thio, sulfinyl, alkanesulfonyl, allenesulfonyl, sulfamoyl, or phosphonyl group. Among them, halogen atoms, alkyl, cycloalkyl, aryl, alkoxy, aryloxy, amino, anilino, carbonamide, ureido, sulfonamide, sulfamoylamino, alkylthio, and arylthio groups are more preferred. The most preferable are alkyl, cycloalkyl, aryl, alkoxy, aryloxy, alkylthio, and arylthio groups. m' is preferably in the range from 0 to 3. More preferably, m' is 1 or 2. $R'_{19}$ is preferably substituted at the ortho- position of phenyl.

$R'_{11}$ is preferably a group represented by formula (Q-1) or (Q-3). More preferably, $R'_{11}$ is a group represented by formula (Q-1). Particularly, it is preferred that R'14, $R'_{15}$, and $R'_{16}$ are alkyl. Most preferably, $R'_{11}$ is t-butyl. Hereinafter, preferable examples of the group represented by $R'_1$i are given, which should not be construed as limiting the present invention.

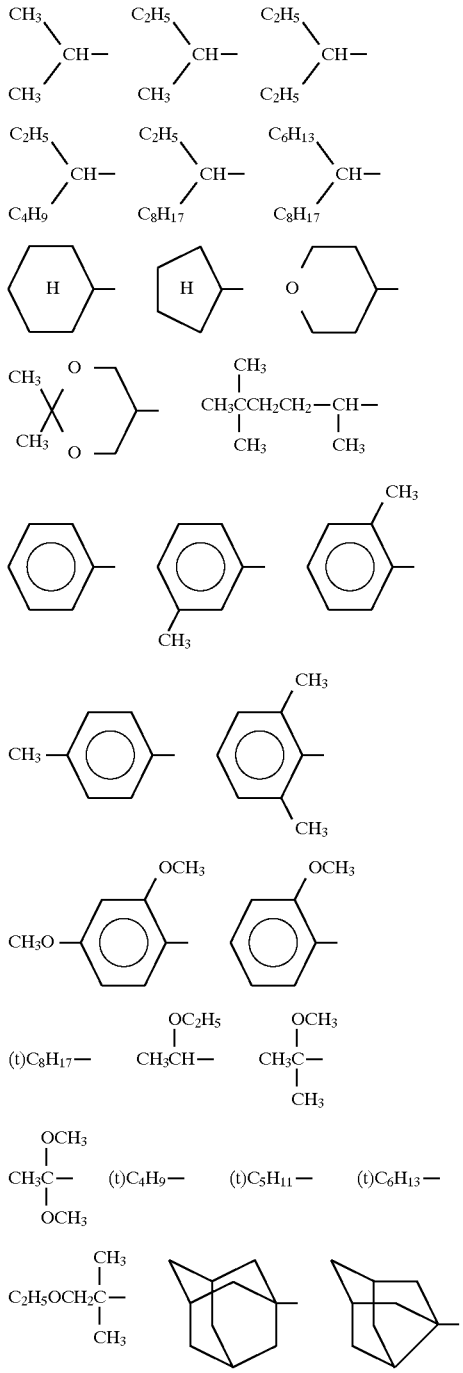

-continued

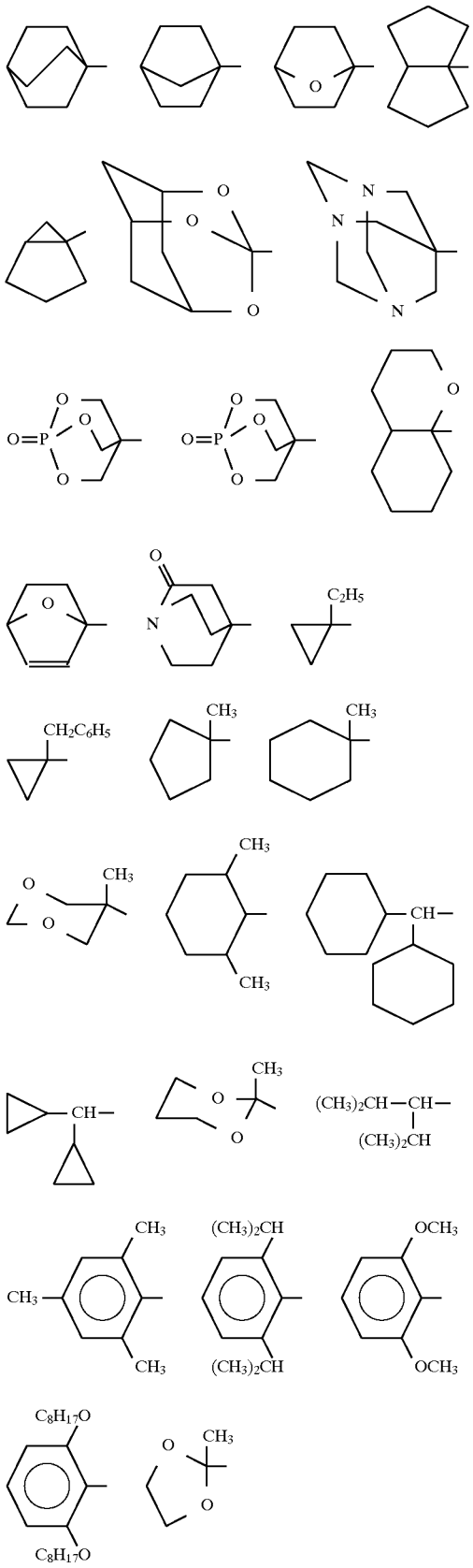

-continued

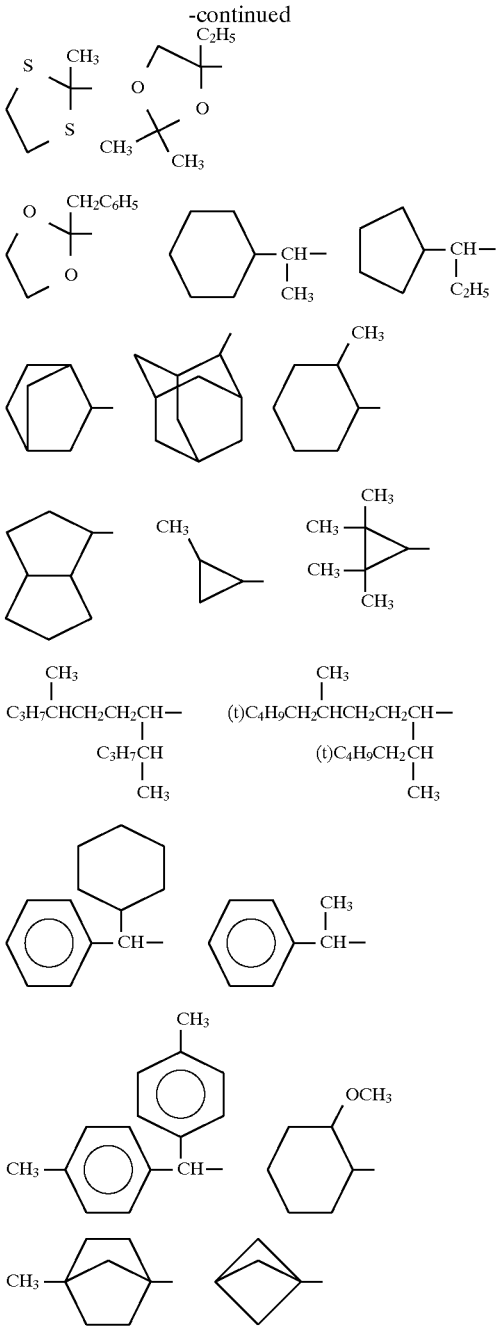

$R'_{12}$ is alkoxy, aryloxy, acyloxy, alkoxycarbonyloxy, cycloalkyloxycarbonyloxy, aryloxycarbonyloxy, carbamoyloxy, sulfamoyloxy, alkanesulfonyloxy, allenesulfonyloxy, acyl, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, heterocyclic thio, alkanesulfonyl, allenesulfonyl, or sulfamoyl group. Among them, preferable are alkoxy, aryloxy, acyl, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, and sulfamoyl groups. $R'_{12}$ is preferably substituted at a meta- or para- position with respect to the carbon atom which is linked to the pyrazolotriazole ring, with the para-position being more preferred.

Preferably, $R'_{13}$ is a fluorine, chlorine or bromine atom, alkyl, cycloalkyl, aryl, a heterocyclic ring, cyano, hydroxyl, nitro, alkoxy, aryloxy, carboxyl, acyl, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, sulfamoylamino, imide, alkylthio, arylthio, heterocyclic thio, sulfinyl, sulfo, alkanesulfonyl, allenesulfonyl, sulfamoyl, or phosphonyl group. n' is preferably in the range from 0 to 3. More preferably, n' is 0 or 1.

X is preferably a hydrogen, chlorine or bromine atom, aryloxy, alkylthio, arylthio, heterocyclic thio, or heterocyclic group. More preferably, X is a chlorine atom or aryloxy group, with a chlorine atom being most preferred. Hereafter, preferable examples of X will be given, which should not be construed as limiting the invention.

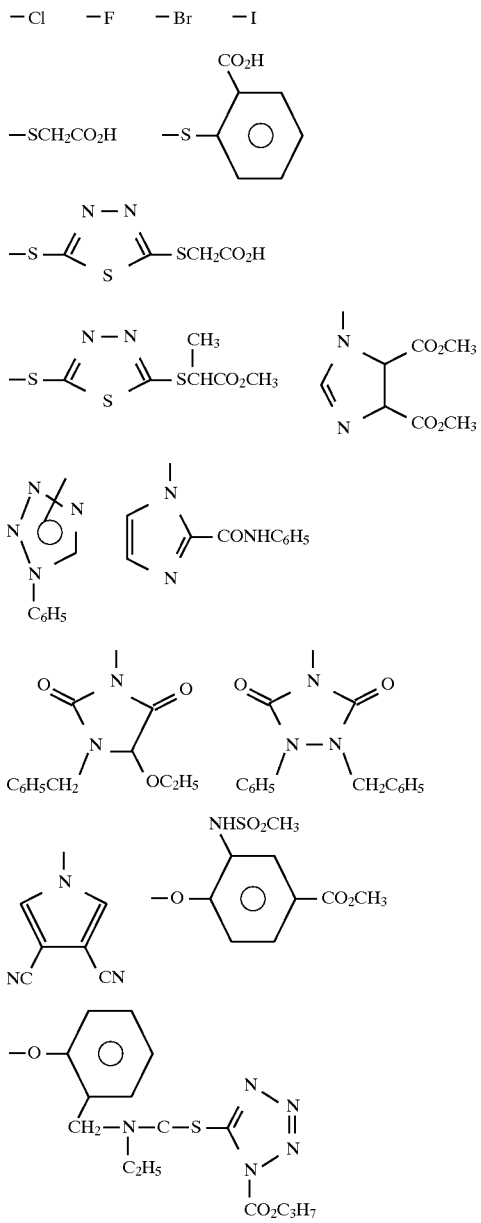

-continued
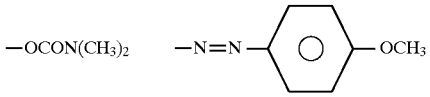
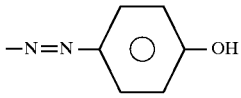
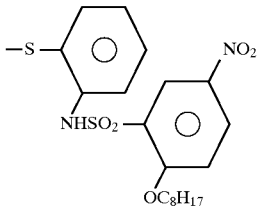
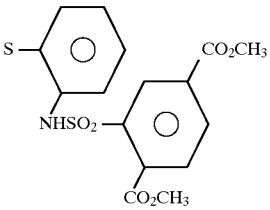
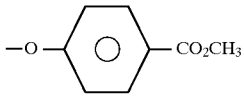
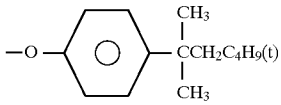
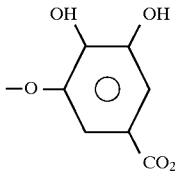
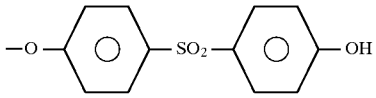
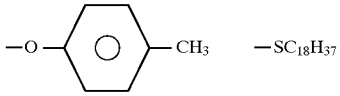
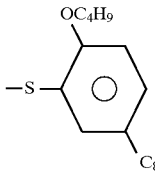
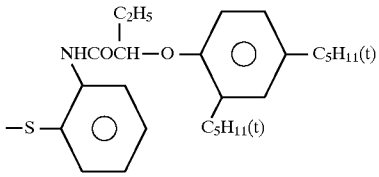
-continued
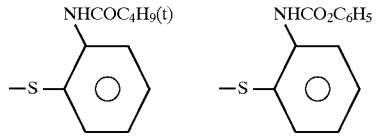
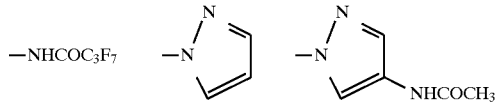
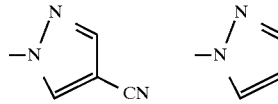
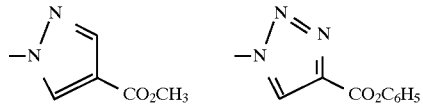
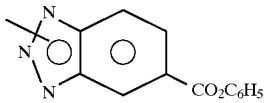
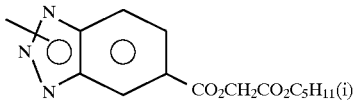
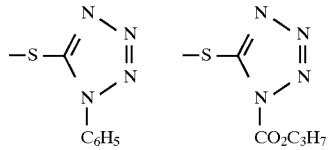
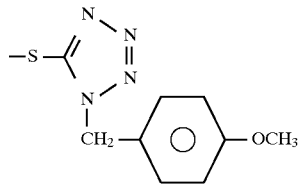
Among the compounds of (M-I), compounds represented by the following (M-II), and particularly compounds of formula (M-III) are preferred in view of advantageous effects of the present invention.
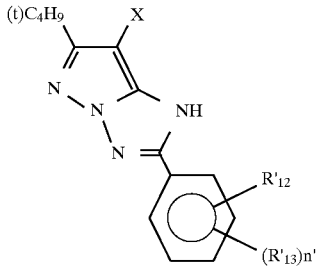
(M-II)
wherein $R'_{12}$, $R'_{13}$, n' and X have the same meanings as defined in formula (M-I).

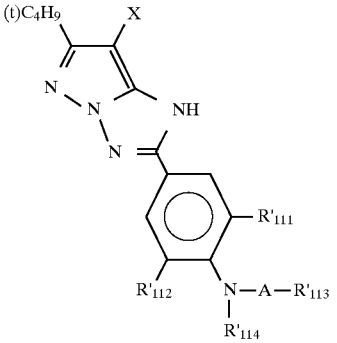

(M-III)

wherein $R'_{111}$ and $R'_{112}$ are hydrogen atoms or substituents, A is —CO— or —$SO_2$, $R'_{113}$ is alkyl, aryl, alkoxy, alkylamino or anilino group, $R'_{114}$ is hydrogen, alkyl, aryl, acyl, alkanesulfonyl, or allenesulfonyl, and X is hydrogen or a group which is releasable by a coupling reaction with an oxidized developing agent. $R'_{113}$ and $R'_{114}$ may be linked to each other and may form a ring having 5–7 members.

In formula (M-III), $R'_{111}$ and $R'_{112}$ are preferably a hydrogen, fluorine, chlorine or bromine atom, alkyl, cycloalkyl, aryl, heterocyclic, cyano, hydroxyl, nitro, alkoxy, aryloxy, carboxyl, acyl, alkoxycarbonyl, cycloalkyloxycarbonyl, aryloxycarbonyl, carba page moyl, amino, anilino, carbonamide, alkoxycarbonylamino, aryloxycarbonylamino, ureido, sulfonamide, sulfamoylamino, imide, alkylthio, arylthio, heterocyclic thio, sulfinyl, sulfo, alkanesulfonyl, allenesulfonyl, sulfamoyl, or phosphonyl group. $R'_{113}$ is preferably alkyl or aryl group. $R'_{114}$ is preferably hydrogen or alkyl. A is preferably —CO—. X is preferably a hydrogen, chlorine or bromine atom, aryloxy, alkylthio, arylthio, heterocyclic thio, or heterocyclic group. More preferably, X is a chlorine atom or aryloxy group, with a chlorine group being most preferred.

Next, specific examples of the pyrazolotriazole magenta couplers represented by formula (M-I) which can be used in the present invention will be given, which should not be construed as limiting the invention.

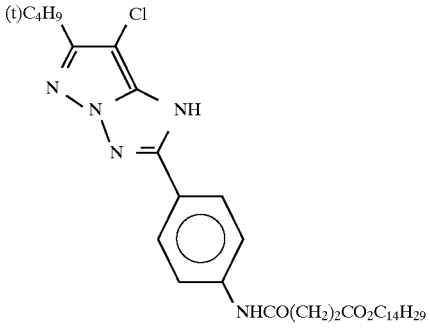

M-1

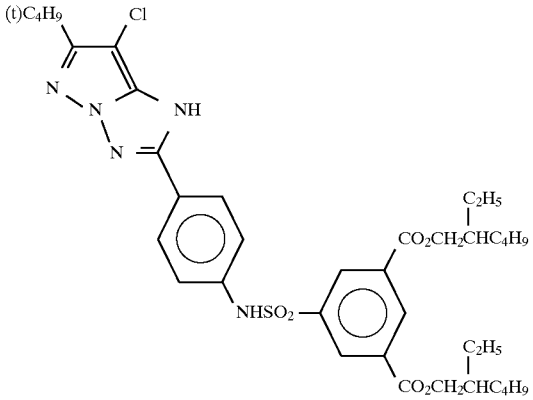

M-2

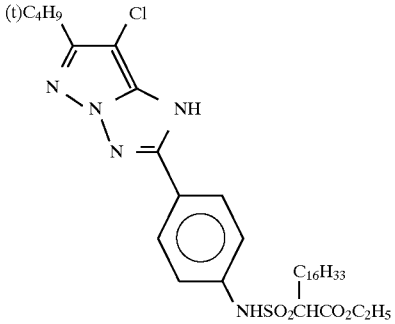

M-3

-continued
M-4
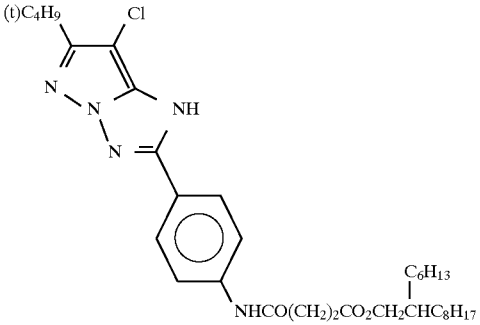
M-5
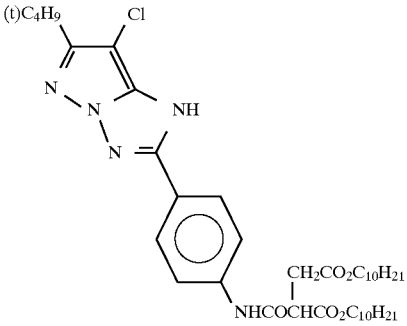
M-6
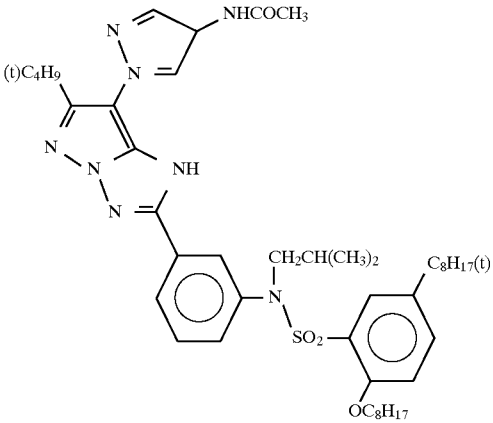
M-7
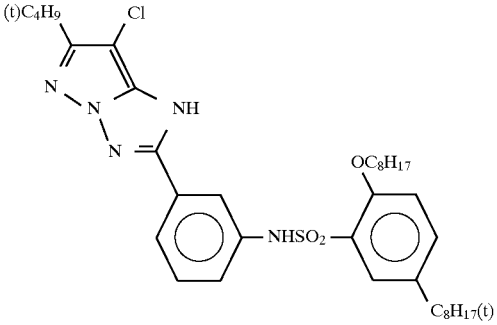

-continued
M-8
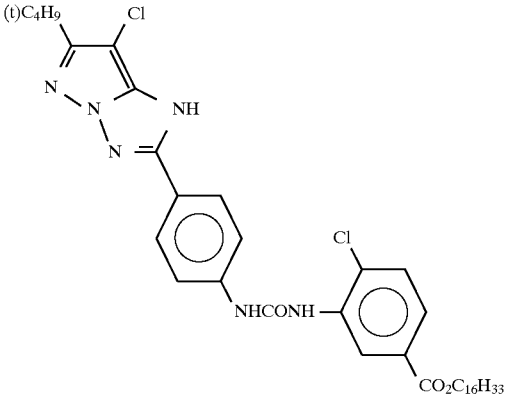
M-9
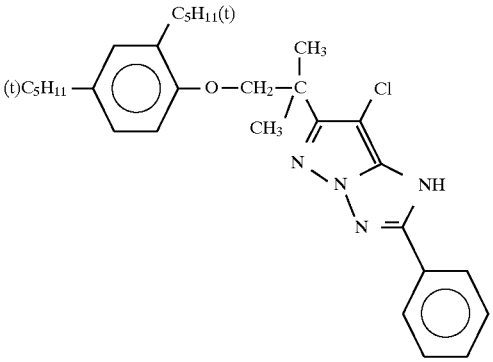
M-10
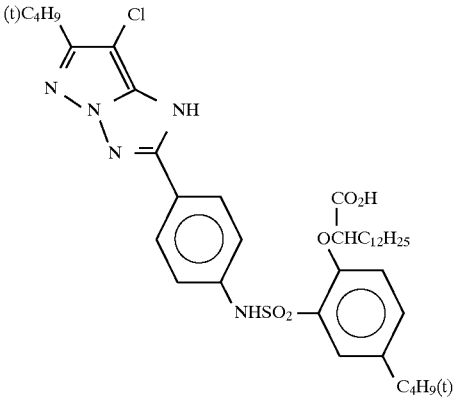

-continued
M-11
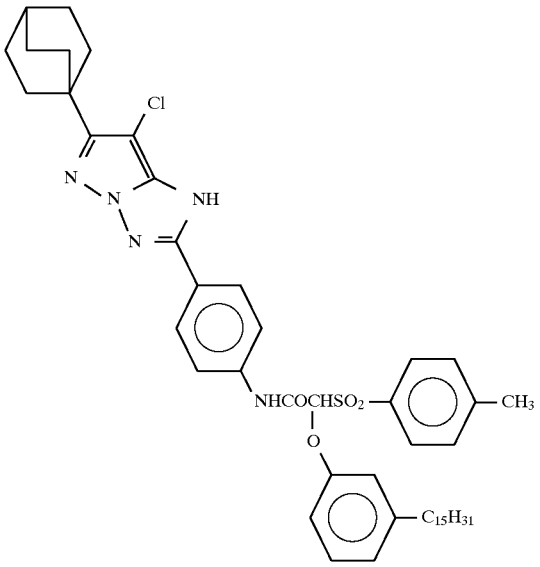
M-12
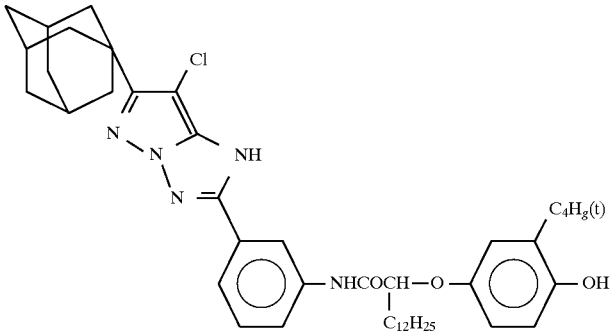
M-13
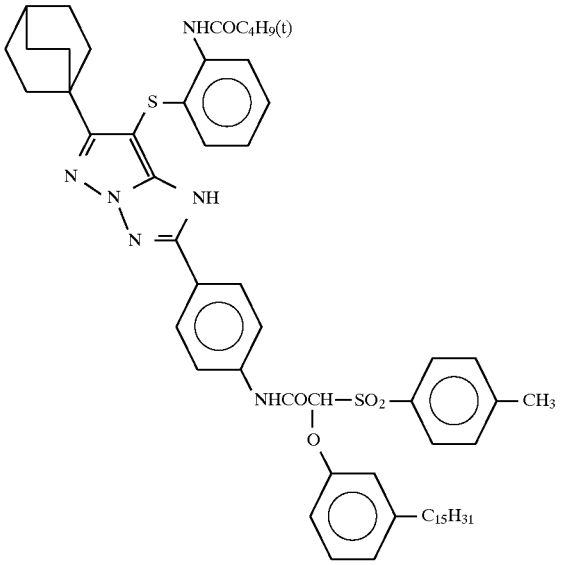

-continued
M-14
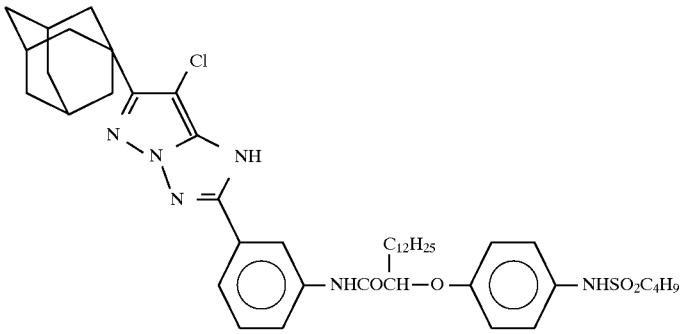
M-15
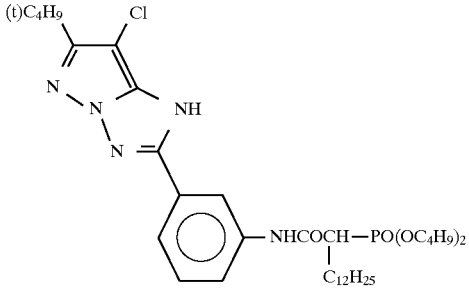
M-16
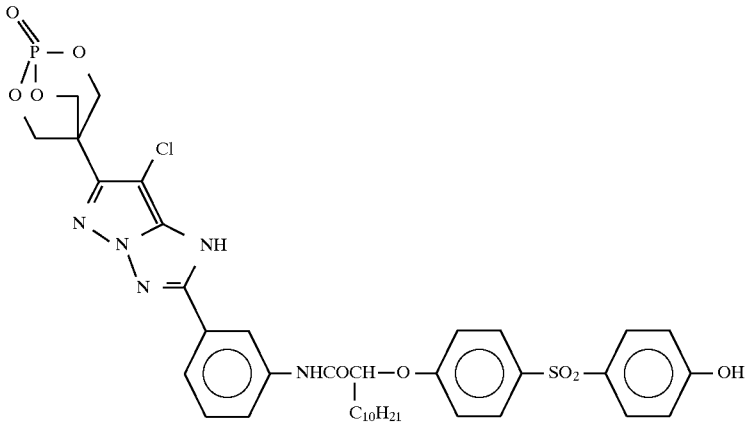
M-17
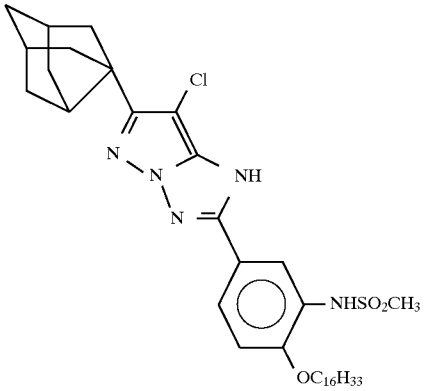

-continued
M-18
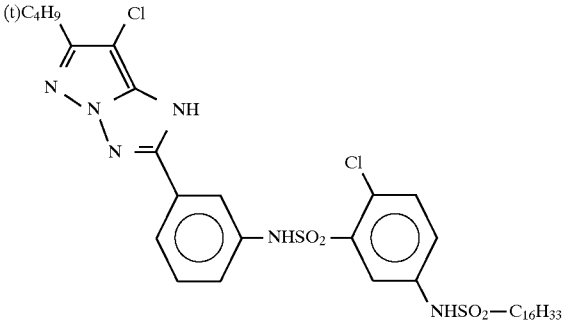
M-19
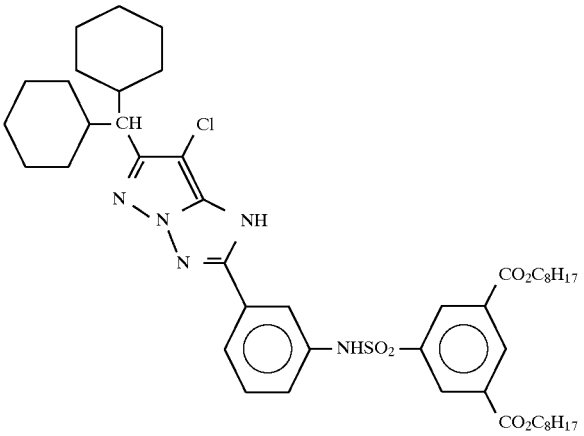
M-20
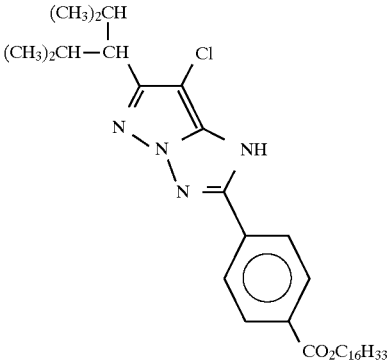
M-21
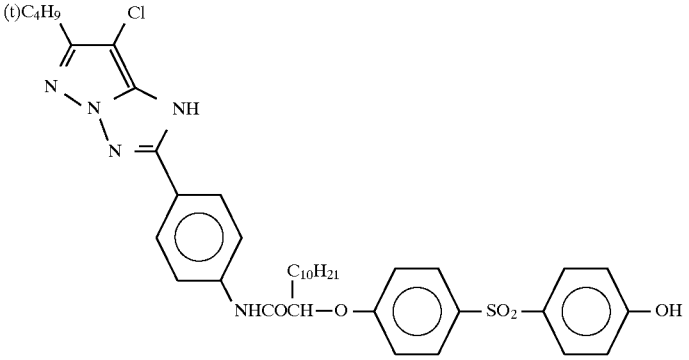

-continued
M-22
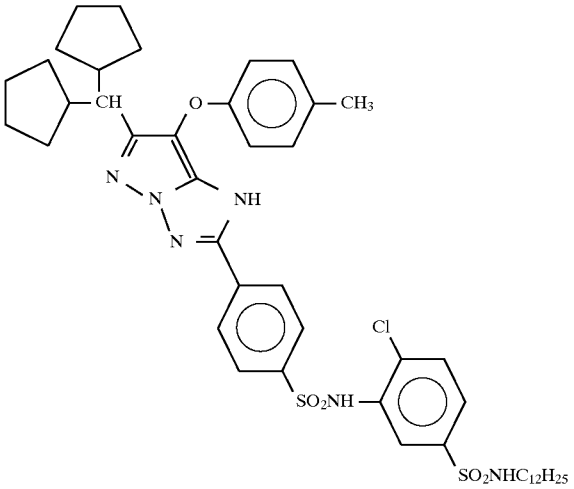
M-23
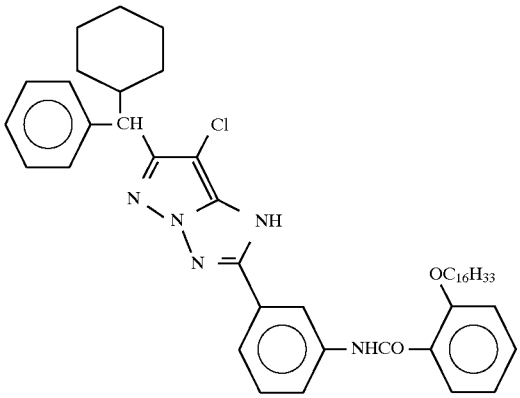
M-24
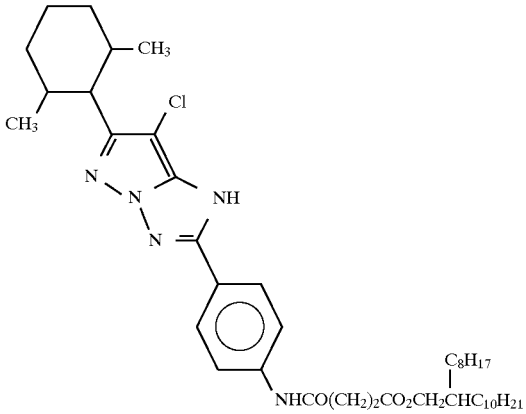
M-25
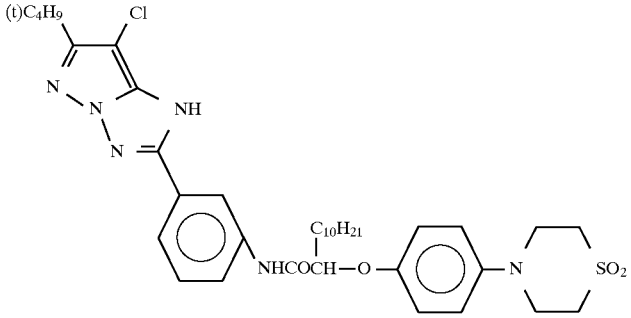

-continued
M-26
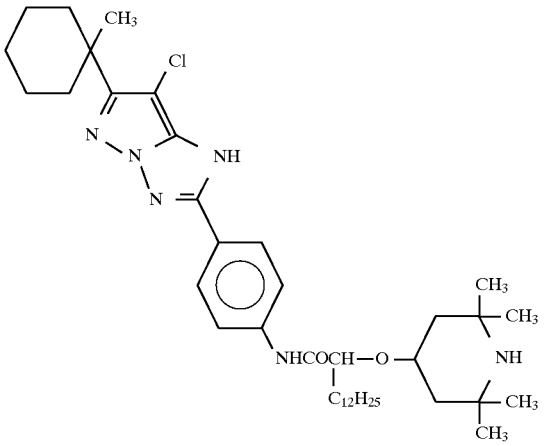
M-27
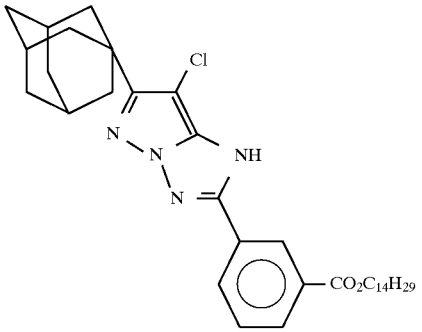
M-28
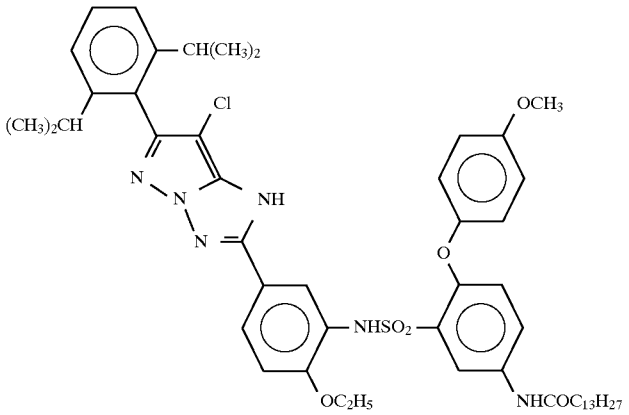
M-29
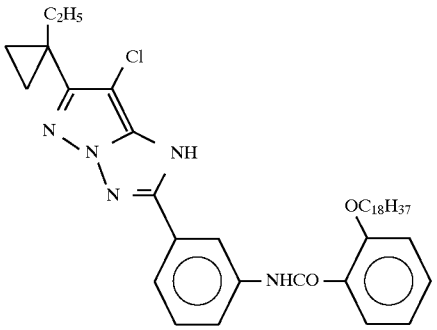

-continued
M-30
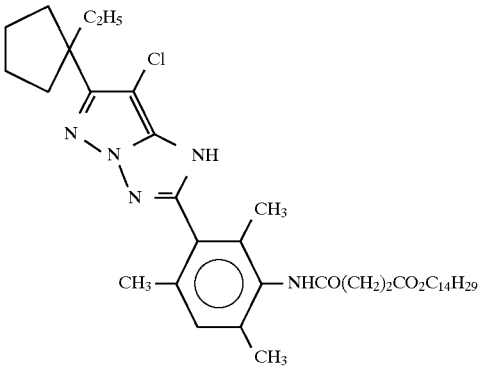
M-31
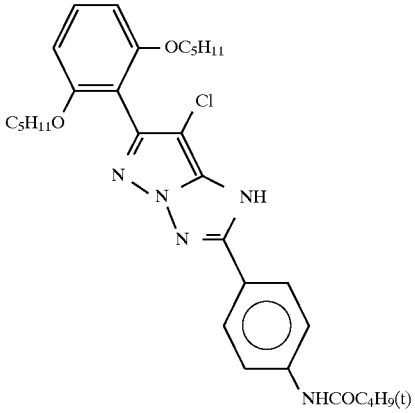
M-32
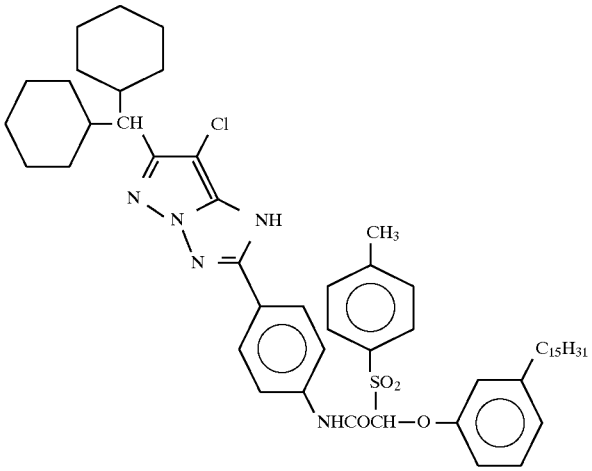
M-33
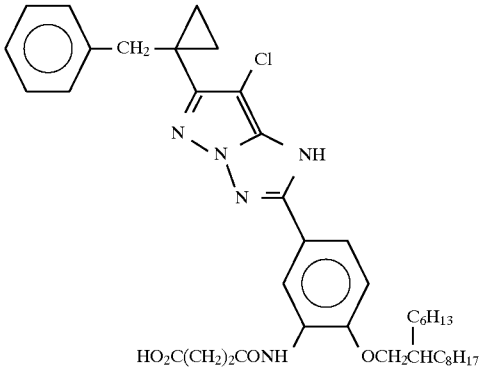

-continued
M-34
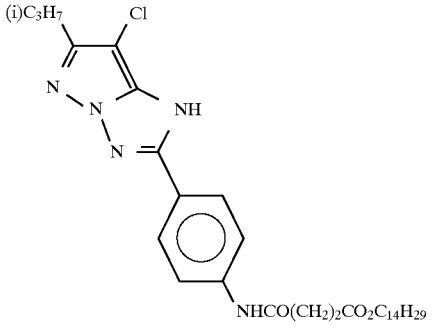
M-35
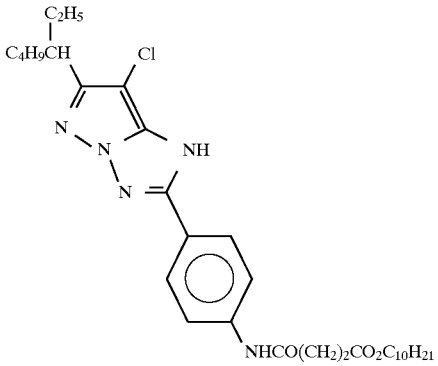
M-36
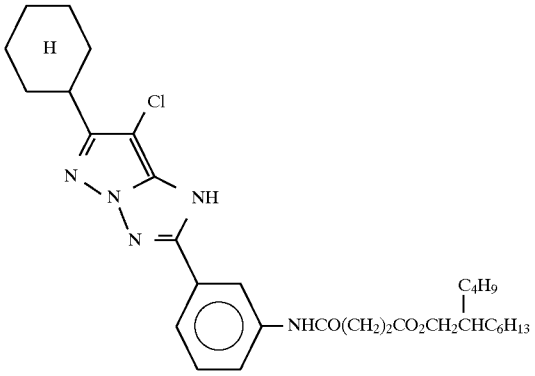
M-37
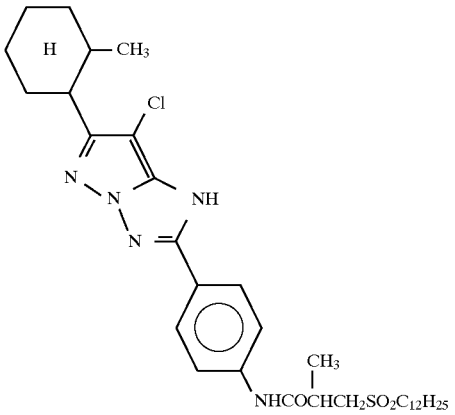

-continued
M-38
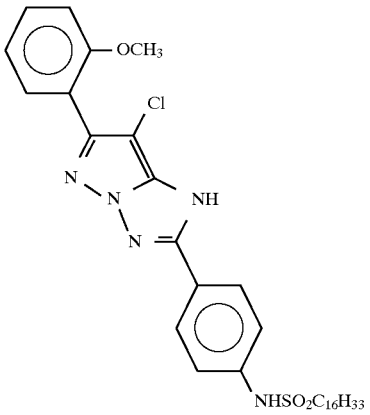
M-39
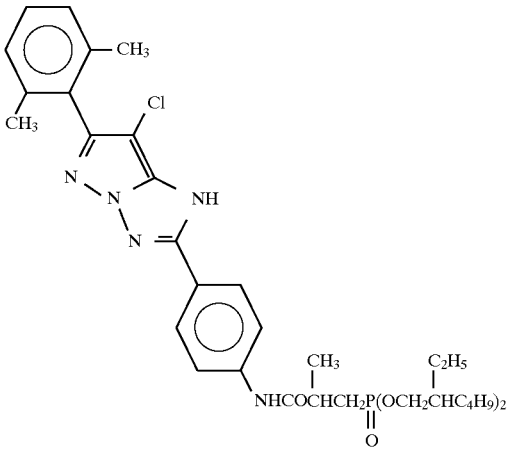
M-40
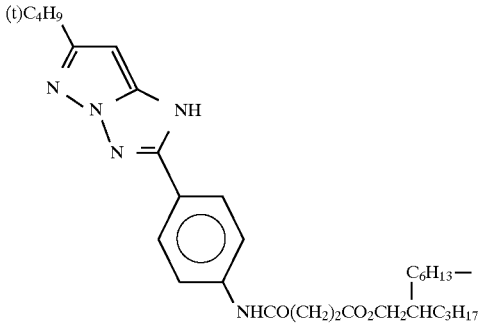
M-41
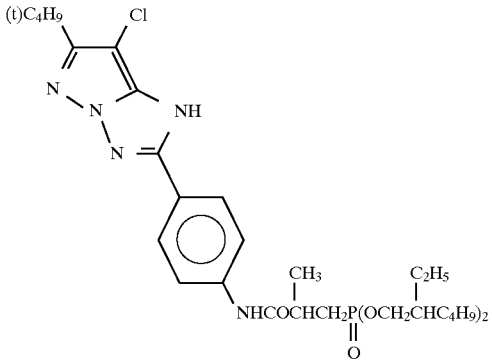

-continued
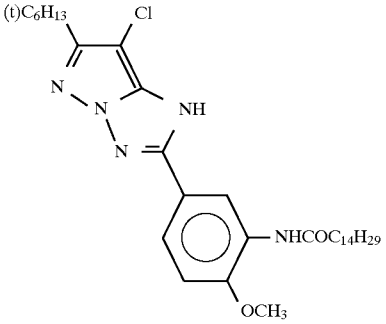
M-42
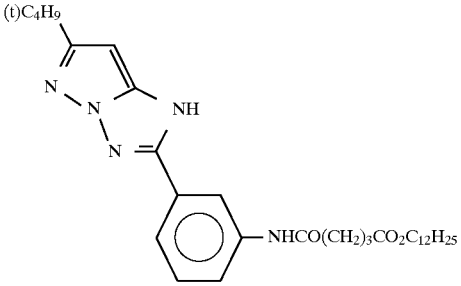
M-43
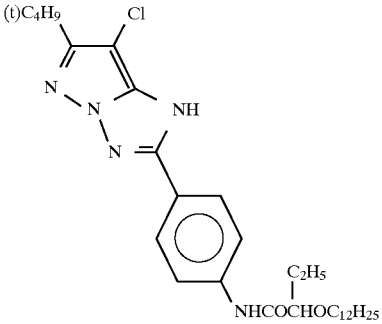
M-44
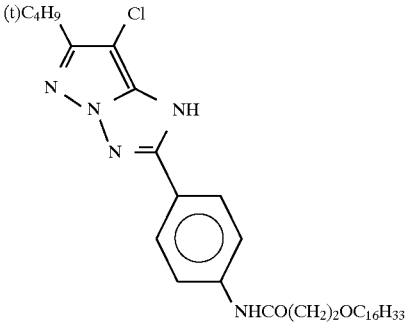
M-45
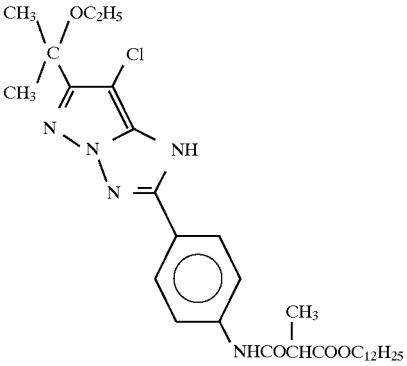
M-46

-continued
M-47
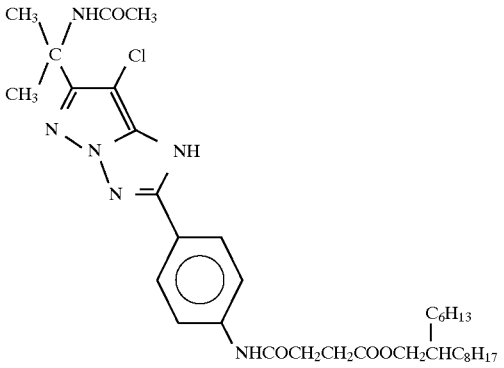
M-48
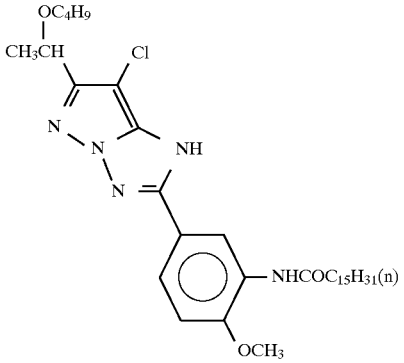
M-49
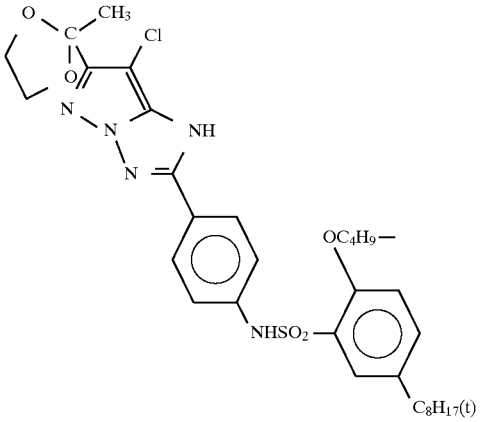
M-50
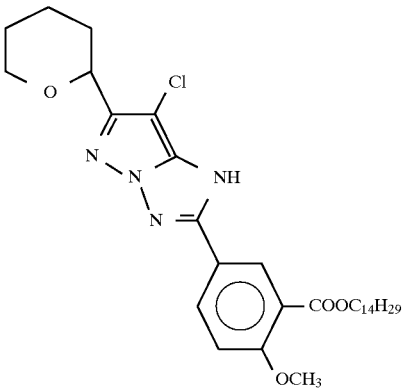

-continued

M-51

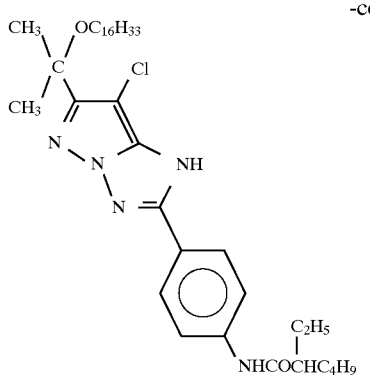

The pyrazolotriazole magenta coupler of formula (M-I) is preferably incorporated in a silver halide emulsion layer containing silver halide-rich emulsion particles having the silver halide content of not less than 70 mol %. The amount of the coupler is preferably from 0.1 to 2 mol, particularly from 0.2 to 1.2 mol, per 1 mol of silver halide in the same layer.

The silver halide emulsion particles which are present in the silver halide emulsion layer containing a magenta coupler according to the present invention are formed by adding, into a system containing said silver halide particles, a bromine ion releasing compound and/or a bromine atom releasing compound in an amount of 0.0005–0.05 mol per mol of silver halide, at any time during a period from completion of the formation of the silver halide particles to its application onto a support.

If the amount of the bromine ion releasing compound and/or bromine atom releasing compound to be added is less than 0.0005 mol, effects of the present invention cannot be achieved. That is, reduction in sensitivity cannot be prevented when the light-sensitive materials are exposed to light under highly humid conditions after storage for a prolonged period. On the other hand, if the amount is in excess of 0.05 mol, desensitization will occur when pressure is applied to the light-sensitive materials. It is particularly preferred to add a bromine ion releasing compound and/or a bromine atom releasing compound in an amount from 0.001 to 0.03 mol.

The addition of the bromine ion releasing compound and/or the bromine atom releasing compound is preferably effected after completion of chemical sensitization and before application of the emulsion layer.

The bromine ion releasing compound and/or the bromine atom releasing compound is not particularly limited as long as it is capable of releasing bromine ions or bromine atoms when it is added to a system containing silver halide. Preferable examples include inorganic compounds, such as potassium bromide, calcium bromide, sodium bromide, zinc bromide, and silver bromide; and organic compounds, such as those listed in U.S. Pat. No. 5,061,615 (for example, $Br(CH_2)_3COOH$). When silver bromide is used, it may be used in the form of a silver bromide emulsion or a silver chloroiodobromide emulsion.

The present invention will further be described by way of examples, which should not be construed as limiting the present invention.

EXAMPLES

Example 1

Layers having the compositions described below are applied on a cellulose triacetate film support which has an undercoat thereon (thickness of support: 140 μm, a resin layer containing fine carbon particles is provided on the surface opposite the emulsion surface so as to have a transmission density of 1.0) to prepare a multilayer color photographic sensitive material (sample No. 101).

Structure of layers:

The compositions of the layers are shown below. The figures indicate the amounts of coating ($g/m^2$). The figures given for silver halide emulsions indicate the amounts of coating converted into the amounts of silver halide.

First layer (blue-sensitive emulsion layer):

| | |
|---|---|
| Silver chlorobromide emulsion (cubic, average halogen composition: Br/Cl = 1 mol %: 99 mol %, a 1:3 mixture (based on mols of siiver) of (B1) gold sulfate sensitizing emulsion containing particles having an average grain size of 0.7 μm and (B2) gold sulfate sensitizing emulsion containing particles having an average grain size of 0.4 μm): | 0.50 |
| Gelatin | 1.66 |
| Yellow coupler (ExY) | 1.10 |
| Solvent (Solv-1) | 0.13 |
| Solvent (Solv-2) | 0.13 |
| (Cpd-1) | 0.0016 |
| (Cpd-2) | 0.0006 |
| (Cpd-3) | 0.006 |
| (Cpd-4) | 0.03 |

Second layer (color amalgamation inhibiting layer):

| | |
|---|---|
| Gelatin | 0.40 |
| (Cpd-5) | 0.03 |
| Solvent (Solv-3) | 0.03 |
| Solvent (Solv-4) | 0.03 |

Third layer (red sensitive emulsion layer):

| | |
|---|---|
| Silver chlorobromide emulsion (cubic, average halogen composition: Br/Cl = 25 mol %: 75 mol %, a 1:3 mixture (based on mols of silver) of (R1) gold sulfate sensitizing emulsion containing particles having an average grain size of 0.25 μm and (R2) gold sulfate sensitizing emulsion containing particles having an average grain size of 0.1 μm): | 0.44 |
| Gelatin | 2.12 |
| Cyan coupler (ExC) | 0.97 |

-continued

| | |
|---|---|
| (Cpd-6) | 0.18 |
| (Cpd-5) | 0.015 |
| Solvent (Solv-5) | 0.50 |
| Solvent (Solv-6) | 0.32 |
| (Cpd-7) | 0.0002 |
| (Cpd-8) | 0.003 |
| (Cpd-2) | 0.003 |

Fourth layer (color amalgamation inhibiting layer):

| | |
|---|---|
| Gelatin | 0.40 |
| (Cpd-5) | 0.03 |
| Solvent (Solv-3) | 0.03 |
| Solvent (Solv-4) | 0.03 |

Fifth layer (green sensitive emulsion layer):

| | |
|---|---|
| Silver chlorobromide emulsion (cubic, average halogen composition: Br/Cl = 25 mol %: 75 mol %, a 1:3 mixture (based on mols of silver) of (G1) gold sulfate sensitizing emulsion containing particles having an average grain size of 0.25 μm and (G2) gold sulfate sensitizing emulsion containing particles having an average grain size of 0.1 μm): | 0.52 |
| Gelatin | 1.29 |
| Magenta coupler (ExM) | 0.61 |
| (Cpd-9) | 0.001 |
| (Cpd-5) | 0.012 |
| Solvent (Solv-3) | 0.15 |
| (Cpd-10) | 0.003 |
| (Cpd-11) | 0.002 |
| (Cpd-12) | 0.003 |

Sixth layer (protective layer):

| | |
|---|---|
| Gelatin | 0.98 |
| Acrylic modified copolymer of polyvinyl alcohol (degree of modification: 17%) | 0.05 |
| Liquid paraffin | 0.02 |

The compounds used in this Examples are as follows.

(1) ExY

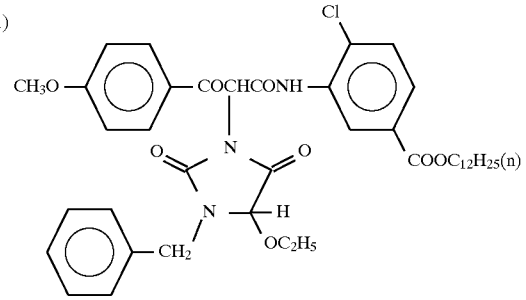

(2)

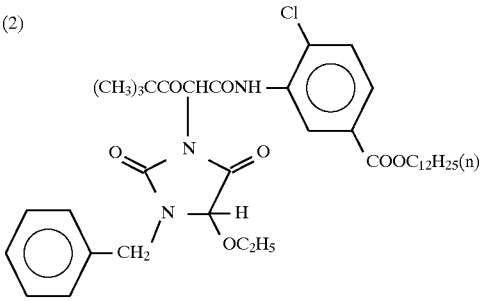

Mixture of (1) and (2) (weight ratio = 76:24)

ExM

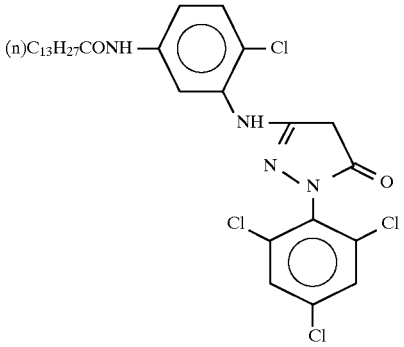

-continued
ExC
(1)
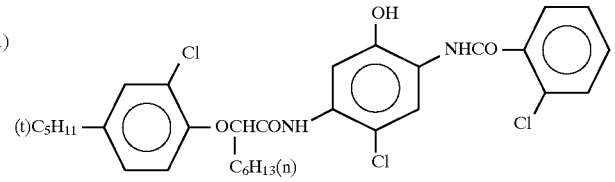
(2)
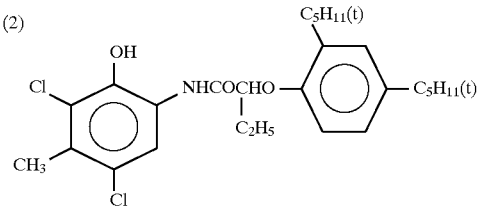
Mixture of (1) and (2) (weight ratio = 88:12)
(Cpd-1)
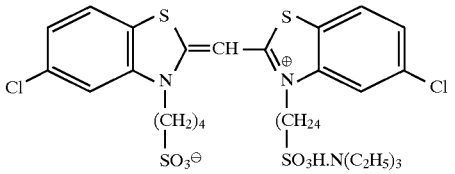
(Cpd-2)
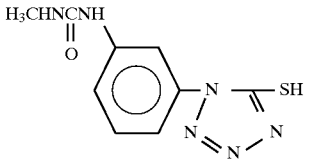
(Cpd-3)
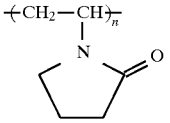
(Cpd-4)
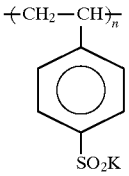
(Cpd-5)
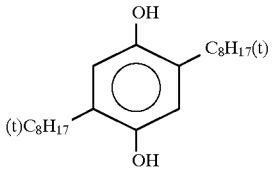
(Cpd-6)
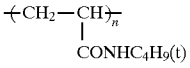
Average molecular weight: about 60,000
(Cpd-7)
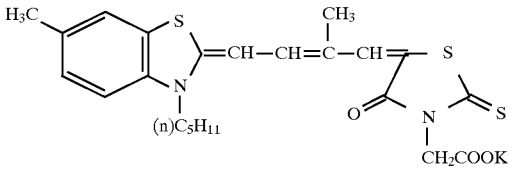

-continued
(Cpd-8)
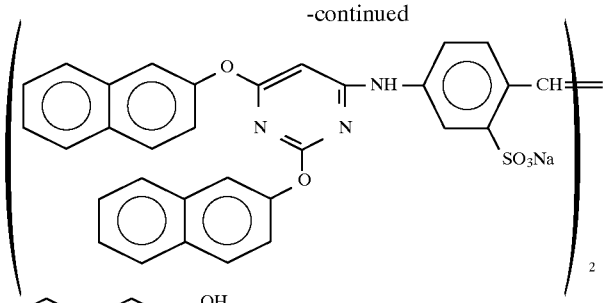
(Cpd-9)
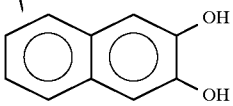
(Cpd-10)
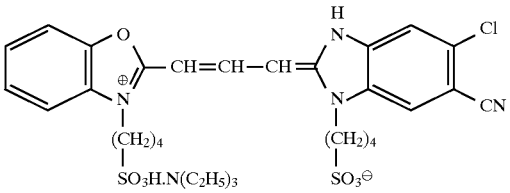
(Cpd-11)
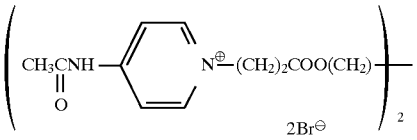
(Cpd-12)
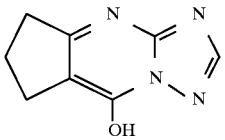
(Solv-1)
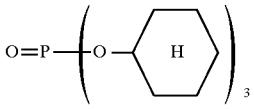
(Solv-2)
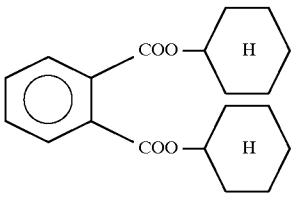
(Solv-3)
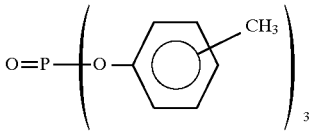
$O{=}P{+}O{-}C_6H_{13}(n))_3$ (Solv-4)
(Solv-5)
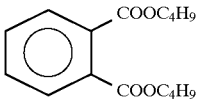
(Solv-6)
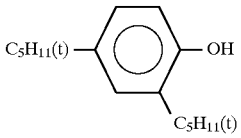
As a gelatin setting agent for each layer, a sodium salt of 1-oxy-3,5-dichloro-s-triazine was used.
Moreover, in order to prevent irradiation, a dye represented by the following formula was used in the emulsion layers (the figure in parenthesis indicates the quantity of coat).

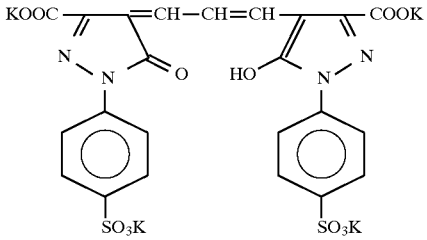

(0. 043g/m2)

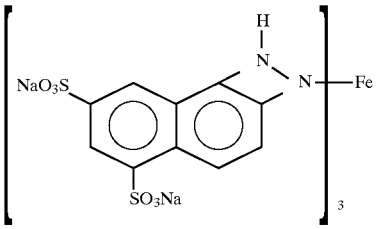

(0. 098g/m2)

Preparation of solid dispersion of a dye:

A wet cake of the dyes in Table 10 (8.35 g in terms of the net content of the dye) and dispersing additive shown in Table 10 (2.51 g) were added to water to prepare a solution of 83.5 g, to which glass beads for removing alkali (1 mm in diameter, 218 g) were added. The resultant material was dispersed using a "Sandgrinder Mill-TSG" (product of Aimex K.K.) for the periods indicated in Table 10.

Subsequently, the contents of the mill were taken out to filter off the beads and to collect a dispersion. The average grain size in the dispersion was determined with a mastersizer made by Maruburn.

TABLE 10

| Sample No. | Dye | Dispersant | Time of dispersion [hr] | Average particle size [μm] |
|---|---|---|---|---|
| 1 | 1 | A | 4.5 | 0.40 |
| 2 | 2 | B | 4.5 | 0.45 |
| 3 | 3 | B | 4.5 | 0.41 |
| 4 | 4 | B | 4.5 | 0.48 |
| 5 | 5 | B | 6 | 0.45 |
| 6 | 6 | B | 6 | 0.42 |
| 7 | 7 | B | 6 | 0.40 |

A: Carboxymethylcellulose, Na salt (Trademark: Cerogen 6A, by Daiich Kogyo Seiyaku K.K.)
B: A polycondensation product of naphthalene sulfonic acid Next, the resin layer of sample 101, the layer being provided on the back surface of the support, was removed, and in its place, a hydrophilic layer containing a conductive polymer shown below and fine particles of tin oxide was provided. In addition, a layer having the following composition and containing a compound in a dispersion form of solid fine particles was newly provided the surface of the support and the first layer to prepare samples 102 to 107.

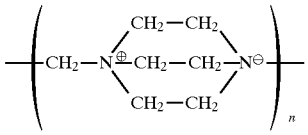

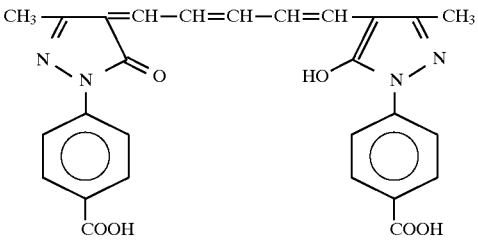

Dye 1

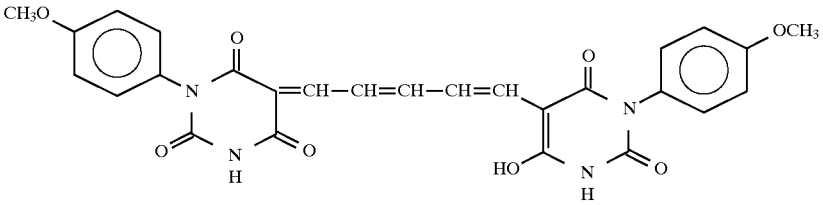

Dye 2

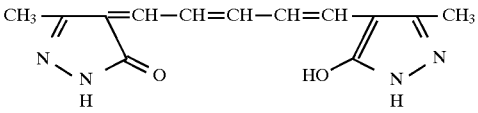

Dye 3

-continued

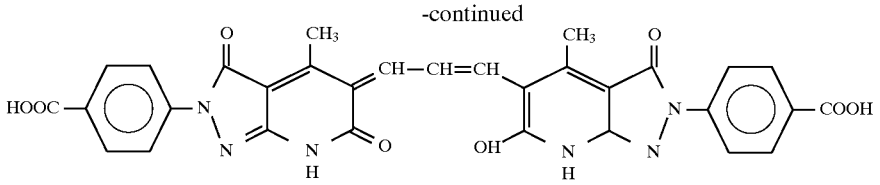

Dye 4

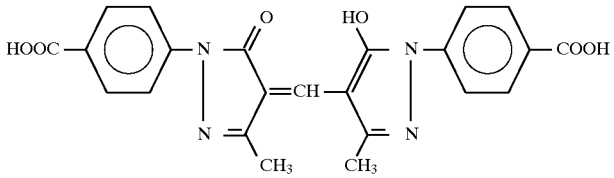

Dye 5

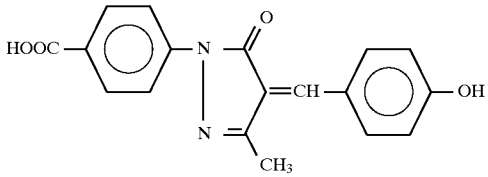

Dye 6

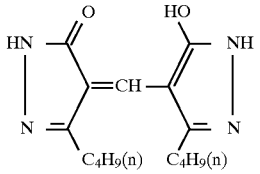

Dye 7

Each sample was subjected to gradation exposure (at 60,000 lux for 1/100 second) for sensitometry through a B, G or R filter using a sensitometer (made by Fuji Photo Film Co, Ltd., model FWH, color temperature of the light source: 3200 K), and processed according to the process, ECP-2, proposed by Eastman Kodak.

Evaluation of sharpness:

Exposure was effected through an optical wedge for measuring sharpness and a Y, M or C filter, followed by processing as described below. The sharpness was indicated by spatial frequency (lines/mm) which gives CTF of 0.8. Greater values indicate higher sharpnesses.

Evaluation of photographic characteristics:

A so-called characteristic curve was obtained by measuring the transmission density of processed samples through a B, G, or R filter. Sensitivity was defined as an inverse number of the exposure level which gives a concentration 1.0 higher than the minimum density (hereinafter referred to as $D_{min}$), and shown as a relative value assuming that the sensitivity of sample 101 is 100. Furthermore, the maximum density ($D_{max}$) was obtained.

The results are shown in Tables 11 and 12.

TABLE 11

| Sample No. | Resin (Presence/ absence of layer) | Kinds and amounts of solid, dispersed compound (note 1) | Amount of gel coating of layer containing solid, dispersed compound | Sharpness | | | Sensitivity | | | $D_{min}$ | | | $D_{max}$ | | | Remarks |
|---|---|---|---|---|---|---|---|---|---|---|---|---|---|---|---|---|
| | | | | Y | M | C | Y | M | C | Y | M | C | Y | M | C | |
| 101 | Presence | None | — | 18 | 30 | 25 | 100 | 100 | 100 | 0.08 | 0.05 | 0.05 | 2.5 | 3.0 | 3.2 | Comparative example |
| 102 | Absence | A | 1.3 g/m$^2$ | 10 | 30 | 20 | 100 | 100 | 100 | 0.08 | 0.05 | 0.05 | 2.4 | 2.5 | 2.6 | Comparative example |
| 103 | Absence | B | 1.3 g/m$^2$ | 10 | 20 | 20 | 50 | 30 | 30 | 0.08 | 0.05 | 0.05 | 2.5 | 3.0 | 3.2 | Comparative example |
| 104 | Absence | C | 1.3 g/m$^2$ | 18 | 30 | 20 | 100 | 30 | 100 | 0.08 | 0.07 | 0.06 | 2.5 | 2.5 | 2.6 | Comparative example |
| 105 | Absence | D | 1.3 g/m$^2$ | 10 | 30 | 30 | 110 | 100 | 100 | 0.08 | 0.05 | 0.05 | 2.5 | 2.5 | 2.6 | Comparative example |
| 106 | Absence | A + E | 1.3 g/m$^2$ | 20 | 30 | 20 | 90 | 100 | 100 | 0.08 | 0.05 | 0.05 | 2.4 | 2.5 | 2.6 | Comparative example |
| 107 | Absence | B + E | 1.3 g/m$^2$ | 20 | 20 | 20 | 40 | 30 | 30 | 0.08 | 0.05 | 0.05 | 2.5 | 3.0 | 3.2 | Comparative example |
| 108 | Absence | C + E | 1.3 g/m$^2$ | 22 | 30 | 20 | 90 | 30 | 100 | 0.08 | 0.07 | 0.05 | 2.5 | 2.5 | 2.6 | Comparative example |

TABLE 11-continued

| Sample No. | Resin (Presence/ absence of layer) | Kinds and amounts of solid, dispersed compound (note 1) | Amount of gel coating of layer containing solid, dispersed compound | Sharpness | | | Sensitivity | | | $D_{min}$ | | | $D_{max}$ | | | Remarks |
|---|---|---|---|---|---|---|---|---|---|---|---|---|---|---|---|---|
| | | | | Y | M | C | Y | M | C | Y | M | C | Y | M | C | |
| 109 | Absence | D + E | 1.3 g/m$^2$ | 20 | 30 | 30 | 100 | 100 | 100 | 0.08 | 0.05 | 0.05 | 2.5 | 2.9 | 3.1 | Present invention |

Note) A: Dye 1 (150 mg/m$^2$)
B: Dye 2 (150 mg/m$^2$)
C: Dye 3 (150 mg/m$^2$)
D: Dye 4 (150 mg/m$^2$)
E: Dye 5 (30 mg/m$^2$)

TABLE 12

| Sample No. | Resin (Presence/ absence of layer) | Kinds and amounts of solid, dispersed compound (note 1) | Amount of gel coating of layer containing solid, dispersed compound | Sharpness | | | Sensitivity | | | $D_{min}$ | | | $D_{max}$ | | | Remarks |
|---|---|---|---|---|---|---|---|---|---|---|---|---|---|---|---|---|
| | | | | Y | M | C | Y | M | C | Y | M | C | Y | M | C | |
| 110 | Absence | A + F | 1.3 g/m$^2$ | 20 | 30 | 20 | 80 | 100 | 100 | 0.09 | 0.05 | 0.05 | 2.4 | 2.5 | 2.6 | Comparative example |
| 111 | Absence | B + F | 1.3 g/m$^2$ | 20 | 20 | 20 | 40 | 30 | 30 | 0.09 | 0.05 | 0.05 | 2.5 | 3.0 | 3.2 | Comparative example |
| 112 | Absence | C + F | 1.3 g/m$^2$ | 22 | 30 | 20 | 80 | 30 | 100 | 0.09 | 0.07 | 0.05 | 2.5 | 2.5 | 2.6 | Comparative example |
| 113 | Absence | D + F | 1.3 g/m$^2$ | 20 | 30 | 30 | 90 | 100 | 100 | 0.09 | 0.05 | 0.05 | 2.5 | 2.9 | 3.1 | Present invention |
| 114 | Absence | A + G | 1.3 g/m$^2$ | 25 | 30 | 20 | 100 | 100 | 100 | 0.08 | 0.05 | 0.05 | 2.4 | 2.5 | 2.6 | Comparative example |
| 115 | Absence | B + G | 1.3 g/m$^2$ | 25 | 20 | 20 | 50 | 30 | 30 | 0.08 | 0.05 | 0.05 | 2.5 | 3.0 | 3.2 | Comparative example |
| 116 | Absence | C + G | 1.3 g/m$^2$ | 22 | 30 | 20 | 100 | 30 | 100 | 0.08 | 0.07 | 0.05 | 2.5 | 2.5 | 2.6 | Comparative example |
| 117 | Absence | D + G | 1.3 g/m$^2$ | 25 | 30 | 30 | 110 | 100 | 100 | 0.08 | 0.05 | 0.05 | 2.5 | 2.9 | 3.1 | Present invention |

Note) A: Dye 1 (150 mg/m$^2$)
B: Dye 2 (150 mg/m$^2$)
C: Dye 3 (150 mg/m$^2$)
D: Dye 4 (150 mg/m$^2$)
F: Dye 6 (30 mg/m$^2$)
G: Dye 7 (30 mg/m$^2$)

The advantageous effects of the present invention are clear from the tables. A sample containing dye No. 1 exhibited greatly reduced $D_{max}$, compared with the case where dye No. 1 was not contained. Samples which contain dye Nos. 2 and 3 greatly reduce the sensitivity even though they are used in combination with a dye according to the present invention. When dye Nos. 1 or 2 are used singly, yellow sharpness is deteriorated. On the other hand, if dye No. 3 is used, it elevates $D_{min}$ even when it is used in combination with a dye of the present invention.

When dye No. 4 of the present invention is used singly, adverse side effects cannot be avoided, and satisfactory yellow sharpness cannot be obtained.

The dye No. 4 of the present invention can achieve high sharpness and minimized adverse side effects on photographic characteristics (deteriorated sensitivity, high $D_{min}$, or low $D_{max}$) only when it is used in combination with dye Nos. 5, 6, or 7 of the present invention.

Example 2

Samples 201–217 which correspond to the samples 101–117 of Example 1 were made excepting that cellulose triacetate used as a support was replaced with polyethylene terephthalate (thickness: 125 $\mu$m). They were evaluated in a manner similar to that described in Example 1, revealing that the samples have similar effects.

Example 3

Samples 301–317 which correspond to the samples 101–117 of Example 1 were made excepting that the support was replaced with a paper support having polyethylene film laminated on both sides thereof (14 wt. % of titanium dioxide was mixed into the polyethylene film on the side on which an emulsion was applied). The samples 301–317 were evaluated in a manner similar to that described in Example 1, revealing that they have effects similar to those obtained in Example 1.

Example 4

A multilayered color photographic printing paper (401) was manufactured by applying various photographic layers onto a support having an under coat and made of polyethylene terephthalate. The support had a thickness of 200 μm, and had a gelatin layer containing an ultraviolet absorbing agent applied to a side opposite to the emulsion-applied side. Coating solutions which were applied to the support were prepared as follows. Preparation of a coating solution for a first layer:

122.0 g of a yellow coupler ExY, 15.4 g of a first color image stabilizer Cpd-6, 7.5 g of a second color image stabilizer Cpd-13, and 16.7 g of a third color image stabilizer Cpd-14 were dissolved in a mixture of a solvent Solv-7 (44 g) and ethyl acetate (180 cc). The mixture was then emulsified and dispersed in 1000 g of 10% aqueous gelatin solution containing 86 cc of 10% sodium dodecylbenzene sulfonate to obtain an emulsion A. Separately, a silver chlorobromide emulsion A (cubic, mixture of large grain emulsion A having an average grain size of 0.88 μm and small grain emulsion A having an average grain size of 0.70 μm (3:7 in molar ratio of silver)) was prepared. The variation coefficients of distribution of the grain sizes were 0.08 for the large grains and 0.10 for the small grains. In grains of both sizes, 0.3 mol % of silver bromide was locally included into a part of the surface of each grain containing silver chlororide as a matrix. The below described blue color sensitizing dyes A, B and C were added to large grains of the emulsion A in an amount of $1.41\times10^{-4}$ mol/1 mol of silver, and to small grains of emulsion A in an amount of $1.7\times10^{-4}$ mol/1 mol of silver. A sulfur sensitizer and a gold sensitizer were added for chemical ripening. The above-described emulsion A and the silver chlorobromide emulsion A were mixed and dissolved to prepare a coating solution, for a first layer, which had the following composition. An amount of the applied emulsion was indicated by an amount of silver.

Coating solutions for the second to seventh layers were prepared in a similar manner. A sodium salt of 1-oxy-3,5-dichloro-s-triazine was used as a gelatin setting agent in each layer.

Also, Cpd-22, Cpd-23, Cpd-24 and Cpd-25 were added in each layer such that their total amounts become 15.0 mg/m$^2$, 60.0 mg/m$^2$, 5.0 mg/m$^2$ and 10.0 mg/m$^2$, respectively.

For silver chlorobromide emulsion in each light-sensitive emulsion layer, the following spectral sensitizing dyes were used:

Blue sensitive emulsion layer:

Sensitizing Dye A

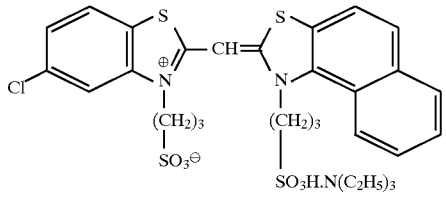

Sensitizing Dye B

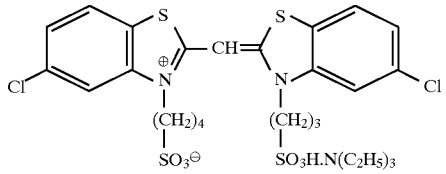

Sensitizing Dye C

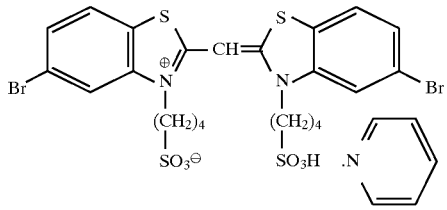

The above compound was added to large grains of emulsion in an amount of $1.41\times10^{-4}$ mol/1 mol of silver halide, and to small grains of emulsion in an amount of $1.7\times10^{-4}$ mol/1 mol of silver halide.

Green sensitive emulsion layer:

Sensitizing Dye D

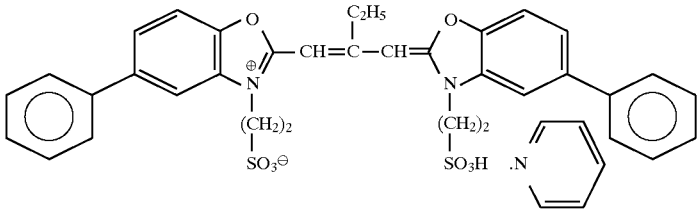

Sensitizing Dye E

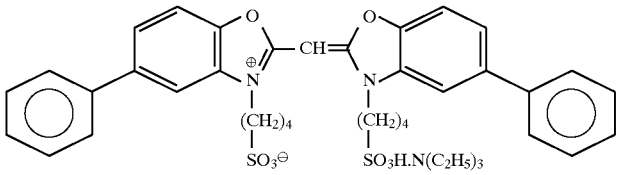

Sensitizing Dye F

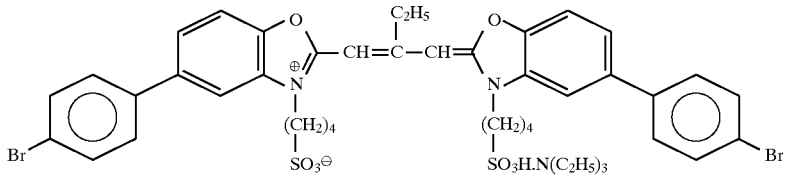

The sensitizing dye D was added to large grains of emulsion in an amount of $3.0\times10^{-4}$ mol/1 mol of silver halide, and to small grains of emulsion in an amount of $3.6\times10^{-4}$ mol/1 mol of silver halide. The sensitizing dye E was added to large grains of emulsion in an amount of $4.0\times10^{-5}$ mol/1 mol of silver halide, and to small grains of emulsion in an amount of $7.0\times10^{-5}$ mol/1 mol of silver halide. The sensitizing dye F was added to large grains of emulsion in an amount of $2.0\times10^{-4}$ mol/1 mol of silver halide, and to small grains of emulsion in an amount of $2.8\times10^{-4}$ mol/1 mol of silver halide.

Red sensitive layer:

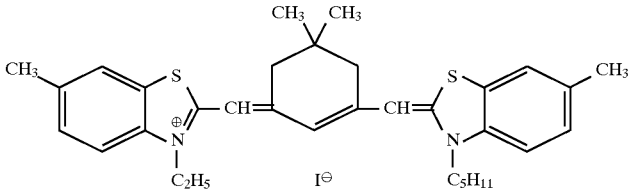

Sensitizing Dye G

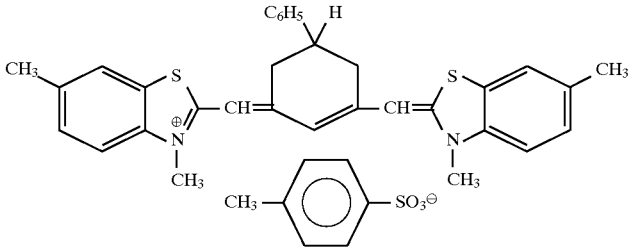

Sensitizing Dye H

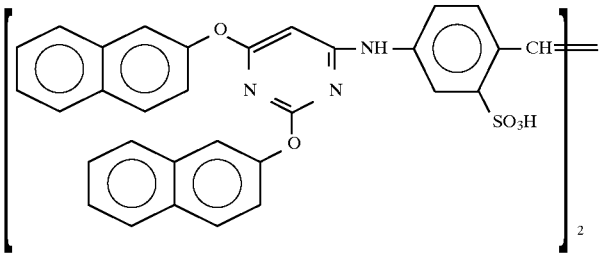

The above compound was added to large grains of emulsion in an amount of $5.0\times10^{-5}$ mol/1 mol of silver halide, and to small grains of emulsion in an amount of $8.0\times10^{-5}$ mol/1 mol of silver halide.

In addition, the following compound was added to the red sensitive emulsion layer in an amount of $2.6\times10^{-3}$/1 mol of silver halide.

Also, 1-(5-methylureidophenyl)-5-mercaptotetrazole was added to the blue sensitive emulsion layer, the green sensitive emulsion layer, and red sensitive emulsion layer, in amounts of $3.5\times10^{-4}$ mol, $3.0\times10^{-3}$ mol, and $2.5\times10^{-4}$ mol, respectively, with respect to 1 mol of silver halide.

Additionally, 4-hydroxy-6-methyl-l,3,3a,7-tetrazaindene was added to the blue sensitive emulsion layer and the green sensitive emulsion layer in amounts of $1\times10^{-4}$ mol and $2\times10^{-4}$ mol, respectively, with respect to 1 mol of silver halide.

The below described dye was further added to the emulsion layer for preventing irradiation.

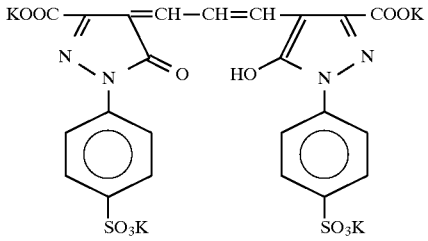

(10mg/m²)

and

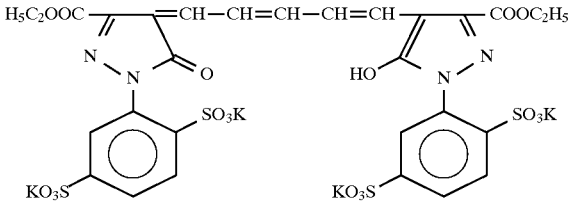

(40mg/m²)

Structure of the layers

The composition of each layer is shown below, wherein the figures indicate the amounts of coat. The amount of silver halide is shown by the amount of silver contained therein.

Support:

Polyethylene-laminated paper (The polyethylene film on the side of the first layer contained a white pigment ($TiO_2$) and a blue dye (ultramarine).

First layer (blue sensitive emulsion layer):

| | |
|---|---|
| The above-described silver chlorobromide A | 0.72 (g/m$^2$) |
| Gelatin | 3.99 |
| Yellow coupler (ExY) | 1.83 |
| Color image stabilizer (Cpd-6) | 0.24 |
| Color image stabilizer (Cpd-13) | 0.12 |
| Color image stabilizer (Cpd-14) | 0.24 |
| Solvent (Solv-7) | 0.66 |

Second layer (color amalgamation inhibiting layer)

| | |
|---|---|
| Gelatin | 1.09 |
| Color amalgamation preventing agent (Cpd-5) | 0.11 |
| Solvent (Solv-7) | 0.07 |
| Solvent (Solv-5) | 0.25 |
| Solvent (Solv-3) | 0.19 |
| Solvent (Solv-9) | 0.09 |

Third layer (green sensitive emulsion layer)

| | |
|---|---|
| Silver chlorobromide (cubic, a mixture of large grain emulsion B having an average grain size of 0.55 $\mu$m and small grain emulsion B having an average grain size of 0.39 $\mu$m (1:3 in molar ratio of silver)). The variation coefficients of distribution of the grain sizes were 0.10 for the large grains and 0.08 for the small grains. In grains of both sizes, 0.8 mol % of silver bromide was locally included into a part of the surface of each grain containing silver chlororide as a matrix.) | 0.33 |
| Gelatin | 3.50 |
| Magenta coupler (ExM) | 0.36 |
| Ultraviolet absorbing agent (UV-1) | 0.38 |
| Color image stabilizer (Cpd-13) | 0.03 |
| Color image stabilizer (Cpd-15) | 0.03 |
| Color image stabilizer (Cpd-16) | 0.03 |
| Color image stabilizer (Cpd-17) | 0.24 |
| Color image stabilizer (Cpd-18) | 0.03 |
| Solvent (Solv-4) | 0.66 |
| Solvent (Solv-8) | 0.45 |

Fourth layer (color amalgamation inhibiting layer):

| | |
|---|---|
| Gelatin | 0.77 |
| Color amalgamation preventing agent (Cpd-5) | 0.08 |
| Solvent (Solv-7) | 0.05 |
| Solvent (Solv-5) | 0.18 |
| Solvent (Solv-3) | 0.14 |
| Solvent (Solv-9) | 0.06 |

Fifth layer (red sensitive emulsion layer):

| | |
|---|---|
| Silver chlorobromide (cubic, a mixture of large grain emulsion C having an average grain size of 0.50 $\mu$m and small grain emulsion C having an average grain size of 0.41 $\mu$m (1:4 in molar ratio of silver)). The variation coefficients of distribution of the grain sizes were 0.09 for the large grains and 0.11 for the small grains. In grains of both sizes, 0.8 mol % of silver bromide was locally included into a part of the surface of each grain containing silver chloride as a matrix.) | 0.54 |
| Gelatin | 2.40 |
| Cyan coupler (ExC) | 0.84 |
| Ultraviolet absorbing agent (UV-3) | 0.57 |
| Color image stabilizer (Cpd-6) | 0.72 |
| Color image stabilizer (Cpd-16) | 0.03 |
| Color image stabilizer (Cpd-18) | 0.03 |
| Color image stabilizer (Cpd-19) | 0.12 |
| Color image stabilizer (Cpd-20) | 0.03 |
| Solvent Solv-7 | 0.03 |
| Solvent Solv-2 | 0.63 |

Sixth layer (Ultraviolet absorbing layer):

| | |
|---|---|
| Gelatin | 0.64 |
| Ultraviolet absorbing agent (UV-2) | 0.39 |
| Color image stabilizer (Cpd-17) | 0.05 |
| Solvent (Solv-10) | 0.05 |

Seventh layer (Protection layer):

| | |
|---|---|
| Gelatin | 1 01 |
| Acrylic modified copolymer of polyvinylalcohol (degree of modification: 17%) | 0.04 |
| Liquid paraffin | 0.02 |
| Surfactant (Cpd-21) | 0.01 |

(ExY) Yellow Coupler

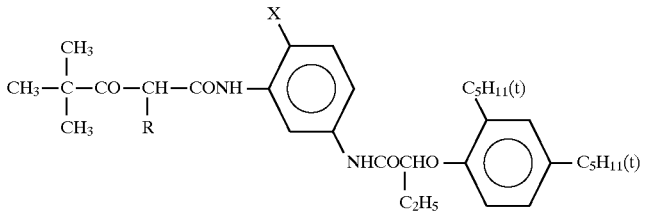

-continued
R = 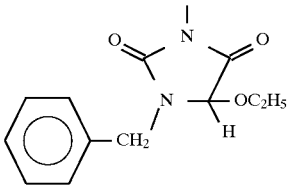
X = Cl
(ExM) Magenta Coupler
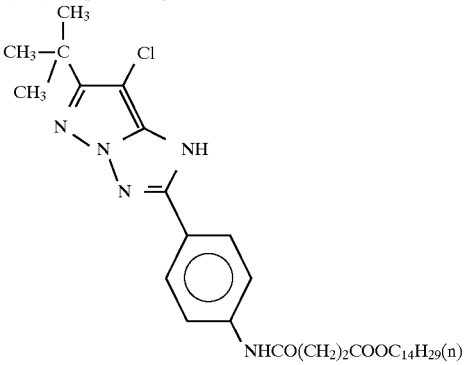
(ExC) Cyan Coupler
Mixture of 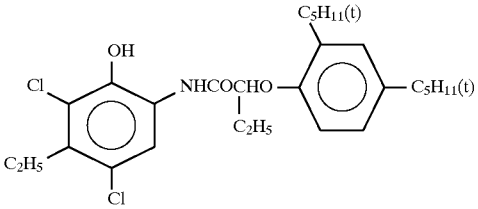
and
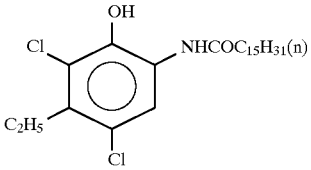
(mole ratio = 25:75)
(Cpd-5) Color Amalgamation preventing Agent
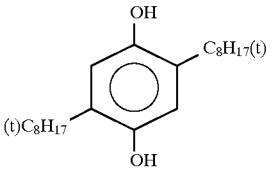
(Cpd-6) Image Stabilizer
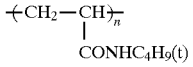
average molecular weight: about 60,000
(Cpd-13) Image Stabilizer
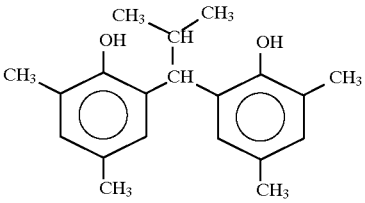
(Cpd-14)

-continued
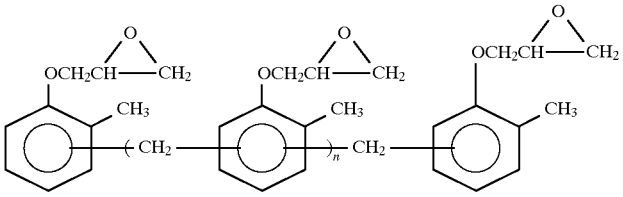
n = 7~8 (Average)
(Cpd-15) Image Stabilizer
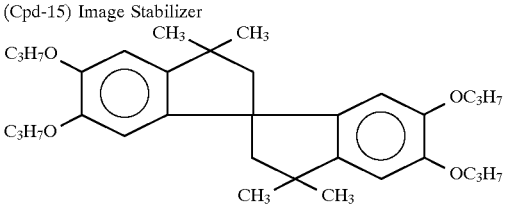
(Cpd-16)
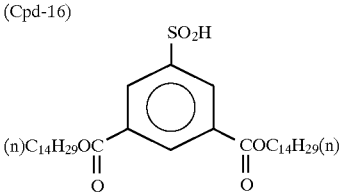
(Cpd-17) Image Stabilizer
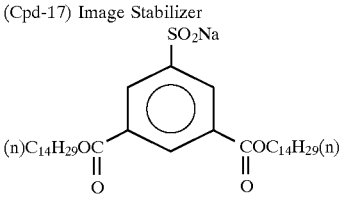
(Cpd-18) Image Stabilizer
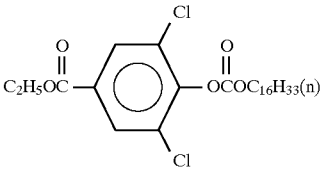
(Cpd-19) Image Stabilizer
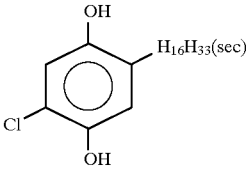
(Cpd-20) Image Stabilizer
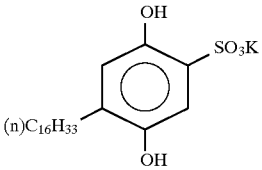
(Cpd-21) Surfactant
(i)
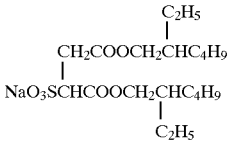
(ii)
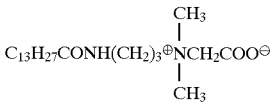
Mixture of (i) and (ii) (weight ratio = 7:3)

-continued
(Cpd-22) Preservative
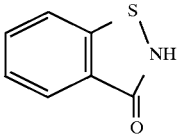
(Cpd-23) Preservative
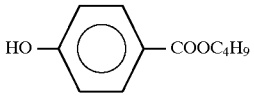
(Cpd-24) Preservative
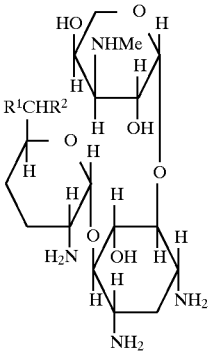
| | $R^1$ | $R^2$ |
|---|---|---|
| a | —Me | —NHMe |
| b | —Me | —$NH_2$ |
| c | —H | —$NH_2$ |
| d | —H | —NHMe |
Mixture of a, b, c and d (weight ratio = 1:1:1:1)
(Cpd-25) Preservative
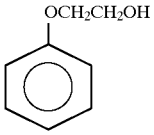
(UV-1) UV-absorber
(1)
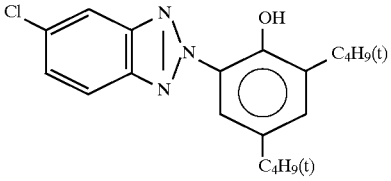
(2)
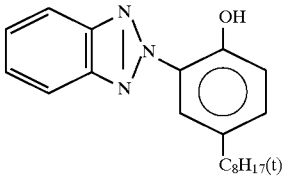
(3)
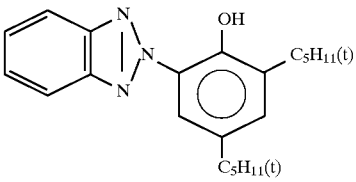
Mixture of (1), (2) and (3) (weight ratio = 1:3:4)
(UV-2) UV-absorber
(1)
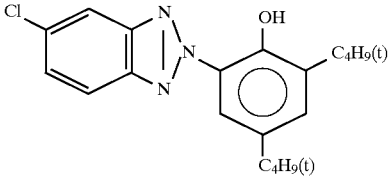
(2)
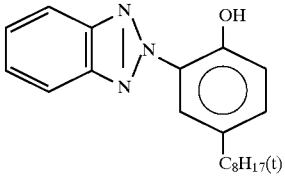

-continued
(3)
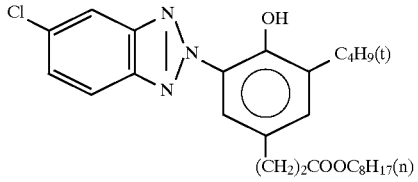
(4)
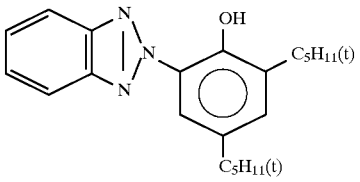
(5)
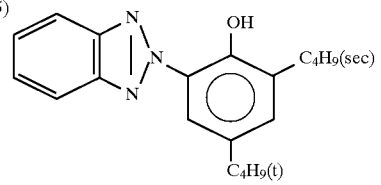
Mixture of (1), (2), (3), (4) and (5) (weight ratio = 1:2:2:3:1)
(UV-3) UV-absorber
(1)
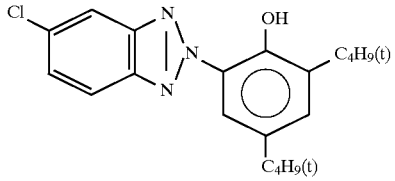
(2)
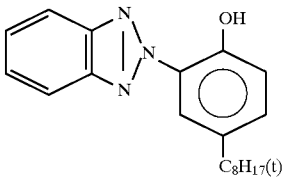
(3)
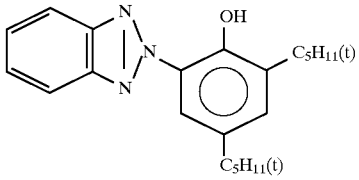
(4)
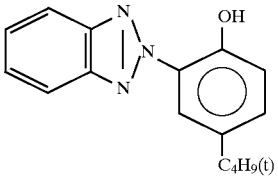
Mixture of (1), (2), (3) and (4) (weight ratio = 1:3:2:
(Solv-2) Solvent
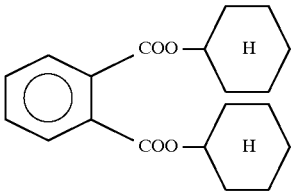
(Solv-3) Solvent
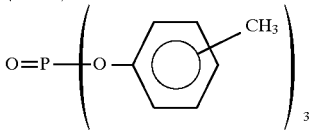
(Solv-4) Solvent
$O{=}P{-}(O{-}C_6H_{13}(n))_3$
(Solv-5) Solvent
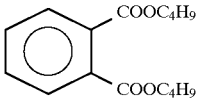
(Solv-7) Solvent
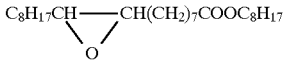
(Solv-8) Solvent -continued

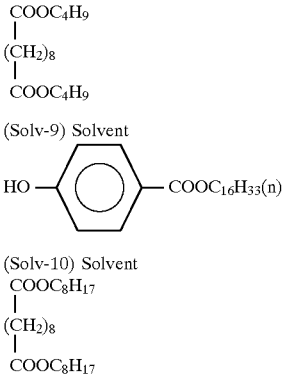

Next, samples 402–417 were manufactured which were the same as the sample 401, excepting that a layer comprising a compound dispersed in a solid fine particle from was formed between the support and the first layer.

The above-described light-sensitive materials were exposed through an optical wedge, and a B, G or R filter, and were processed by the following steps.

| Process step | Temperature | Time |
|---|---|---|
| Color development | 35° C. | 180 sec. |
| Bleaching/fixing | 35° C. | 180 sec. |
| Rinsing (1) | 35° C. | 120 sec. |
| Rinsing (2) | 35° C. | 120 sec. |
| Rinsing (3) | 35° C. | 120 sec. |
| Drying | 80° C. | 240 sec. |

(Rinsing was performed by 3-tank counterflow from (3) to (1))

The compositions of the processing solutions were as follows:

[Color developing solution]

| | |
|---|---|
| Water | 800 ml |
| Ethylene diaminetetraacetic acid | 3.0 g |
| 4,5-Dihydroxybenzene-1,3-disulfonic acid.2 Na | 0.5 g |
| Triethanolamine | 12.0 g |
| Potassium chloride | 2.5 g |
| Potassium bromide | 0.01 g |
| Potassium carbonate | 27.0 g |
| Fluorescent whitening agent (WHITEX 4, product of Sumitomo Kagaku Co.) | 1.0 g |
| Sodium sulfite | 0.1 g |
| Disodium-N,N-bis(sulfonate ethyl) hydroxylamine | 5.0 g |
| N-ethyl-N-(B-methanesulfonamide ethyl)-3-methyl-4-aminoaniline. ½sulfuric acid.1$H_2O$ | 5.0 g |
| Total amount after adding water | 1000 ml |
| pH (at 25° C., adjusted with potassium hydroxide and sulfuric acid) | 10.05 |

[Bleaching/fixing solution]

| | |
|---|---|
| Water | 600 ml |
| Ammonium thiosulfate (750 g/liter) | 93 ml |
| Ammonium sulfite | 40 g |
| Iron (III) ethylenediamine tetraacetate ammonium | 55 g |

-continued

| | |
|---|---|
| Ethylene diamine tetraacetic acid | 5 g |
| Nitric acid (67%) | 30 g |
| Total amount after adding water | 1000 ml |
| pH (at 25° C., adjusted with potassium hydroxide and sulfuric acid | 5.8 |

[Rinsing solution]

| | |
|---|---|
| Chlorinated sodium isocyanurate | 0.02 g |
| Deionized water (conductivity: not greater than 5 us/cm) | 1000 ml |
| pH | 6.5 |

The processed samples 401–407 were evaluated in a similar manner as in Example 1, and it was confirmed that the samples 401–407 have similar advantageous effects as the samples evaluated in Example 1.

The silver halide color photographic light-sensitive materials according to the present invention have the structure as described above. They are therefore advantageous in that the dyes do not transfer to other layers during storage. Also, the materials have excellent light absorbing property. Furthermore, and the dyes are discolored rapidly during a developing process.

Example 5

Each of the compositions described below were applied, in a laminary state, on a cellulose triacetate film support which had an undercoat thereon (thickness of support: 140 μm, a resin layer containing fine carbon particles is provided on the surface opposite the emulsion surface so as to have a transmission density of 1.0) to prepare a multilayer color photographic sensitive material (Sample No. 500).

Structure of layers:

The composition of each of the layers is shown below. The figures indicate the amounts of coating (g/$m^2$). The figures given for silver halide emulsions indicate the coating amount converted into the amounts of silver halide.

First layer (blue-sensitive emulsion layer):

| | |
|---|---|
| Silver chlorobromide emulsion [a 1:3 mixture (based on mols of silver) of (B1) gold sulfate sensitizing emulsion containing particles (cubic) having an average grain size of 0.7 μm and (B2) gold sulfate sensitizing emulsion containing particles (cubic) having an average grain size of 0.4 μm, average halogen composition: Br/Cl = 1 mol %: 99 mol%]: | 0.50 |

-continued

| | |
|---|---|
| Gelatin | 1.66 |
| Yellow coupler (ExY) | 1.10 |
| Solvent (Solv-1) | 0.13 |
| Solvent (Solv-2) | 0.13 |
| (Cpd-1A: illustrated afterwards) | 0.0016 |
| (Cpd-2) | 0.0006 |
| (Cpd-3) | 0.006 |
| (Cpd-4) | 0.03 |

Second layer (color amalgamation preventing layer):

| | |
|---|---|
| Gelatin | 0.40 |
| (Cpd-5) | 0.03 |
| Solvent (Solv-3) | 0.03 |
| Solvent (Solv-4) | 0.03 |

Third layer (red sensitive emulsion layer):

| | |
|---|---|
| Silver chlorobromide emulsion [a 1:3 mixture (based on mols of silver) of (R1) gold sulfate sensitizing emulsion containing particles (cubic) having an average grain size of 0.25 μm and (R2) gold sulfate sensitizing emulsion containing particles (cubic) having an average grain size of 0.1 μm, average halogen composition: Br/Cl = 25 mol %: 75 mol %]: | 0.44 |
| Gelatin | 2.12 |
| Cyan coupler (ExC) | 0.97 |
| (Cpd-6) | 0.18 |
| (Cpd-5) | 0.015 |
| Solvent (Solv-5) | 0.50 |
| Solvent (Solv-6) | 0.32 |
| (Cpd-7) | 0.0002 |
| (Cpd-8) | 0.003 |
| (Cpd-2) | 0.003 |

Fourth layer (color amalgamation preventing layer):

| | |
|---|---|
| Gelatin | 0.40 |
| (Cpd-5) | 0.03 |
| Solvent (Solv-3) | 0.03 |
| Solvent (Solv-4) | 0.03 |

Fifth layer (green sensitive emulsion layer):

| | |
|---|---|
| Silver chlorobromide emulsion [a 1:3 mixture (based on mols of silver) of (G1) gold sulfate sensitizing emulsion containing particles (cubic) having an average grain size of 0.25 μm and (G2) gold sulfate sensitizing emulsion containing particles (cubic) having an average grain size of 0.1 μm, average halogen composition: Br/Cl = 25 mol %: 75 mol %]: | 0.52 |
| Gelatin | 1.29 |
| Magenta coupler (ExM) | 0.61 |
| (Cpd-9) | 0.001 |
| (Cpd-5) | 0.012 |
| Solvent (Solv-3) | 0.15 |
| (Cpd-10) | 0.003 |
| (Cpd-11) | 0.002 |
| (Cpd-12) | 0.003 |

Sixth layer (protective layer):

| | |
|---|---|
| Gelatin | 0.98 |
| Acrylic modified copolymer of polyvinyl alcohol (degree of modification: 17%) | 0.05 |
| Liquid paraffin | 0.02 |

Mixture of (Cpd-1A)

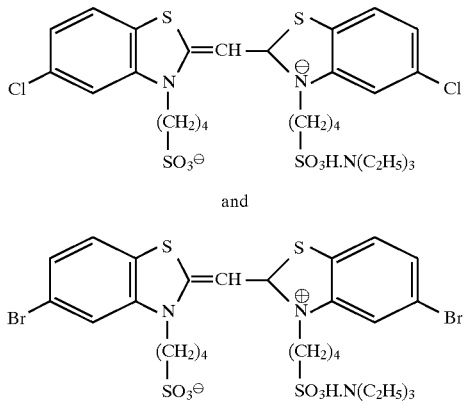

(weight ratio = 1:1)

As a gelatin setting agent to be incorporated in each layer, a sodium salt of 1-oxy-3,5-dichloro-s-triazine was used.

Moreover, in order to prevent irradiation, a dye represented by the following formula was used in the emulsion layers (the figure in parentheses indicates the amount of coating).

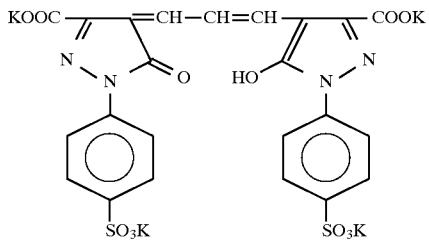

(0.043g/m²)

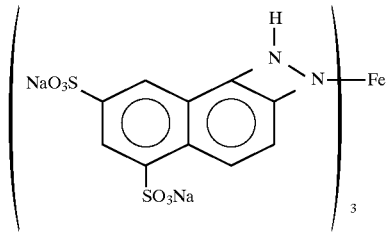

(0.098g/m²)

Preparation of solid dispersion of a dye:

72.64 cc of water was added to 8.35 g of the dye and 2.51 g of the dispersing additive shown in Table A to prepare a solution, to which glass beads in which alkali was removed(1 mm in diameter, 218 g) were added. The resulting material was dispersed using a "Sandgrinder Mill, model TSG" (product of Aimex K.K.) for the period indicated in Table A.

Subsequently, the contents of the mill were taken out to filter off the beads and to collect a dispersion. The average grain size of particles in the dispersion was determined with a mastersizer made by Maruburn.

TABLE A

| solid dispersed compounds | Dye No. | Dispersing additive | Time for dispersing [hr] | Average particle size [μm] |
|---|---|---|---|---|
| A | 1 | A | 4.5 | 0.40 |
| B | 2 | B | 4.5 | 0.45 |
| C | 3 | B | 4.5 | 0.41 |
| D | 4 | B | 4.5 | 0.48 |
| E | 5 | B | 6 | 0.45 |
| F | 6 | B | 6 | 0.42 |
| G | 7 | B | 6 | 0.40 |
| H | 8 | B | 6 | 0.40 |
| I | 9 | B | 6 | 0.40 |

A: Carboxymethylcellulose, Na salt (Trademark: Cerogen 6A, by Daiichi Kogyo Seiyaku K.K.)
B: A polycondensation product of naphthalene sulfonic acid Dyes 1–7 a re already shown.

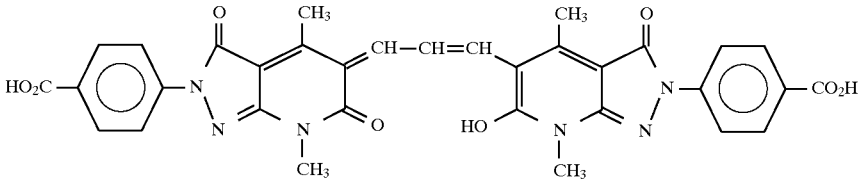

Dye 9

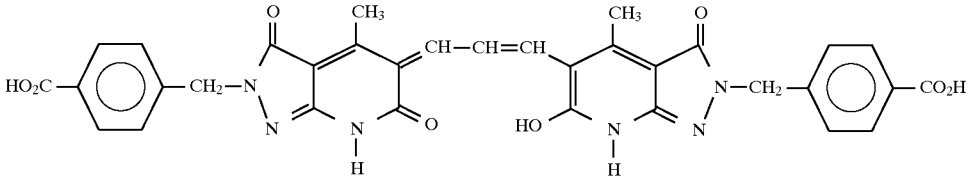

Dye 8

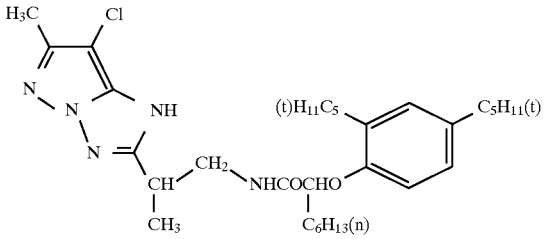

Magenta Coupler 1 (Control)

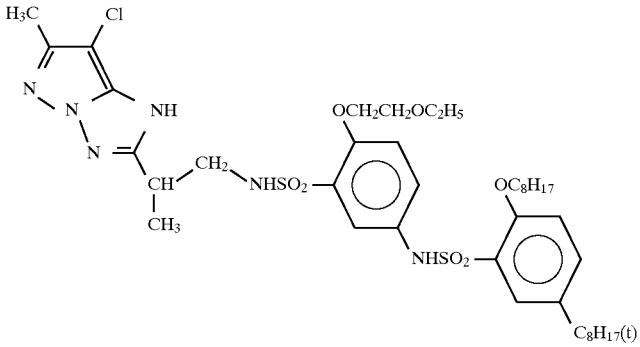

Magenta Coupler 2 (Control)

Next, the resin layer of Sample 500, the layer provided on the back surface of the support was removed, and in its place, a hydrophilic colloidal layer containing a conductive polymer shown below and fine particles of tin oxide was provided. In addition, a layer containing a compound having the following composition in a form of dispersed solid fine particles was newly provided between the surface of the support and the first layer to prepare Samples 501 to 530, which contain different kinds of magenta couplers and different amounts of water-soluble bromides in their green sensitive emulsion layers.

The magenta couplers were replaced in an amount of equivalent mol.

Evaluation of sharpness:

Exposure was effected through an optical wedge for measuring sharpness and a B, G or R filter, in an amount of light such that a density difference of 1.5 was obtained when 5exposed parts and unexposed parts were sufficiently separated from each other. The samples were then processed according to the process, ECP-2, proposed by Eastman Kodak. The spatial frequency (lines/mm) of the exposed parts and unexposed parts was increased. As a result, when the density difference decreased to 1.2, a spatial frequency (lines/mm) was measured. The sharpness was evaluated based on the spatial frequency thus measured. Greater values of spatial frequency indicate higher sharpness.

Evaluation of humidity dependency of exposure:

The samples were stored for three months at 30° C. and a humidity of 55%. Subsequently, each sample was subjected to gradation exposure (at 60,000 lux for 1/100 second) for sensitometry, through a G filter, using a sensitometer (made by Fuji Photo Film Co, Ltd., model FWH) at 25° C. and a humidity of 35%, and at 25° C. and a humidity of 85%. Each sample was thereafter processed according to the process, ECP-2, proposed by Eastman Kodak.

The transmission density of processed samples was measured through a G filter. Sensitivity was defined as the logarithm of an inverse number of the exposure level which gives a concentration of 1.0 higher than the minimum density. The humidity dependency of exposure was evaluated based on the difference between the sensitivity obtained when exposure was effected at 25° C. and a humidity of 35%, and the sensitivity obtained when an exposure was effected at 25° C. and a humidity of 85%. The lower the difference is, the smaller the humidity dependency of each sample after storage for a prolonged period is, thereby providing higher performance. Results are shown in Tables B, C and D.

Results obtained by testing the Sample 500, which has a resinous backing layer, are also shown as an index in terms of sharpness. The sample having a resinous backing layer has a drawback that an additional processing step is needed to remove carbon particles in a photographic process after exposure. The purpose of the present invention is to obtain a sharpness comparable to or higher than that of a light-sensitive material having a resinous backing layer.

TABLE B

| Sample No. | Resin (Presence/ absence of layer) | Kinds and amounts of solid dispersed compound (note 1) | Amount of gel coating of layer containing solid - dispersed compound | Kinds of magenta coupler | Kinds and amount of water soluble bromide | Sharpness Y | Sharpness M | Sharpness C | Humidity dependency of exposure | Remarks |
|---|---|---|---|---|---|---|---|---|---|---|
| 500 | Presence | None | — | ExM | KBr 0.01 mol/ mol of Ag | 20 | 30 | 25 | — | Comparative example |
| 501 | Absence | A | 1.3 g/m$^2$ | " | KBr 0.01 mol/ mol of Ag | 10 | 20 | 20 | −0.02 | Comparative example |
| 502 | " | B | " | " | KBr 0.01 mol/ mol of Ag | 10 | 20 | 20 | −0.02 | Comparative example |
| 503 | " | C | " | " | KBr 0.01 mol/ mol of Ag | 15 | 20 | 20 | −0.02 | Comparative example |
| 504 | " | D | " | " | KBr 0.01 mol/ mol of Ag | 10 | 20 | 20 | −0.02 | Comparative example |
| 505 | " | A + E | " | " | KBr 0.01 mol/ mol of Ag | 20 | 30 | 25 | −0.10 | Comparative example |
| 506 | " | B + E | " | " | KBr 0.01 mol/ mol of Ag | 20 | 25 | 30 | −0.10 | Comparative example |
| 507 | " | D + E | " | " | KBr 0.01 mol/ mol of Ag | 25 | 30 | 30 | −0.10 | Comparative example |
| 508 | " | " | " | " | KBr 0.01 mol/ mol of Ag | 25 | 30 | 30 | −0.15 | Comparative example |
| 509 | " | A | " | M-1 | KBr 0.01 mol/ mol of Ag | 10 | 20 | 20 | −0.02 | Comparative example |
| 510 | " | B | " | " | KBr 0.01 mol/ mol of Ag | 10 | 20 | 20 | −0.02 | Comparative example |

Note)
A: Dye 1 (150 mg/m$^2$)
B: Dye 2 (150 mg/m$^2$)
C: Dye 3 (150 mg/m$^2$)
D: Dye 4 (150 mg/m$^2$)
E: Dye 5 (30 mg/m$^2$)
F: Dye 6 (30 mg/m$^2$)
G: Dye 7 (30 mg/m$^2$)
H: Dye 8 (150 mg/m$^2$)
I: Dye 9 (150 mg/m$^2$)
(Values in parentheses indicate the amounts of dies applied.)

TABLE C

| Sample No. | Resin (Presence/ absence of layer) | Kinds and amounts of solid dispersed compound (note 1) | Amount of gel coating of layer containing solid - dispersed compound | Kinds of magenta coupler | Kinds and amount of water soluble bromide | Sharpness Y | Sharpness M | Sharpness C | Humidity dependency of exposure | Remarks |
|---|---|---|---|---|---|---|---|---|---|---|
| 511 | Absence | C | 1.3 g/m$^2$ | M-1 | KBr 0.01 mol/ mol of Ag | 15 | 20 | 20 | −0.02 | Comparative example |
| 512 | " | D | " | " | KBr 0.01 mol/ mol of Ag | 10 | 20 | 20 | −0.02 | Comparative example |
| 513 | " | A + E | " | " | KBr 0.01 mol/ mol of Ag | 20 | 30 | 25 | −0.10 | Comparative example |
| 514 | " | B + E | " | " | KBr 0.01 mol/ mol of Ag | 20 | 25 | 30 | −0.10 | Comparative example |
| 515 | " | C + E | " | " | KBr 0.01 mol/ mol of Ag | 20 | 25 | 20 | −0.10 | Comparative example |
| 516 | " | D + E | " | " | KBr 0.01 mol/ mol of Ag | 20 | 30 | 30 | −0.10 | Example of invention |
| 517 | " | H + E | " | " | KBr 0.01 mol/ mol of Ag | 20 | 30 | 30 | −0.02 | Example of invention |
| 518 | " | I + E | " | " | KBr 0.01 mol/ mol of Ag | 20 | 30 | 30 | −0.02 | Example of invention |
| 519 | " | A + F | " | " | KBr 0.01 mol/ mol of Ag | 15 | 20 | 20 | −0.10 | Comparative example |
| 520 | " | B + F | " | " | KBr 0.01 mol/ mol of Ag | 15 | 20 | 20 | −0.10 | Comparative example |
| 521 | " | C + F | " | " | KBr 0.01 mol/ mol of Ag | 15 | 20 | 20 | −0.10 | Comparative example |

Note)
A: Dye 1 (150 mg/m$^2$)
B: Dye 2 (150 mg/m$^2$)
C: Dye 3 (150 mg/m$^2$)
D: Dye 4 (150 mg/m$^2$)
E: Dye 5 (30 mg/m$^2$)
F: Dye 6 (30 mg/m$^2$)
G: Dye 7 (30 mg/m$^2$)
H: Dye 8 (150 mg/m$^2$)
I: Dye 9 (150 mg/m$^2$)
(Values in parentheses indicate the amounts of dies applied.)

TABLE D

| Sample No. | Resin (Presence/ absence of layer) | Kinds and amounts of solid dispersed compound (note 1) | Amount of gel coating of layer containing solid - dispersed compound | Kinds of magenta coupler | Kinds and amount of water soluble bromide | Sharpness Y | Sharpness M | Sharpness C | Humidity dependency of exposure | Remarks |
|---|---|---|---|---|---|---|---|---|---|---|
| 522 | Absence | D + F | 1.3 g/m$^2$ | M-1 | KBr 0.01 mol/ mol of Ag | 25 | 30 | 30 | −0.02 | Example of invention |
| 523 | " | H + F | " | " | Kbr 0.01 mol/ mol of Ag | 20 | 30 | 30 | −0.02 | Example of invention |
| 524 | " | D + E | " | " | — | 25 | 30 | 30 | −0.10 | Comparative example |
| 525 | " | " | " | " | KBr 0.005 mol/ mol of Ag | 25 | 30 | 30 | −0.03 | Example of invention |

TABLE D-continued

| Sample No. | Resin (Presence/ absence of layer) | Kinds and amounts of solid dispersed compound (note 1) | Amount of gel coating of layer containing solid - dispersed compound | Kinds of magenta coupler | Kinds and amount of water soluble bromide | Sharpness Y | Sharpness M | Sharpness C | Humidity dependency of exposure | Remarks |
|---|---|---|---|---|---|---|---|---|---|---|
| 526 | " | " | " | " | KBr 0.005 mol/ mol of Ag | 25 | 30 | 30 | −0.02 | Example of invention |
| 527 | " | " | " | M-2 | KBr 0.01 mol/ mol of Ag | 25 | 30 | 30 | −0.02 | Example of invention |
| 528 | " | " | " | M-4 | KBr 0.01 mol/ mol of Ag | 25 | 30 | 30 | −0.02 | Example of invention |
| 529 | " | " | " | Magenta coupler-1 | KBr 0.01 mol/ mol of Ag | 25 | 30 | 30 | −0.09 | Comparative example |
| 530 | " | " | " | Magenta coupler-2 | KBr 0.01 mol/ mol of Ag | 25 | 30 | 30 | −0.09 | Comparative example |
| 531 | " | D + G | " | M-1 | KBr 0.01 mol/ mol of Ag | 25 | 30 | 30 | −0.02 | Example of invention |

Note)
A: Dye 1 (150 mg/m$^2$)
B: Dye 2 (150 mg/m$^2$)
C: Dye 3 (150 mg/m$^2$)
D: Dye 4 (150 mg/m$^2$)
E: Dye 5 (30 mg/m$^2$)
F: Dye 6 (30 mg/m$^2$)
G: Dye 7 (30 mg/m$^2$)
H: Dye 8 (150 mg/m$^2$)
I: Dye 9 (150 mg/m$^2$)
(Values in parentheses indicate the amounts of dies applied.)

The results shown in Tables B, C and D demonstrate the following.

Use of the mixture according to the present invention which includes fine die particles in a dispersed state improves the sharpness to the same degree as in the sample in which a resinous backing layer is formed. Also, the sample prepared by using a magenta coupler containing 5-pyrazolone such as ExM has a larger humidity dependency of exposure compared to the sample in which a magenta coupler containing pyrazolotriazole according to the present invention (comparison between Sample 508 and Sample 524) is used. In samples prepared by using a magenta coupler containing pyrazolotriazole and a mixture which includes fine die particles in a dispersed state, both of which are according to the invention, the humidity dependency of exposure is greatly improved by adding KBr. By contrast, in the samples prepared by using a magenta coupler containing 5-pyrazolone, the addition of KBr exhibits only a small effect (comparison between Samples 516–518, 522, 523, 525–528 and 531 and Samples 505–507 and 513–515). The samples according to the present invention were rapidly discolored during a developing process, and no color remained.

In Samples 501–504, 509–512 and 519–521, in which a solid die was singly used in a dispersed form, or in which combination was utilized which involves a solid die other than the solid dies according to the present invention, sufficient sharpness cannot be obtained. Even in the sample where a magenta coupler containing pyrazolotriazole is used, the addition of KBr does not greatly improve the humidity dependency of exposure if magenta couplers such as magenta coupler 1 and magenta coupler 2, other than the magenta couplers according to the present invention are used.

Example 6

In place of the first through sixth layers of Sample 500 in Example 5, the following first through seventh layers were applied onto a support to make a Sample 600. Moreover, magenta couplers and amounts of soluble bromides were changed in the same manners as Samples 501–531 in Example 1 to make Samples 601–631 corresponding thereto.

These samples were evaluated in a manner similar to that described in Example 5 in terms of sharpness and humidity dependency of exposure (decrease in sensitivity when a light-sensitive material is exposed under a high humidity after storage for a prolonged period). The evaluation revealed that the samples exhibited the effects of the present invention similar to that obtained in Example 5.

Preparation of a coating solution for a first layer:

122.0 g of a yellow coupler ExY, 15.4 g of a first color image stabilizer Cpd-6, 7.5 g of a second color image stabilizer Cpd-13, and 16.7 g of a third color image stabilizer Cpd-14 were dissolved in a mixture of a solvent Solv-7 (44 g) and ethyl acetate (180 cc). The solution was then emulsified and dispersed in 1000 g of 10% aqueous gelatin solution containing 86 cc of 10% sodium dodecylbenzene sulfonate to obtain an emulsified dispersion A. Separately, a silver chlorobromide emulsion A (cubic, mixture of large grain-emulsion A having an average grain size of 0.88 $\mu$m and small-grain emulsion A having an average grain size of 0.70 $\mu$m (3:7 in molar ratio of silver)) was prepared. The variation coefficients of distribution of the grain sizes were 0.08 for the large grains and 0.10 for the small grains. In grains of both sizes, 0.3 mol % of silver bromide was locally included into a part of the surface of each grain containing, as a matrix, silver chloride. The blue color sensitizing dyes A, B and C were added to large grain-emulsion A in an amount of $1.4\times10^{-4}$ mol/1 mol of silver, and to small grain-emulsion A in an amount of $1.7\times10^{-4}$ mol/1 mol of silver. A sulfur sensitizer and a gold sensitizer were added for chemical ripening. The above-described emulsified dispersion A and the silver chlorobromide emulsion A were mixed and dissolved to prepare a coating solution, for a first layer, which had the following composition. An amount of the applied emulsion was indicated by conversion to an amount of silver.

Coating solutions for the second to seventh layers were prepared in a similar manner. A sodium salt of 1-oxy-3,5-dichloro-s-triazine was used as a gelatin setting agent in each layer.

Also, Cpd-22, Cpd-23, Cpd-24 and Cpd-25 were added in each layer such that their total amounts become 15.0 mg/m$^2$, 60.0 mg/m$^2$, 5.0 mg/m$^2$ and 10.0 mg/m$^2$, respectively.

For silver chlorobromide emulsion in each light-sensitive emulsion layer, the following spectral sensitizing dyes were used:

Blue sensitive emulsion layer:

The above-described sensitizing dyes A, B and C were used.

The above compound was added to large grain-emulsion in an amount of $1.4\times10^{-4}$ mol/1 mol of silver halide, and to small grain-emulsion in an amount of $1.7\times10^{-4}$ mol/1 mol of silver halide.

Green sensitive emulsion layer:

The above-described sensitizing dyes D, E and F were used.

The sensitizing dye D was added to large grain-emulsion in an amount of $3.0\times10^{-4}$ mol/1 mol of silver halide, and to small grain-emulsion in an amount of $3.6\times10^{-4}$ mol/1 mol of silver halide. The sensitizing dye E was added to large grain-emulsion in an amount of $4.0\times10^{-5}$ mol/1 mol of silver halide, and to small grain-emulsion in an amount of $7.0\times10^{-5}$ mol/1 mol of silver halide. The sensitizing dye F was added to large grains of emulsion in an amount of $2.0\times10^{-4}$ mol/1 mol of silver halide, and to small grain-emulsion in an amount of $2.8\times10^{-4}$ mol/1 mol of silver halide.

Red sensitive layer:

The above-described sensitizing dyes G and H were used.

The above compound was added to large grain-emulsion in an amount of $5.0\times10^{-5}$ mol/1 mol of silver halide, and to small grain-emulsion in an amount of $8.0\times10^{-5}$ mol/1 mol of silver halide.

In addition, the following compound was added to the red sensitive emulsion layer in an amount of $2.6\times10^{-3}$/1 mol of silver halide.

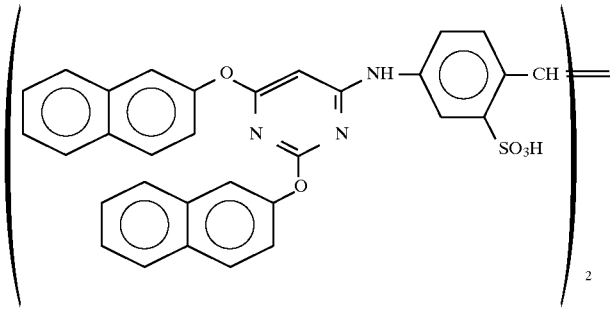

Also, 1-(5-methylureidophenyl)-5-mercaptotetrazole was added to the blue sensitive emulsion layer, the green sensitive emulsion layer, and red sensitive emulsion layer, in amounts of $3.5\times10^{-4}$ mol, $3.0\times10^{-3}$ mol, and $2.5\times10^{-4}$ mol, respectively, with respect to 1 mol of silver halide.

Additionally, 4-hydroxy-6-methyl-1,3,3a,7-tetrazaindene was added to the blue sensitive emulsion layer and the green sensitive emulsion layer in amounts of $1\times10^{-4}$ mol and $2\times10^{-4}$ mol, respectively, with respect to 1 mol of silver halide.

Structure of the layers:

The composition of each layer is shown below, wherein the figures indicate the amounts of coating. The amount of silver halide is shown by conversion to the amount of silver contained therein.

First layer (blue sensitive emulsion layer):

| | |
|---|---|
| The above-described silver chlorobromide A | 0.48 |
| Gelatin | 2.66 |
| Yellow coupler (ExY) | 1.22 |
| Color image stabilizer (Cpd-6) | 0.16 |
| Color image stabilizer (Cpd-13) | 0.08 |
| Color image stabilizer (Cpd-14) | 0.16 |
| Solvent (Solv-7) | 0.44 |

Second layer (color amalgamation preventing layer)

| | |
|---|---|
| Gelatin | 1.09 |
| Color amalgamation preventing agent (Cpd-4") | 0.11 |
| Solvent (Solv-7) | 0.07 |
| Solvent (Solv-5) | 0.25 |
| Solvent (Solv-3) | 0.19 |
| Solvent (Solv-9) | 0.09 |

Third layer (green sensitive emulsion layer)

| | |
|---|---|
| Silver chlorobromide [cubic; a mixture of large grain emulsion B having an average grain size of 0.55 μm and small grain emulsion B having an average grain size of 0.39 μm (1:3 in molar ratio of silver)]. The variation coefficients of distribution of the grain sizes were 0.10 for the large grains and 0.08 for the small grains. In grains of both sizes, 0.8 mol % of silver bromide was locally included into a part of the surface of each grain containing, as a matrix, silver chloride.) | 0.20 |
| Gelatin | 2.38 |
| Magenta coupler (ExM": illustrated afterwards) | 0.24 |
| Ultraviolet absorbing agent (UV-1) | 0.24 |

-continued

| | |
|---|---|
| Color image stabilizer (Cpd-13) | 0.02 |
| Color image stabilizer (Cpd-15) | 0.02 |
| Color image stabilizer (Cpd-16) | 0.02 |
| Color image stabilizer (Cpd-7": illustrated afterwards) | 0.16 |
| Color image stabilizer (Cpd-18) | 0.02 |
| Solvent (Solv-4) | 0.60 |
| Solvent (Solv-8) | 0.30 |

Fourth layer (color amalgamation preventing layer):

| | |
|---|---|
| Gelatin | 0.77 |
| Color amalgamation preventing agent (Cpd-4") | 0.08 |
| Solvent (Solv-7) | 0.05 |
| Solvent (Solv-5) | 0.18 |
| Solvent (Solv-3) | 0.14 |
| Solvent (Solv-9) | 0.06 |

Fifth layer (red sensitive emulsion layer):

| | |
|---|---|
| Silver chlorobromide [cubic, a mixture of large grain emulsion C having an average grain size of 0.50 μm and small grain emulsion C having an average grain size of 0.41 μm (1:4 in molar ratio of silver)]. The variation coefficients of distribution of the grain sizes were 0.09 for the large grains and 0.11 for the small grains. In grains of both sizes, 0.8 mol % of silver bromide was locally included into a part of the surface of each grain containing, as a matrix, silver chloride.) | 0.44 |
| Gelatin | 1.96 |
| Cyan coupler (ExC) | 0.68 |
| Ultraviolet absorbing agent (UV-3) | 0.46 |
| Color image stabilizer (Cpd-6) | 0.59 |
| Color image stabilizer (Cpd-16) | 0.02 |
| Color image stabilizer (Cpd-18) | 0.02 |
| Color image stabilizer (Cpd-19) | 0.10 |
| Color image stabilizer (Cpd-20) | 0.02 |
| Solvent Solv-7 | 0.02 |
| Solvent Solv-2 | 0.51 |

Sixth layer (Ultraviolet absorbing layer):

| | |
|---|---|
| Gelatin | 0.64 |
| Ultraviolet absorbing agent (UV-2) | 0.39 |
| Color image stabilizer (Cpd-7") | 0.05 |
| Solvent (Solv-10) | 0.05 |

Seventh layer (Protection layer):.

| | |
|---|---|
| Gelatin | 1.01 |
| Acrylic modified copolymer of polyvinyl alcohol (degree of modification: 17%) | 0.04 |
| Liquid paraffin | 0.02 |
| Surfactant (Cpd-21) | 0.01 |

ExM"

-continued

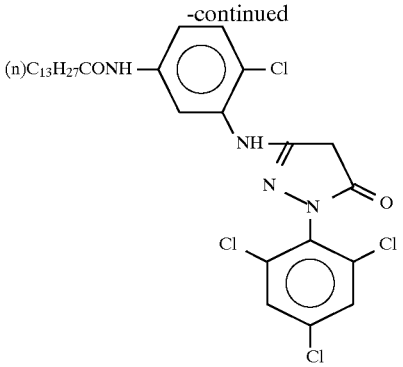

(Cpd-4") Amalgamation Preventing Agent
Mixture of

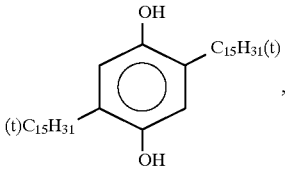

,

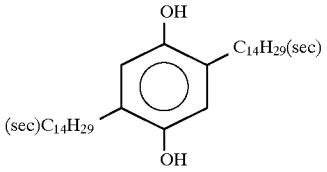

and

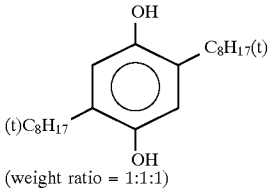

(weight ratio = 1:1:1)

(Cpd-7") Image Stabilizer

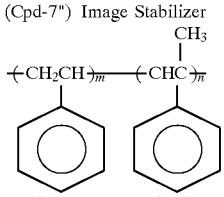

number average molecular weight 600
m/n = 10/90

Example 7

The magenta coupler of Sample 216 in Example 6 was replaced with compounds shown in Table E in an amount of equivalent mols to make Samples 701–704. These Samples were evaluated in the same manner as in Example 5 to obtain results shown in Table E.

As is apparent from the results, the effects of the present invention are remarkably enhanced when the magenta coupler represented by formula (M-II) is used.

TABLE E

| Sample No. | Resin (Presence/ absence of layer) | Kinds and amounts of solid dispersed compound (note 1) | Amount of gel coating of layer containing solid - dispersed compound | Kinds of magenta coupler | Kinds and amount of water soluble bromide | Sharpness Y | Sharpness M | Sharpness C | Humidity dependency of exposure | Remarks |
|---|---|---|---|---|---|---|---|---|---|---|
| 616 | Absence | D + F | 1.3 g/m$^2$ | M-1 | KBr 0.01 mol/ mol of Ag | 25 | 30 | 30 | −0.01 | Example of invention |
| 627 | " | " | " | M-2 | KBr 0.01 mol/ mol of Ag | 25 | 30 | 30 | −0.02 | Example of invention |
| 628 | " | " | " | M-4 | KBr 0.01 mol/ mol of Ag | 25 | 30 | 30 | −0.02 | Example of invention |
| 701 | " | " | " | M-7 | KBr 0.01 mol/ mol of Ag | 25 | 25 | 30 | −0.04 | Example of invention |
| 702 | " | " | " | M-15 | KBr 0.01 mol/ mol of Ag | 25 | 25 | 30 | −0.04 | Example of invention |
| 703 | " | " | " | M-20 | KBr 0.01 mol/ mol of Ag | 25 | 25 | 30 | −0.05 | Example of invention |
| 704 | " | " | " | M-34 | KBr 0.01 mol/ mol of Ag | 25 | 25 | 30 | −0.05 | Example of invention |

Note)
A: Dye 1 (150 mg/m$^2$)
B: Dye 2 (150 mg/m$^2$)
C: Dye 3 (150 mg/m$^2$)
D: Dye 4 (150 mg/m$^2$)
E: Dye 5 (30 mg/m$^2$)
F: Dye 6 (30 mg/m$^2$)
G: Dye 7 (30 mg/m$^2$)
H: Dye 8 (150 mg/m$^2$)
I: Dye 9 (150 mg/m$^2$)
(Values in parentheses indicate the amounts of dies applied.)

Example 8

Samples 801–831 corresponding to Samples 601–631 used in Example 6 were prepared in the same manner excepting that the amounts of the first, third and fifth layers applied to the support were decreased to 0.5-fold, 0.5-fold and 0.41-fold, respectively, and that the support was replaced with a paper support having polyethylene film laminated on both sides thereof (14% by weight of titanium oxide was mixed into the polyethylene film on the side on which an emulsion was applied). To use Sample 801 as an index in terms of sharpness, Sample 801 was made by using a cellulose support which is coated by the same resinous backing layer as that of Sample 601.

About these samples, sharpness and humidity dependency of exposure were tested in the same manner as in Example 6 excepting that the developing process was changed as follows. However, the resinous backing layer of Sample 801 was removed, before developing process, in accordance with the process used in Example 5. Moreover, to evaluate their photographic characteristics based on reflected light, an opaque liquid (MISNON, product of Lion Jimuki, Co.) is applied to the surface of the support opposite to the surface on which images are formed, after the developing process. The results of evaluation of the photographic characteristics revealed that these samples exhibited the same effects as in Example 6.

| Processing step | Temperature | Time | Amount of replenishment | Volume of tank |
|---|---|---|---|---|
| Color development | 38.5° C. | 45 sec. | 73 ml | 500 ml |
| Bleaching/fixing | 30–35° C. | 45 sec. | | |
| Rinsing (1) | 30–35° C. | 20 sec. | | |
| Rinsing (2) | 30–35° C. | 20 sec. | | |
| Rinsing (3) | 30–35° C. | 20 sec. | | |
| Drying | 70–80° C. | 60 sec. | | |

note: the amount of replenishment is per m$^2$. (Rinsing was performed by 3-tank counterflow from (3) to (1))

The compositions of the processing solutions were as follows:

[Color developing solution]

| | Tank solution | Replenishing solution |
|---|---|---|
| Water | 700 ml | 700 ml |
| Triisopropylene(β)sulfonic acid | 0.1 g | 0.1 g |
| Ethylene diaminetetraacetic acid | 3.0 g | 3.0 g |
| 2Na salt of 1,2-dihydroxybenzene-4,6-disulfonic acid | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |

-continued

| | Tank solution | Replenishing solution |
|---|---|---|
| Fluorescent whitening agent (WHITEX 4, product of Sumitomo Kagaku Co.) | 1.0 g | 3.0 g |
| Sodium sulfite | 0.1 g | 0.1 g |
| Disodium-N,N-bis(sulfonate ethyl) hydroxylamine | 10.0 g | 13.0 g |
| N-ethyl-N-(β-methanesulfonamide ethyl)-3-methyl-4-aminoaniline sulfate | 5.0 g | 11.5 g |
| Total amount after adding water | 1000 ml | 1000 ml |
| pH (at 25° C.) | 10.0 | 10.0 |

[Bleaching/fixing solution (the tank solution and the replenishing solution are the same)]

| | |
|---|---|
| Water | 600 ml |
| Ammonium thiosulfate (700 g/liter) | 100 ml |
| Ammonium sulfite | 40 g |
| Ammonium (ethylenediamine tetraacetate)iron (III) | 55 g |
| Disodium (ethylenediamine tetraacetate)iron (II) | 5 g |
| Ammonium bromide | 40 g |
| Nitric acid (67%) | 30 g |
| Total amount after adding water | 1000 ml |
| pH (at 25° C., adjusted with acetic acid and ammonia water | 5.8 |

[Rinsing solution (the tank solution and the replenishing solution are the same)]

Ion exchanged water (amounts of calcium and magnesium are not greater than 3 ppm)

Example 9

About Samples 500–531 prepared in Examples 5, exposure for sensitometry was effected through a G filter, and each sample was thereafter processed according to the process, ECP-2, while selectively using color development solutions having pH's of 10.53 and 10.73, respectively. The transparent density of the samples thus processed was measured to evaluate their sensitivity. Based on the difference in sensitivity between the case in which the process was performed using a color development solution having a pH of 10.53 and the case in which the process was performed using a color development solution having a pH of 10.73, the stability of the photographic characteristics with respect to variations in the state of the processing solutions were tested. The results are shown in Table F.

It is apparent from Table F that variations in the photographic characteristics with respect to variations in the state of the processing solutions were diminished.

TABLE F

| Sample No. | Variation in sensitivity | Remarks |
|---|---|---|
| 500 | — | Comparative example |
| 501 | +0.02 | " |
| 502 | +0.02 | " |
| 503 | +0.02 | " |
| 504 | +0.02 | " |
| 505 | +0.11 | " |
| 506 | +0.11 | " |
| 507 | +0.12 | " |
| 508 | +0.16 | " |
| 509 | +0.03 | " |
| 510 | +0.03 | " |
| 511 | +0.02 | " |
| 512 | +0.02 | " |
| 513 | +0.10 | " |
| 514 | +0.11 | " |
| 515 | +0.11 | " |
| 516 | +0.01 | Example of invention |
| 517 | +0.01 | " |
| 518 | +0.01 | " |
| 519 | +0.04 | Comparative example |
| 520 | +0.04 | " |
| 521 | +0.04 | " |
| 522 | +0.01 | Example of invention |
| 523 | +0.01 | " |
| 524 | +0.16 | Comparative example |
| 525 | +0.02 | Example of invention |
| 526 | +0.01 | " |
| 527 | +0.01 | " |
| 528 | +0.01 | " |
| 529 | +0.09 | Comparative example |
| 530 | +0.09 | " |
| 531 | +0.01 | Example of invention |

What is claimed is:

1. A silver halide color photographic light-sensitive material which comprises a support having thereon photographic constituting layers comprising a blue sensitive silver halide emulsion layer containing a yellow coupler, a green sensitive silver halide emulsion layer containing a magenta coupler, a red sensitive silver halide emulsion layer containing a cyan coupler, and at least one light-insensitive hydrophilic colloidal layer, comprising in combination or separately, at least one compound represented by the following formula (1):

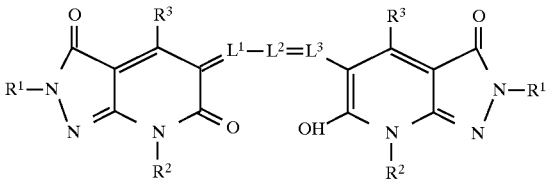

(1)

wherein $R^1$ represents a hydrogen atom, an alkyl group, an aryl group or a heterocyclic ring group, $R^2$ represents a hydrogen atom, an alkyl group, an aryl group, a heterocyclic ring group, $COR^4$ or $SO_2R^4$, $R^3$ represents a hydrogen atom, a cyano group, a hydroxyl group, a carboxyl group, an alkyl group, an aryl group, $CO_2R^4$, $OR^4$, $NR^5R^6$, $CONR^5R^6$, $NR^5COR^4$, $NR^5SO_2R^4$, or $NR^5CONR^5R^6$ (wherein $R^4$ represents an alkyl group or an aryl group, and $R^5$ and $R^6$ represent a hydrogen atom, an alkyl group or an aryl group), and $L^1$, $L^2$, and $L^3$ each independently represents a methine group; and at least one compound represented by the following formula (4):

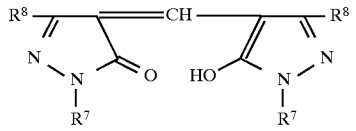

(4)

wherein $R^7$ is a hydrogen atom, an alkyl group, or an aryl group, and $R^8$ is an alkyl group or an aryl group, provided that each of the compounds represented by formulas (1) and (4) has, in the molecule, at least one dissociating group selected from the group consisting of carboxyl, sulfonamide, arylsulfamoyl, sulfonylcarbamoyl, carbonylsulfamoyl, an enol group, and phenolic hydroxyl, and each compound does not contain any other groups which render the compounds soluble in water, each compound being in a dispersion form of solid fine particles.

2. The silver halide color photographic light-sensitive material according to claim 1, wherein the hydrophilic colloidal layer is located between the support and the silver halide emulsion layer which is closest to the support, and contains at least one compound represented by formula (1) and at least one compound represented by formula (4) in a dispersion form of solid fine particles.

3. The silver halide color photographic light-sensitive material according to claim 2, wherein the ratio by weight of the total amounts of the compounds incorporated in dispersion forms of solid fine particles to the amount of hydrophilic colloids contained in the hydrophilic colloidal layer which is present between the support and the silver halide emulsion layer closest to the support is in the range from 0.05 to 0.3.

4. The silver halide color photographic light-sensitive material according to claim 1, wherein the hydrophilic colloidal layer, between the support and the blue-sensitive silver halide emulsion layer, contains at least one compound of formula (4), and another hydrophilic colloidal layer, between the blue-sensitive silver halide emulsion layer and the red-sensitive silver halide emulsion layer, contains at least one compound represented by formula (1).

5. The silver halide color photographic light-sensitive material according to claim 1, wherein an antistatic layer is provided by application thereof on the surface of the support opposite the surface on which the silver halide emulsion layer is provided.

6. The silver halide color photographic light-sensitive material according to claim 1, wherein one or more of $R^1$, $R^2$, $R^3$, $R^4$, $R^5$, and $R^6$ are alkyl groups which have 1 to 6 carbon atoms and may have a substituent.

7. The silver halide color photographic light-sensitive material according to claim 6, wherein the substituent is selected from hydroxyl, carboxyl, cyano, nitro, alkoxy, halogen, aryl, amino, acylamino, sulfonamide, carbamoyl, and sulfamoyl groups.

8. The silver halide color photographic light-sensitive material according to claim 1, wherein one or more of $R^1$, $R^2$, $R^3$, $R^4$, $R^5$, and $R^6$ are aryl groups selected from phenyl or naphthyl groups which may have a substituent.

9. The silver halide color photographic light-sensitive material according to claim 8, the substituent is a group or an atom selected from hydroxyl, carboxyl, cyano, nitro, alkoxy, halogen, amino, acylamino, sulfonamide, carbamoyl, sulfamoyl, ureido, alkyl, and ester.

10. The silver halide color photographic light-sensitive material according to claim 1, wherein one or more of $R^1$ and $R^2$ are 5-membered or 6-membered nitrogen-containing heterocyclic rings having at least one nitrogen atom, which may have a substituent.

11. The silver halide color photographic light-sensitive material according to claim 10, wherein the substituent is a group or an atom selected from hydroxyl, carboxyl, cyano, halogen, acylamino and sulfonamide.

12. The silver halide color photographic light-sensitive material according to claim 1, the compounds represented by formula (1) are those in which $R^1$ is a phenyl group having at least one group selected from the group consisting of carboxyl, sulfonamide, and sulfamoyl; $R^2$ is hydrogen; $R^3$ is a hydrogen atom, an alkyl group having 1 to 4 carbon atoms, an ester group, or a carboxyl group; and $L^1$, $L^2$, and $L^3$ are respectively an unsubstituted methine group.

13. The silver halide color photographic light-sensitive material according to claim 12, wherein $R^1$ is selected from the group consisting of 4-carboxyphenyl, 3-carboxyphenyl, 2-carboxyphenyl, 3,3-dicarboxyphenyl, 2,4-dicarboxyphenyl, 2,5-dicarboxyphenyl, 4-methanesulfonamidephenyl, 4-benzenesulfonamidephenyl, 4-sulfamoylphenyl, and 4-(N-phenylsulfamoyl)phenyl; and $R^3$ is a hydrogen atom or a methyl group.

14. The silver halide color photographic light-sensitive material according to claim 1, wherein the compounds represented by formula (1) is selected from:

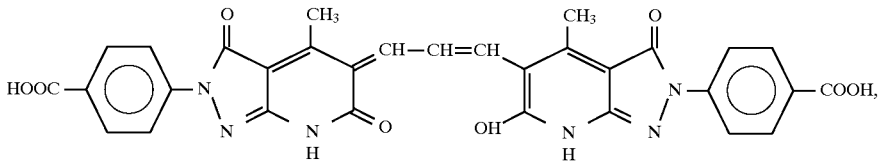

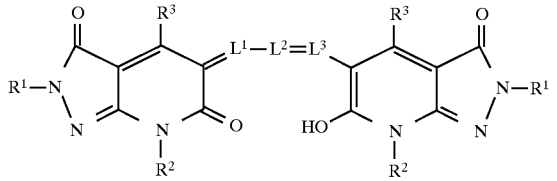

| | $-R^1$ | $-R^2$ | $-R^3$ | $=L^1-L^2=L^3-$ |
|---|---|---|---|---|
| 1-1 | 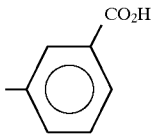 | $-H$ | $-CH_3$ | $=CH-CH=CH-$ |
| 1-2 | 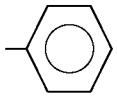 | $-H$ | $-CH_3$ | $=CH-CH=CH-$ |
| 1-3 | $-CH_3$ | $-H$ | $-CH_3$ | $=CH-CH=CH-$ |
| 1-4 | 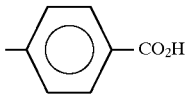 | $-CH_3$ | $-CH_3$ | $=CH-CH=CH-$ |
| 1-5 | 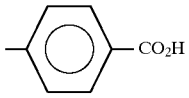 | 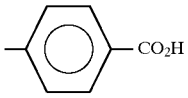 | $-CH_3$ | $=CH-CH=CH-$ |
| 1-6 | 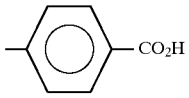 | $-CH_3$ | $-CO_2C_2H_5$ | $=CH-CH=CH-$ |
| 1-7 | 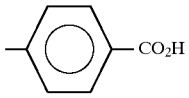 | $-CH_3$ | $-CO_2H$ | $=CH-CH=CH-$ |
| 1-8 | $-CH_3$ | 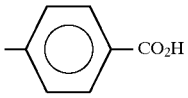 | $-CH_3$ | $=CH-CH=CH-$ |
| 1-9 | $-CH_3$ | 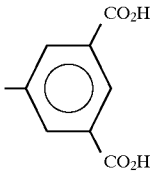 | $-CH_3$ | $=CH-CH=CH-$ |
| 1-10 | $-CH_3$ | $-CH_3$ | $-CH_3$ | $=CH-CH=CH-$ |
| 1-11 | 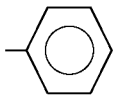 | 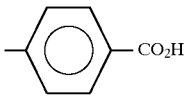 | $-CH_3$ | $=CH-CH=CH-$ |
| 1-12 | 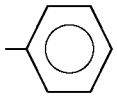 | 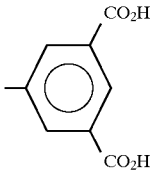 | $-CH_3$ | $=CH-CH=CH-$ |
| 1-13 | 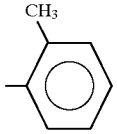 | 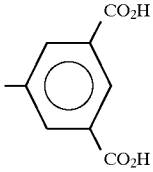 | $-CH_3$ | $=CH-CH=CH-$ |
| 1-14 | 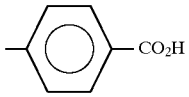 | $-H$ | $-CH_3$ | $=CH-C(CH_3)=CH-$ |

| | | | | |
|---|---|---|---|---|
| 1-15 | 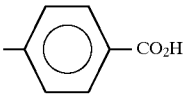 | $-H$ | $-CO_2C_2H_5$ | $=CH-CH=CH-$ |
| 1-16 | 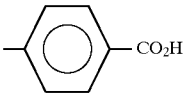 | $-H$ | $-CO_2H$ | $=CH-CH=CH-$ |
| 1-17 | 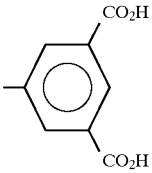 | $-H$ | $-CH_3$ | $=CH-CH=CH-$ |
| 1-18 | 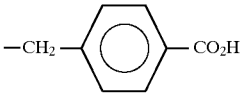 | $-H$ | $-CH_3$ | $=CH-C(CH_3)=CH-$ |
| 1-19 | 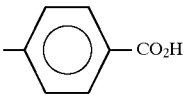 | $-CH_2CH_2OH$ | $-H$ | $=CH-CH=CH-$ |
| 1-20 | 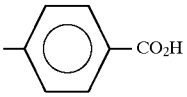 | $-CH_2CO_2H$ | $-CH_3$ | $=CH-C(CH_3)=CH-$ |
| 1-21 | 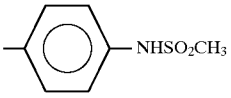 | $-H$ | $-CH_3$ | $=CH-CH=CH-$ |
| 1-22 | 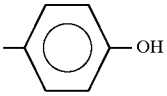 | $-H$ | $-CH_3$ | $=CH-CH=CH-$ |
| 1-23 | $-CH_2CH_2OH$ | $-H$ | $-CH_3$ | $=CH-CH=CH-$ |
| 1-24 | $-CH_3$ | $-CH_2CH_2OH$ | $-CH_3$ | $=CH-CH=CH-$ |
| 1-25 | $-H$ | 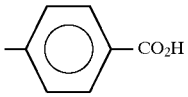 | $-CH_3$ | $=CH-CH=CH-$ |
| 1-26 | $-H$ | $-H$ | $-CO_2H$ | $=CH-CH=CH-$ |
| 1-27 | 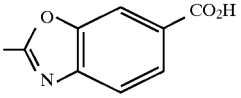 | $-H$ | $-C_2H_5$ | $=CH-CH=CH-$ |
| 1-28 | 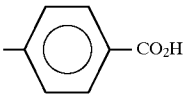 | $-SO_2CH_3$ | $-CO_2CH_3$ | $=CH-C(CH_3)=CH-$ |
| 1-29 | 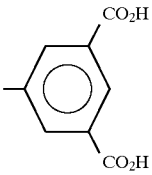 | $-COCH_3$ | $-CH_3$ | $=CH-CH=CH-$ |

| | | | | |
|---|---|---|---|---|
| 1-30 | $-H$ | 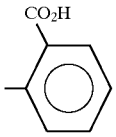 | $-CH_3$ | $=CH-CH=CH-$ |
| 1-31 | 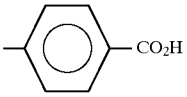 | 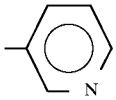 | $-CH_3$ | $=CH-C(CH_3)=CH-$ |
| 1-32 | 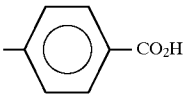 | $-CH_3$ | $-CN$ | $=CH-CH=CH-$ |
| 1-33 | 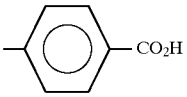 | $-H$ | $-H$ | $=CH-CH=CH-$ |
| 1-34 | 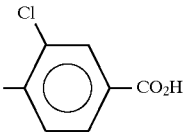 | $-H$ | $-OC_2H_5$ | $=CH-CH=CH-$ |
| 1-35 | 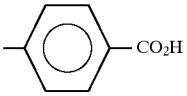 | $-H$ | $-C_4H_9(n)$ | $=CH-CH=CH-$ |
| 1-36 | 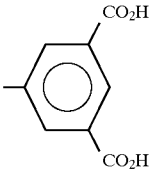 | $-CH_3$ | $-NHCH_3$ | $=CH-CH=CH-$ |
| 1-37 | 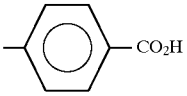 | $-COCH_3$ | $-NHCOCH_3$ | $=CH-CH=CH-$ |
| 1-38 | 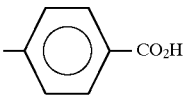 | $-CO_2CH_3$ | $-NHSO_2CH_3$ | $=CH-CH=CH-$ |
| 1-39 | 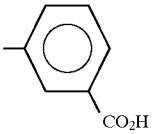 | $-CH_2CH_2OH$ | $-CH_3$ | $=CH-CH=CH-$ |
| 1-40 | $-CH_2CH_2CN$ | $-H$ | $-CH_3$ | $=CH-CH=CH-$ |
| 1-41 | 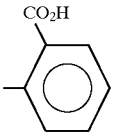 | $-H$ | $-CH_3$ | $=CH-CH=CH-$ |
| 1-42 | 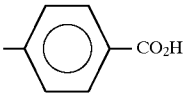 | $-H$ | $-C_2H_5$ | $=CH-CH=CH-$ |
| 1-43 | 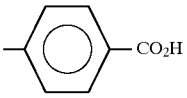 | $-CH_2CH_2OCH_3$ | $-CH_3$ | $=CH-C(C_2H_5)=CH-$ |

| | | | | |
|---|---|---|---|---|
| 1-44 | 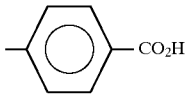 | $-H$ | $-CH_3$ | $=CH-\overset{Cl}{\overset{\vert}{C}}=CH-$ |
| 1-45 | 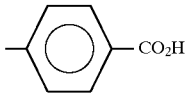 | $-H$ | $-CO_2H$ | $=CH-\overset{CH_3}{\overset{\vert}{C}}=CH-$ |
| 1-46 | 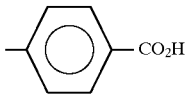 | $-H$ | $-CO_2H$ | $=CH-\overset{Cl}{\overset{\vert}{C}}=CH-$ |
| 1-47 | $-CH_2CH_2CN$ | 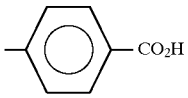 | $-CH_3$ | $=CH-CH=CH-$ |
| 1-48 | $-CH_2CH_2CN$ | 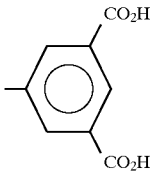 | $-CH_3$ | $=CH-CH=CH-$ |

15. The silver halide color photographic light-sensitive material according to claim 1, wherein the compound of formula (4) is selected from the following formulas:

3-1

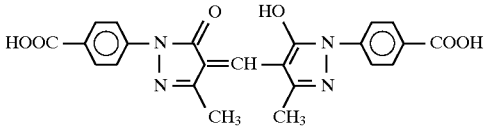

3-2

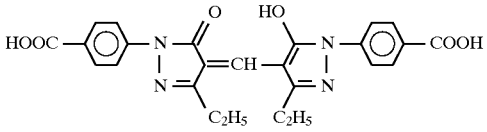

3-3

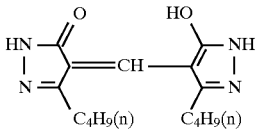

3-4

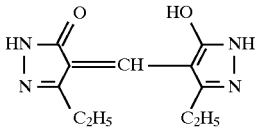

3-9

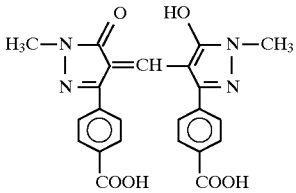

16. The silver halide color photographic light-sensitive material according to claim 1, wherein the amounts of the compound represented by formula (1) and the compound represented by formula (4) are from $5\times10^{-2}$ mol/m$^2$ to $5\times10^{-7}$ mol/m$^2$, respectively.

17. The silver halide color photographic light-sensitive material according to claim 1, wherein the average particle sizes of the compound represented by formula (1), and the compound represented by formula (4) are from 0.005 micrometers to 10 micrometers, respectively.

18. The silver halide color photographic light-sensitive material according to claim 1, wherein the silver halide emulsion in at least one of the silver halide emulsion layers does not substantially contain silver iodide, and is silver chloridebromide or silver chloride in which the silver chloride content is 90 mol % or more.

19. A silver halide color photographic light-sensitive material comprising a support having thereon photographic constituting layers comprising at least one light-sensitive silver halide emulsion layer containing a yellow coupler, at least one light-sensitive silver halide emulsion layer containing a magenta coupler, at least one light-sensitive silver halide emulsion layer containing a cyan coupler, and at least one light-insensitive hydrophilic colloidal layer, wherein at least one layer of said photographic constituting layers comprises at least one compound represented by the following formula (1) and at least one compound represented by the following formula (4):

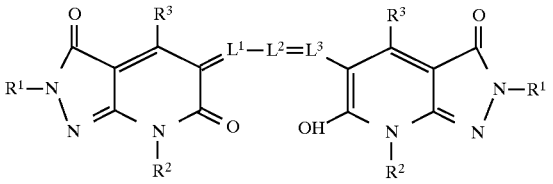

(1)

wherein $R^1$ represents a hydrogen atom, an alkyl group, an aryl group or a heterocyclic ring group, $R^2$ represents a hydrogen atom, an alkyl group, an aryl group, a heterocyclic ring group, $COR^4$ or $SO_2R^4$, $R^3$ represents a hydrogen atom, a cyano group, a hydroxyl group, a carboxyl group, an alkyl group, an aryl group, $CO_2R^4$, $OR^4$, $NR^5R^6$, $CONR^5R^6$, $NR^5COR^4$, $NR^5SO_2R^4$, or $NR^5CONR^5R^6$ (wherein $R^4$ represents an alkyl group or an aryl group, and $R^5$ and $R^6$ represent a hydrogen atom, an alkyl group or an aryl group), and $L^1$, $L^2$, and $L^3$ each independently represents a methine group;

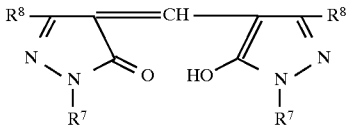

(4)

wherein $R^7$ is a hydrogen atom, an alkyl group, or an aryl group, and $R^8$ is an alkyl group or an aryl group, provided that each of the compounds represented by formulas (1) and (4) has, in the molecule, at least one dissociating group selected from the group consisting of carboxyl, sulfonamide, arylsulfamoyl, sulfonylcarbamoyl, carbonylsulfamoyl, an enol group of an oxonole dye, and phenolic hydroxyl groups, and each compound does not contain any other groups which render the compounds soluble in water, each compound being in a dispersion form of solid fine particles, at least one magenta coupler contained in said light-sensitive silver halide emulsion layer containing the magenta coupler is a compound represented by the following formula (M-I), said light-sensitive silver halide emulsion layer containing the magenta coupler comprises at least one selected from the group consisting of silver chlorobromide, silver chloroiodobromide, silver chloroiodide and silver chloride emulsion particles, each of said silver halides containing silver chloride in an amount not less than 70 mol %, and said emulsion particles are formed by adding, into a system containing said silver halide particles, at least one of a bromine ion releasing compound and a bromine atom releasing compound in an amount of 0.0005–0.05 mol per mol of the silver halide at any time during a period from completion of the formation of the silver halide particles to its application onto the support,

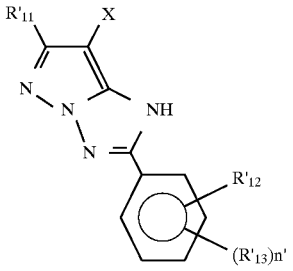

(M-I)

wherein $R'_{11}$ is a group represented by the following formula (Q-1) , (Q-2) or (Q-3):

$$—C(R'_{14})(R'_{15})—R'_{16} \quad \text{(Q-1)}$$

wherein $R'_{14}$ is alkyl, cycloalkyl, aryl or heterocyclic ring group, $R'_{15}$ and $R'_{16}$ are substituents, and $R'_{14}$, $R'_{15}$ and $R'_{16}$ may be linked to each other to form a single ring or condensed ring having 5–7 members, $$—CH(R'_{17})—R'_{18} \quad \text{(Q-2)}$$

wherein $R'_{17}$ is alkyl, cycloalkyl, aryl or heterocyclic ring group, $R'_{18}$ represents a substituent, and $R'_{17}$ and $R'_{18}$ may be linked to each other to form a single ring or condensed ring having 5–7 members,

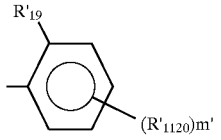

(Q-3)

wherein $R'_{19}$ and $R'_{110}$ are substituents, and m' is a number of 0–4, provided that plural $R'_{110}$ may be the same or different when m' is not less than 2, $R'_{12}$ and $R'_{13}$ are substituents, n' is a number of 0–4, and X is a halogen atom or a group which is releasable by a coupling reaction with an oxidized developing agent, provided that plural $R'_{13}$ may be the same or different when n' is a number not less than 2.

20. The silver halide color photographic light-sensitive material according to claim 19, wherein the hydrophilic colloidal layer is located between the support and the light-sensitive halide emulsion layer which is closest to the support, and contains at least one compound represented by formula (1) and at least one compound represented by formula (4) in a dispersion form of solid fine particles.

21. The silver halide color photographic light-sensitive material according to claim 20, wherein the ratio by weight of the total amounts of the compounds incorporated in dispersion forms of solid fine particles to the amount of the hydrophilic colloids contained in the hydrophilic colloidal layer which is present between the support and the light-sensitive silver halide emulsion layer closest to the support is in the range from 0.05 to 0.3.

22. The silver halide color photographic light-sensitive material according to claim 19, wherein an antistatic layer is provided by application thereof on the surface of the support opposite the surface on which the light-sensitive silver halide emulsion layers are provided.

23. The silver halide color photographic light-sensitive material according to claim 19, wherein $R'_{11}$ in the magenta coupler contained in the light-sensitive silver halide emulsion layer containing the magenta coupler and represented by formula (M-1) is a coupler represented by one selected from the group of formulas (Q-1) and (Q-2).

24. The silver halide color photographic light-sensitive material according to claim 19, wherein the magenta coupler contained in the light-sensitive silver halide emulsion layer containing the magenta coupler and represented by formula (M-1) is a coupler represented by the following formula (M-II):

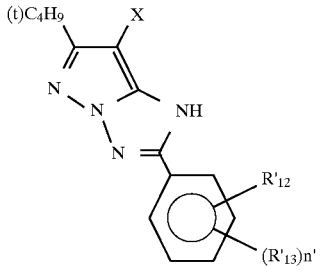

(M-II)

wherein $R'_{12}$, $R'_{13}$, n' and X have the same meanings as defined in formula (M-1).

25. The silver halide color photographic light-sensitive material according to claim 1, wherein said compounds of formulae (1) and (4) are present in the same light-insensitive hydrophilic colloidal layer.

* * * * *